US007786435B2

(12) United States Patent
Whitehouse et al.

(10) Patent No.: US 7,786,435 B2
(45) Date of Patent: Aug. 31, 2010

(54) RF SURFACES AND RF ION GUIDES

(75) Inventors: Craig M. Whitehouse, Branford, CT (US); David G. Welkie, Branford, CT (US); Lisa Cousins, Branford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 211 days.

(21) Appl. No.: 12/111,484

(22) Filed: Apr. 29, 2008

(65) Prior Publication Data

US 2008/0296495 A1 Dec. 4, 2008

Related U.S. Application Data

(63) Continuation of application No. 11/133,724, filed on May 20, 2005, now Pat. No. 7,365,317.

(60) Provisional application No. 60/573,667, filed on May 21, 2004.

(51) Int. Cl.
*H01J 49/42* (2006.01)

(52) U.S. Cl. ..... 250/292; 250/290; 250/287; 250/396 ML

(58) Field of Classification Search ..... 250/292, 250/290, 287, 396 R, 396 ML
See application file for complete search history.

(56) References Cited

U.S. PATENT DOCUMENTS

| | | | |
|---|---|---|---|
| 3,334,225 | A | 8/1967 | Langmuir |
| 4,542,293 | A | 9/1985 | Fenn et al. |
| 4,963,736 | A | 10/1990 | Douglas et al. |
| 5,179,278 | A | 1/1993 | Douglas |

(Continued)

FOREIGN PATENT DOCUMENTS

| | | |
|---|---|---|
| EP | 1137044 | 9/2001 |

(Continued)

OTHER PUBLICATIONS

Chien and Lubman, "Analysis of the Fragments from Collission-Induced Dissociation of Electrospray-Produced Peptide Ions Using a Quadropole Ion Trap Storage/Reflectron Time-of-Flight Mass Spectrometer," *Anal. Chem.* 66, 1630-1636 (1994).

(Continued)

*Primary Examiner*—Kiet T Nguyen
(74) *Attorney, Agent, or Firm*—Fish & Richardson P.C.

(57) ABSTRACT

Apparatus and methods are provided for trapping, manipulation and transferring ions along RF and DC potential surfaces and through RF ion guides potential wells are formed near RF-field generating surfaces due to the overlap of the radio-frequency (RF) fields and electrostatic fields created by static potentials applied to surrounding electrodes. Ions can be constrained and accumulated over time in such wells During confinement, ions may be subjected to various processes, such as accumulation, fragmentation, collisional cooling, focusing, mass-to-charge filtering, spatial separation ion mobility and chemical interactions, leading to improved performance in subsequent processing and analysis steps, such as mass analysis. Alternatively, the motion of ions may be better manipulated during confinement to improve the efficiency of their transport to specific locations, such as an entrance aperture into vacuum from atmospheric pressure or into a subsequent vacuum stage.

53 Claims, 33 Drawing Sheets

U.S. PATENT DOCUMENTS

| | | | | |
|---|---|---|---|---|
| 5,572,035 | A * | 11/1996 | Franzen | 250/396 R |
| 5,652,427 | A | 7/1997 | Whitehouse et al. | |
| 5,689,111 | A | 11/1997 | Dresch et al. | |
| 5,853,294 | A | 12/1998 | Rehder | |
| 5,962,851 | A | 10/1999 | Whitehouse et al. | |
| 6,011,259 | A | 1/2000 | Whitehouse et al. | |
| 6,020,586 | A | 2/2000 | Dresch et al. | |
| 6,111,250 | A | 8/2000 | Thomson et al. | |
| 6,188,066 | B1 | 2/2001 | Whitehouse et al. | |
| 6,403,953 | B2 | 6/2002 | Whitehouse et al. | |
| 6,683,301 | B2 | 1/2004 | Whitehouse et al. | |
| 6,707,037 | B2 | 3/2004 | Whitehouse | |
| 6,872,941 | B1 * | 3/2005 | Whitehouse et al. | 250/288 |
| 2002/0175292 | A1 | 11/2002 | Whitehouse et al. | |

FOREIGN PATENT DOCUMENTS

| | | |
|---|---|---|
| WO | 2004/021385 | 3/2004 |

OTHER PUBLICATIONS

Ji et al., "A Segmented Ring, Cylindrical Ion Trap Source for Time-of-Flight Mass Spectrometry," *J. Amer. Soc. Mass. Spec.* 7, 1009 (1996).

Grix et al., "An Electron Impact Storage Ion Source for Time-of-Flight Mass Spectometers," *Int. J. Mass. Spectrom. Ion Processes* 93, 323 (1989).

Dehmelt, "Radiofrequency of Spectroscopy of Stored Ions I: Storage," *Adv. At. Mol. Physics* 3, 59 (1963).

International Search Report for corresponding PCT application PCT/US2005/017748 dated Aug. 25, 2006.

T. Bergmann et al., "High-resolution time-of-flight mass spectrometer," 60(4) *Rev. Sci. Instrum.* 792-93 (1989).

James G. Boyle & Craig M. Whitehouse, "Time-of-Flight Mass Spectrometry with an Electrospray Ion Beam," 64 *Analytical Chem.* 2084-89 (1992).

John Coles & Michael Guilhaus, "Orthogonal acceleration—a new direction for time-of-flight mass spectrometry: fast, sensitive mass analysis for continuous ion sources," 12(5) *Trends in Analytical Chem.* 203-13 (1993).

J.H.J. Dawson & M. Guilhaus, "Orthogonal-acceleration Time-of-flight Mass Spectrometer," 3(5) *Rapid Comm. Mass. Spec.* 155-59 (1989).

A.F. Dodonov et al., "Atmospheric Pressure Ionization Time-of-Flight Mass Spectrometer," *Proc.* 12th *Int'l Mass. Spec. Conf.* 153 (1991).

G.L. Glish & D.E. Goeringer, "Tandem Quadrupole/Time-of-Flight Instrument for Mass Spectrometry/Mass Spectrometry," 56(13) Analytical Chem. 2291-29 (1984).

G.L. Glish et al., "Improved Performance of a Tandem Quadrupole/Time-of-Flight Mass Spectrometer," 16(1) Analytical Instrumentation 191-206 (1987).

D.W. Thomas, "The Reactions of Ions with Molecules in the Gas Phase and the Sputtering of Solid Surfaces by Ion Bombardment," Time-of-Flight Mass Spectrometry 171-210 (1969).

The American Heritage Dictionary of the English Language 1467 (3rd ed 1992).

Random house Webster's Unabridged Dictionary 1566 (2d ed 2001).

*McGraw-Hill Dictionary of Scientific & Technical Terms* 1520 (4th ed. 1989).

*Webster's Third New Int'l Dictionary* 1841 (1986).

B.A. Mamyrin & D.V. Shmikk, "The Linear Mass Reflectron," 49(5) *Sov. Phys. JETP* 762 (1979).

B.A. Mamyrin et al., "The mass-reflectron, a new nonmagnetic time-of-flight mass spectrometer with high resolution," 37 *Sov. Phys. JETP* 45 (1973).

Th.L. Grebner & H. J. Neusser, "Laser produced ions in a cylindrical ion trap & detected in a reflectron time-of-flight mass spectrometer," 137 Int'l Mass Spect. & Ion Processes L1-L6 (1994).

Hong Jie Xu et al., "A new cooling & focusing device for ion guide," 33 *Nuclear Inst. & Methods in Phys. Res.* A 274-81 (1993).

Claude Beaugrand et al., "How to Use a Standard Quadrupole Filter as a Two Dimensional Ion-Trap," *Proc.* 37th *ASMS Conf. On Mass Spectrometry & Allied Topics* (1989).

K.L. Busch, G.L. Glish, and S.A. McLuckey, "Mass Spectrometry/Mass Spectrometry: Techniques and Applications of Tandem Mass Spectrometry" (1989).

Steven M. Michael et al., "An ion trap storage/time-of-flight mass spectrometer," 63(10) Rev. Sci. Instrum. 4277-84 (1992).

Office Action dated Feb. 5, 2009 for corresponding Canadian application No. 2,567,466.

* cited by examiner

RF SURFACES AND RF ION GUIDES

RELATED APPLICATIONS

This application is a continuation of U.S. application Ser. No. 11/133,724 filed on May 20, 2005 issuing as U.S. Pat. No. 7,365,317 on Apr. 29, 2008, which claims the benefit of U.S. Provisional Application No. 60/573,667 filed on May 21, 2004—the disclosures of which are incorporated by reference herein.

FIELD OF THE INVENTION

The present invention relates to mass spectrometry and in particular to apparatus and methods for temporary storage, manipulation and transport of ions using a combination of radio-frequency fields and electrostatic fields in mass spectrometric analysis.

BACKGROUND OF THE INVENTION

The application of mass spectrometry to the chemical analysis of sample substances has grown in recent years due in large part to advances in instrumentation and methods. Such advances include improved ionization sources, more efficient ion transport devices, more sophisticated ion processing, manipulation and separation methods, and mass-to-charge (m/z) analyzers with greater performance. However, while much progress has been made in these areas, there remains the potential for substantial improvements.

In particular, compromises must often be made in order to maximize a particular performance characteristic or enable a particular functionality. For example, orthogonal pulse-acceleration has evolved as a preferred solution to the problem of coupling continuous ionization sources to a time-of-flight mass-to-charge analyzer (TOF MS), which require a well-defined pulsed introduction of ions This approach has been refined to the point that mass-to-charge resolving power greater than 10,000 full-width-at-half-maximum (FWHM) can now be routinely achieved with such configurations. However, there is often a trade-off between sensitivity and resolving power, for example, when portions of the angular and/or spatial distributions of the sampled ion population must be sacrificed in order to achieve high resolving power There may also be trade-offs between duty cycle directly related to sensitivity and m/z range, due to the reduction in repetition rate that is often required in order to accommodate the long flight times of high-m/z ions. Typically, a relatively small portion of the sample ion population from a continuous ion beam may be analyzed at a time, resulting in relatively low duty cycle efficiency. One approach to address such problems was described by Dresch, et al in U.S. Pat. No. 5,689,111 Essentially, a multipole ion guide, used to transportions generated in an ion source to a time-of-flight mass analyzer, was configured with an electrode at the exit end, to which potentials could be rapidly applied that either trap ions in the ion guide to store them between time-of-flight analyses, or release them into the time-of-flight pulsing region for analysis A substantial improvement in duty cycle efficiency was realized, which approached 100%, but only over a limited m/z range, depending on the relative timing of the release of ions from the ion guide and the pulsing of ions into the TOF analyzer. For ion m/z values outside the selected high duty cycle m/z range, this approach introduces a reduction in duty cycle due to the m/z separation that accompanies the transfer of ions released from the ion guide into the orthogonal pulse-acceleration region of the time-of-flight mass-to-charge analyzer. Hence, as the duty cycle efficiency is increased for a selected range of m/z values, the duty cycle decreases for m/z values outside the selected range. Nevertheless, enhancement of the duty cycle for a selective m/z range can be advantageous for some analytical applications, particularly in targeted analysis. For other analytical applications, however, a high duty cycle and sensitivity is required over a wider m/z range than could be achieved with the teaching of Dresch '111. The present invention improves the sensitivity of MS analysis, particularly TOF MS, over a wider range of m/z values.

There have been other ion storage approaches to address the inherently poor duty cycle efficiency of TOF analyzers For example, Lubman, et. al., in Anal. Chem 66, 1630 (1994), and references therein, describe a configuration which incorporates a Paul three-dimensional RF-quadrupole ion trap as the TOF pulsing region for externally-generated ions. Ions can be accumulated prior to pulsing them out of the trap and into the TOF drift region. However, the continuous transfer of externally-generated ions into such a three-dimensional RF-quadrupole ion trap is problematic because ions with energies low enough to be trapped will only be able to overcome the RF fields and enter the trap during a relatively short segment of the RF cycle time, resulting in a relatively low duty cycle. Another disadvantage is that such an electrode geometry produces pulsed TOF acceleration fields that are generally not optimum for achieving maximum TOF mass resolving power.

Also, Enke, et. al., J. Amer. Soc Mass Spec. 7, 1009 (1996) describe a three-dimensional planar electrode ion trap configured as the pulsing region of a TOF mass spectrometer Sample molecules are internally ionized by electron impact ionization and accumulated in the trap, before pulsing them into the TOF drift region for mass analysis. Relatively poor performance resulted from difficulties in efficient trapping of ions due to the non-ideal trapping fields, as well as from scattering of ions by the sample gas and by the gas introduced to collisionally cool the ions in the trap, which degrades TOF mass resolution and sensitivity Grix, et al., had previously described a more direct approach in Int. J Mass Spectrom. Ion Processes 93, 323 (1989) in which an electron beam is directed to pass through the TOF pulsing region to ionize sample gas molecules. The electron beam is sufficiently intense so that the local potential well produced by the electrons traps a substantial number of ions, until they are pulsed into the TOF drift region for mass analysis Disadvantages of this approach, as well as that of Enke, et al., include; 1) sample gas is introduced directly into the TOF optics, degrading the vacuum and causing ion scattering; 2) electron impact ionization results in substantial fragmentation which renders this ionization method impractical for mass analysis of many types of samples, such as large biomolecules; and 3) the sample needs to be introduced into the TOF as a gas, which makes this approach incompatible with non-volatile samples; and 4) the ionization efficiency is relatively small given the poor overlap between the neutral sample molecules and the electron beam.

More recently, Whitehouse et al., describe in U.S. Pat. Nos. 6,683,301 B2 and 6,872,941 another type of ion trapping configuration incorporated into the pulsing region of a TOF analyzer. Essentially, the pulsing electrode in this region is configured as an array of small electrodes arranged along a surface, typically a planar surface. Opposite phases of an RF waveform are applied to neighboring electrodes, thereby generating an RF field highly localized above the array, and conforming to the array surface, as taught by Franzen in U.S. Pat. No. 5,572,035. Such a field acts to repel ions that come close to the array surface, so that, in conjunction with DC potentials applied to additional surrounding electrodes, an effective so-called 'pseudopotential' well is formed immediately above the electrode array surface, that is, the 'RF surface', in which ions may be trapped Because the RF fields are highly localized at the RF array surface, ions may be readily transferred into the pulsing region, away from the influence of the RF field during the transfer, with high efficiency Consequently, Whitehouse '301 and '941 teach that ions may be accumulated in such a trap between TOF introduction pulses, resulting in TOF performance improvements, including reduced m/z discrimination, increased duty cycle efficiency, and improved resolving power.

However, the inventions disclosed by Whitehouse '301 and '941 require that the RF fields generated by an RF surface be sufficiently intense that ions are not able to come close enough to the RF surface to be trapped in the local potential wells between the RF electrodes Ions are trapped within essentially a one-dimensional well normal to the RF surface, but are free to move in directions parallel to the RF surface, being trapped in these directions only by voltages applied to electrodes at the boundaries of the pulsing region, resulting in a contained two-dimensional ion 'gas', more or less. While such configurations lead to improved TOF performance, nevertheless, the relatively poor localization of trapped ions parallel to the RF surface precludes additional possible improvements and functionalities. For example, fragmentation of trapped ions by photon-induced dissociation via a focused, pulsed laser beam is relatively inefficient because the laser beam pulse is able to intersect only a small fraction of the trapped ion population with each pulse. Further, any interaction between trapped ions and other reagent species, such as electron transfer dissociation (ETD) ions, is relatively inefficient without better spatial localization of the reactant species. Even further, any opportunity to manipulate the spatial distribution of trapped ions is severally limited, such as the ability to control the separation of the trapped ion population into sub-populations which are then directed to different TOF detectors, thereby providing better dynamic range, as described by Whitehouse, et al., in U.S. Application Publication No. 20020175292. The present invention provides such local three-dimensional trapping, thereby enabling these, and additional, TOF performance and functionality improvements.

Another area in which progress has been made in recent years, but for which the potential for substantial improvement remains, is the transport of ions from atmospheric pressure ionization (API) sources to a mass-to-charge analyzer in vacuum. Generally, ions produced at atmospheric pressure are transported through an atmospheric-pressure/vacuum interface, and then typically through a series of vacuum pumping stages to a mass-to-charge analyzer under vacuum. A major challenge with such interfaces is to direct as many of the ions produced at atmospheric pressure through one or more small orifices comprising the API interface. This is generally accomplished by a combination of electrostatic electric fields and gas flow dynamics Focusing ions toward the orifice into vacuum in an API source is typically conducted by applying a DC voltage gradient between the first API interface orifice electrode and the surrounding electrodes. The motion of ions through atmospheric pressure is strongly damped by collisions with background gas, so ion motion is determined by a combination of electric field and gas flow forces. While the applied electrostatic field is effective at drawing the ions in close to the orifice, the same electric field lines terminating on the face or edge of the orifice into vacuum direct the ions onto the conductive surface or edge where they are lost. A portion of the ions directed near the orifice into vacuum are swept through the orifice by the gas expanding into vacuum. The opposing requirements of high electric fields for ion focusing, and low electric fields for ion transport driven by gas dynamics, has resulted in inefficient transport of ions produced at or near atmospheric pressure into vacuum. The present invention provides improvements in the efficiency of ion transport from atmosphere through an orifice into vacuum by mitigating the impact of these competing requirements.

Another challenge has been to transportions efficiently through multiple vacuum pumping stages. Generally, multiple vacuum regions separated by vacuum partitions are employed to achieve good vacuum in a downstream vacuum pumping stage, which may, for example, contain a mass-to-charge analyzer. RF multipole ion guides have long been used to transportions through an individual vacuum stage, and ions have been transported from one stage to the next by focusing them through a vacuum orifice in the vacuum partition between the stages. A significant improvement in the transmission efficiency of ions between vacuum stages was realized with the development of RF multipole ion guides that extend continuously through the vacuum partition between vacuum pumping stages, while also effectively limiting gas flow between the stages, similar to the effect of a vacuum partition orifice, as taught by Whitehouse, et al., in U.S. Pat. Nos. 5,652,427; 5,962,851; 6,188,066; and 6,403,953 Nevertheless, there remain compromises in these configurations between maximizing ion transport efficiency and minimizing gas flow between vacuum pumping stages. The inventions disclosed herein provide improvements over prior art for ion transport, while simultaneously reducing gas flow, between vacuum stages.

The aforementioned deficiencies in the art are addressed and improvements are provided by the inventions disclosed herein,

SUMMARY OF THE INVENTION

Ions in RF multipole ion guides experience alternating attractive and repulsive forces, due to the alternating electric voltages applied to adjacent electrodes. Integrated over time, the RF surface operates as an ion repulsive surface A surface of multipole tips approaches the behavior of an RF surface with an infinitely large number of poles, producing a wide field free region bordering on very steep repulsive walls. The ion interaction with the RF field is very short range. As discussed by Dehmelt, in Adv. At. Mol. Physics, 3, 59 (1963), this integrated repelling force field is often called a "pseudo force field", described by a "pseudo potential distribution". For a single electrode tip, this pseudo potential is proportional to the square of the RF-field strength and decays as a function of distance r from the tip with a $1/r^4$ dependence. Additionally, the pseudo potential is inversely proportional to both the particle mass m and the square of the angular RF frequency $w^2$, where $\omega=2\Pi f$ with f equal to the RF frequency. For an array of RF electrode tips, such as will be described in detail below, the pseudo potential near the surface is stronger than that of a single tip and decays even more rapidly as a function of distance from the surface formed by the tip array. In a distance that is large compared to the distance between neighboring electrode tips, the RF-field is negligible. The net effect is the formation of a steep pseudo potential barrier localized very near the multiple electrode surface with low penetration into the space above the surface for ions of moderate kinetic energies. Similar pseudo potential distributions can be formed above surfaces that are composed of alternative electrode array geometries, such as the combination of electrode tips and a grid mesh formed around the tips. The tips and the mesh have opposite RF phases applied or an array of closely-spaced parallel electrodes, where every other electrode has the opposite RF phase applied relative to neighboring electrodes. An alternative RF surface electrode geometry comprises parallel rod electrodes extending the length of the RF surface with opposite phase RF applied to adjacent RF rod electrodes. The minimum number of RF tip electrodes comprising an RF surface is four arranged in a quadrupole configuration with a single ion trapping region or energy well located at the center of the four electrodes. Alternatively an RF surface configured according to the invention may comprise an array of more than four RF electrodes forming multiple ion trapping regions.

As described by Whitehouse et. al. in U.S. Pat. No. 6,683,301 B2, an electrostatic potential can be applied to a counter electrode positioned above or across from a surface of RF electrodes (RF surface). The counter electrode electrostatic potential can be set relative to the DC offset potential applied to the RF surface electrodes to move ions toward or away from the RF surface. Ions approaching the RF surface are prevented from hitting the RF electrode surfaces by the repelling "pseudo force field" formed by the RF voltage. A "pseudo potential well" is created capable of trapping ions of moderate translational energy over a wide range of mass-to-charge values between the counter electrode and the RF surface. Ions directed toward the RF surface by an increased electrical potential applied to a counter electrode tend to move back and forth in the pseudo energy well that forms in the center of RF electrode sets. To control the position of ions trapped in these pseudo energy wells and to facilitate movement of ions along an RF surface, an RF surface configured according to the present invention comprises electrodes positioned behind the RF surface electrodes and on the sides of the RF surface electrode array in addition to the counter electrode, DC voltages are applied to such back and side electrodes during operation. The RF surface, configured according to the invention, comprises multiple DC back and side electrodes positioned to control trapped ion positions above or below the RF surface plane or to move ions along the RF surface when appropriate DC voltages are applied Repelling electrostatic potentials are applied to the back electrodes relative to the local RF offset potential to move ions trapped in local energy wells above the RF trapping surface. The distance that the repelling DC potentials applied to back electrodes penetrate between the RF electrodes is a function of the RF electrode tip shape and spacing geometry as well as the relative electrostatic potentials applied to the back electrodes, side electrodes, the RF electrode offset and the counter electrode. As the repelling potential from the back electrodes is increased the energy well depth between RF electrode sets decreases allowing ions to move more freely along the RF surface during operation. In some cases it is advantageous to preferably repel ions at some positions along the RF surface and attract them at others. For example, the back electrodes can be segmented to provide an attractive potential in a region in space where it is desirable to encourage ions to leak through the gaps in the electrodes, and to provide a retarding potential in regions of space to discourage ions from leaking through the gaps.

In one preferred embodiment of the invention, the RF electrodes comprising the RF surface are configured in a repeating quadrupole pattern with separate concentric shaped back electrostatic electrodes positioned between each row of RF electrodes starting at the center quadrupole electrode set and extending in larger electrode concentric patterns in the radial direction. In one embodiment of the invention, this RF surface is configured in a TOF MS pulsing region and is operated to effect trapping and release ions during the pulsing cycle of a Time-Of-Flight (TOF) mass to charge analyzer. Voltages can be applied to the DC and RF electrodes comprising the RF surface assembly to concentrate trapped ions at the center of the RF surface, spread trapped ions out along the RF surface or concentrate trapped ions in specific locations on the RF surface prior to pulsing the trapped ions into the TOF mass analyzer flight tube for mass to charge analysis A pulsed packet of ions or a continuous ion beam entering the gap between the RF surface and the counter electrode in the TOF pulsing region is directed toward the RF surface and trapped by the combined RF and DC fields formed by the back, side, counter and RF electrodes. Trapped ions are pulsed into the TOF flight tube by rapidly switching the voltage applied to the counter electrode to pull ions away from the RF surface and accelerate the ions down the TOF flight tube for mass to charge analysis.

Prior to pulsing trapped ions into the TOF fight tube, a sequence of RF and DC voltage changes and collisional cooling of ion kinetic energy can be applied to improve or expand TOF analytical performance. In one operating sequence according to the invention, the spatial spread of trapped ions can be compressed by applying a rapid change of RF voltages and electrostatic potentials to the RF, back, side and counter electrodes just prior to pulsing the spatially compressed trapped ions into the TOF flight tube for mass to charge analysis. The spatial ion compression improves TOF resolving power in mass to charge analysis by allowing more effective correction of initial ion energy spread in the TOF flight tube ion reflector. The back electrodes configured with an RF surface may be shaped as concentric rings and/or segmented. In some cases it is advantageous to repel ions at some positions along the RF surface and attract them at others. In one embodiment of the invention, an ion population entering the TOF pulsing region is collected and trapped at two separated positions along the RF surface. Both sets of trapped ions are pulsed simultaneously into the TOF flight tube and hit two different detectors operating at different gain Higher concentration ion packets hitting the higher gain detector may saturate the detector output while the second lower gain detector output will fall below its saturation level. Two analog to digital data acquisition systems record both TOF spectra simultaneously. The simultaneously acquired spectra are added with the appropriate gain corrections to form a combined mass spectrum with improved dynamic range and improved low signal amplitude resolution. The RF surface separation of ion packets with simultaneous pulsing of separated ion packets to two detectors operating at different gain improves TOF mass analyzer dynamic range while preserving accurate quantitative mass measurement capability.

The translational energy of trapped ions may be collisionally cooled by the continuous or pulsed addition of neutral gas molecules into the TOF pulsing region Neutral gas can be introduced near the RF surface during ion trapping to cause collisional damping of ion translational energy prior to pulsing into the TOF flight tube for mass to charge analysis. Neutral gas may be introduced into the TOF pulsing region from upstream vacuum pumping stages or pulsed into the TOF pulsing region synchronized with the TOF puling cycle. In one embodiment of the invention, the TOF pulsing region comprising an RF surface is configured to maximize local neutral gas pressure at the RF surface while minimizing the gas load into the TOF flight tube. Damping of ion translational motion near the RF surface, decreases ion energy and spatial spread prior to pulsing into the TOF flight tube. Damping of trapped ion kinetic energy effectively decouples energy spread of the trapped ion population caused by upstream events from the subsequent TOF pulsing and mass to charge analysis events, Reduced ion translational energy and spatial spread improves TOF resolving power and mass measurement accuracy.

Ions trapped at the RF surface may be subjected to ion-molecule reactions or laser dissociation fragmentation in the TOF pulsing region. Reactant gas may be pulsed into the TOF pulsing region to react with ions trapped at the RF surface. The reaction time between the neutral gas molecules and the trapped ions can be set by varying the time between the introduction of reagent gas and the pulsing of stored ions into the TOF flight tube. Alternatively, the reagent gas can be continuously added to the TOF pulsing region and ion packets may be directed into the TOF pulsing region stored for a period of time and pulsed into the TOF flight tube. Ion molecule reaction times can be controlled precisely by manipulation of ion populations through accurately timed ion storage and pulse cycles using the RF surface configured in a TOF pulsing region. Simultaneously or alternatively, a laser can be pulsed in a direction parallel to the RF surface to induce fragmentation of ions trapped by the RF surface. Trapped ions can be subjected to multiple laser pulses focused locally or broadly along the RF surface. The resulting population of parent and fragment ions may be trapped and subsequently pulsed into the TOF flight tube for mass to charge analysis.

In another embodiment of the invention, an RF surface configured in the pulsing region of a TOF mass spectrometer can be operated to trap ion populations at different locations on the RF surface. Ions trapped in one location on the RF surface follow a different trajectory traversing a TOF flight tube when compared with ions pulsed from a second location on the RF surface. In one example, the first trajectory ions may pass once through one ion reflector before impinging on the TOF detector. The second trajectory ions may pass through a two ion reflector flight path, improving TOF resolving power. Alternatively, ions trapped in local energy wells along the RF surface can be steered as point sources to follow different ion trajectories when pulsed down the TOF flight tube. The steering of ions accelerated from the RF surface traps can be achieved by applying asymmetric DC voltages to the local RF electrodes surrounding the pseudo potential well while simultaneously turning off the RF voltage and applying an accelerating potential to the counter electrode. Ions leaving the RF surface can be steered to pass through single or multiple ion reflectors to improve TOF resolving power or to impinge on different detectors operating at different gain to improve TOF dynamic range as described above.

In an alternative embodiment of the invention a multipole ion guide is incorporated into an RF surface or such ion guide is configured to serve the dual functions or an RF surface as well as an ion guide. Such a hybrid RF surface can be run in multiple operating modes to capture, manipulate and transfer ions in a mass spectrometer apparatus. Ions approaching the RF surface directed by DC fields are prevented from hitting the RF electrodes due to the RF voltage applied. The DC voltages applied to back, side and counter electrodes direct ions into an ion guide integrated into the RF surface. Ions passing into the ion guide center channel, driven by electric fields and gas dynamics, are directed to the ion guide centerline through collisional damping with neutral gas molecules with radial trapping of ions due to the RF field. RF surfaces with integrated ion guides can be operated in background pressures ranging from atmospheric pressure where rapid collisional cooling of kinetic energy occurs to vacuum levels where minimal collisions occur between ions and neutral background gas RF surfaces with integrated ion guides operating at or near atmospheric pressure direct captured or trapped ions into an orifice into vacuum improving ion transmission efficiency into vacuum Aspects of multiple ion guide apparatus and operations to improve ion transmission efficiency from API sources into vacuum are described by Whitehouse, C M, in U.S. Pat. No. 6,707,037 B2 incorporated herein by reference. Multipole ion guide embodiments configured according to the current invention to improve ion transmission from atmospheric pressure ion sources into vacuum are incorporated into RF surfaces or stand alone operating simultaneously as an RF surface and an ion guide. The multipole ion guide assembly is configured at atmospheric pressure with counter and back electrostatic lenses to aid in focusing and directing ions into the center channel of the multipole ion guide. The atmospheric pressure ion (API) source orifice into vacuum is configured as the ion guide electrostatic exit lens. The ion guide embodiments configured according to the invention include elements that constrain gas flow to pass longitudinally through the ion guide length from the entrance end to the exit end. All gas flow through the orifice into vacuum first passes through the ion guide center channel volume moving the radially trapped ions through the ion guide length. The dual purpose RF surface and multipole ion guide effectively reduces ion loss to the API orifice into vacuum improving the sensitivity of atmospheric pressure ion sources coupled to mass spectrometers.

In an alternative embodiment of the invention, multipole ion guides incorporated into RF surfaces or serving the dual function of RF surface and ion guide are configured in vacuum pressure regions. In one embodiment of the invention, multipole ion guides integrated into RF surfaces are configured to transfer ions through one or more vacuum pumping stages. Multipole ion guides that transfer ions through multiple vacuum stages have been described by Whitehouse, C. M. and Gulcicek, E in U.S. Pat. Nos. 5,652,427, 5,962,851 and 6,188,066 incorporated herein by reference. In the present invention, the multipole ion guide operates as an RF surface or is incorporated into a multiple pseudo energy well RF surface extending from the ion guide electrodes. The fringing fields at the entrance of multipole ion guides prevent ions approaching the ion guide entrance, through background gas imposing strong collisional damping of ion kinetic energy, from hitting the ion guide electrodes. Ions move into and through multipole ion guides configured according to the invention driven by dynamic and electrostatic fields and by gas dynamics. The ion guide assemblies are configured to extend though vacuum stage partitions transporting ions into and through one or more vacuum pumping stages.

Ion guides configured according to the invention may be operated to trap and release ions, mass to charge select ions, fragment ions through collision induced dissociation with background molecules and/or separate species in ion populations through ion mobility. Ion guides can be incorporated into hybrid mass to charge analyzers including but not limited to TOF, quadrupole, three dimensional ion trap, linear ion trap, magnetic sector, Fourier Transform Ion Cyclotron Resonance (FTICR) and Orbitrap mass analyzers. Such ion guide functions and hybrid combinations configured with multipole ion guides extending through one or more vacuum stages are described by Dresch, T., Gulcicek, E E, and Whitehouse, C. M. in U.S. Pat. Nos. 5,689,111 and 6,020,586 and Whitehouse, C. M., Dresch, T. and Andrien, B. in U.S. Pat. No. 6,011,259 all incorporated herein by reference. Ion guides configured according to the present invention have extended lengths that serve as ion transport conduits or tunnel regions between vacuum stages. Portions of the guide assemblies form longitudinal extended sections in which gas is prevented from passing out of the ion guide interior through gaps between the multipole ion guide electrodes. Other regions along the ion guide length are configured to allow neutral gas to be pumped out through the gaps between ion guide electrodes. Neutral gas flowing from one vacuum pumping stage into a subsequent vacuum stage is constrained to pass through the center channel or internal bore region of the multiple vacuum stage multipole ion guide. The multipole ion guide, serving as the ion and neutral gas conduit or tunnel between vacuum pumping stages, minimizes the neutral gas conductance while maximizing ion transmission. Neutral gas conductance through vacuum stages is constrained by the inner cross section opening area of the multipole ion guide and by the resistance to neutral molecule flow created by the increased length to diameter ratio of the ion guide conduit between vacuum stages. The length to diameter ratio of the multipole ion guide can be extended in the conduit region between vacuum pumping stages to reduce neutral gas conductance without compromising ion transmission efficiency. Larger cross section ion guides can be configured for the same vacuum pumping speed to increase ion current or ion trapping capacity. Alternatively, vacuum pumping speed and cost can be reduced considerably for the same multipole ion guide cross section by increasing the ion conduit length to diameter ratio between vacuum pumping stages.

Ion guides can be configured as quadrupoles, hexapoles, octopoles or with a higher number of poles. The cross section shape of multipole ion guide electrodes may be round, hyperbolic, flat or other shapes as known in the art. The multipole ion guide mounting hardware, configured according to the invention, serves the multiple functions of holding the multipole ion guide electrodes in position, preventing neutral gas from exiting the multipole ion guide through gaps between the ion guide poles along portions of the ion guide length, serve as vacuum partitions between vacuum stages and electrically insulate the RF electrodes from surrounding conductive elements. The conduit portions of the multipole ion guides formed between vacuum pumping stages create a pressure drop longitudinally along the conduit sections of the ion guide length. Multipole ion guides extending into multiple vacuum stages may be segmented along the ion guide length allowing the application of different DC electrical offset potentials to different ion guide segments. Ions can be accelerated from one multipole ion guide segment to another with sufficient energy to cause collision induced dissociation (CID) by application of the appropriate relative offset potentials between ion guide segments. RF/DC or resonant frequency excitation and mass to charge selection may be conducted in quadrupole ion guides configured according to the invention. Single or multiple RF/DC or resonant frequency mass to charge selection and fragmentation steps may be conducted combined with linear acceleration CID fragmentation. $MS/MS^n$ mass to charge selection and fragmentation may be conducted in single or multiple segment multipole ion guides operated as a linear ion trap Single or multiple segment ion guide configured and operated according to the invention can be incorporated into hybrid mass spectrometers with mass analyzer types as listed above.

Multipole ion guides configured according to the invention to serve as conduits through multiple vacuum pumping stages may comprise one or more sections where the ion guide electrodes are curved in the longitudinal direction When incorporated into hybrid mass spectrometers, straight or curved multipole ion guides configured as ion and neutral gas conduits between vacuum pumping stages can be interfaced to ion guides of different types and different cross sections that are connected to different RF power supplies. When a multipole ion guide configured according to the invention is interfaced to a second multipole ion guide comprising a different number of poles or a different cross section no electrostatic electrode may be included between the exit end of one ion guide and the entrance end of the second ion guide. With no electrostatic electrode included in the interface junction between the two ion guides, less contamination buildup occurs on the electrode during operation Minimizing contamination buildup along the ion path increases the mass spectrometer reliability and consistency of performance over longer time periods.

In an alternative embodiment of the RF surface, a magnetic field of strength >0.05 Tesla is applied in conjunction with the RF trapping potentials to spatially confine the ions above the RF surface or to direct the ion trajectories along the RF surface. In this embodiment of the invention, ions are trapped by the combination of interacting RF and DC electric fields and magnetic fields. Different ion manipulation functions can be conducted by applying magnetic fields along different axes of the RF surface. Ion trajectories near the RF surface can be varied by controlling ion velocity, RF and DC voltages and magnetic field strength. The applied magnetic field can increase the trapping efficiency for less favorable phase space conditions on the RF surface. In one embodiment of the invention, the magnetic field is applied perpendicular to the plane of the RF surface. When operating this embodiment of the RF surface, ion translational motion occurs in the rotational direction around the magnetic field axis just above the RF surface A population of ions form a sheet of rotating ions that in specific operating modes separate radially according to mass to charge. The radial mass to charge separation can be used to conduct mass to charge analysis of multiple species ion populations.

In another embodiment of the invention, the RF field-generating surface can be configured as at least one electrode assembly in an ICR cell. Ions entering the ICR cell can be captured and trapped along one or more RF field-generating surfaces and selectively directed into the center of the FTMS cell for FTMS analysis. Ions can be introduced into the ICR cell through an ion guide integrated into one RF surface assembly. In one embodiment of the invention, an ICR cell comprises two RF surface end electrode assemblies. Back electrode and RF electrode voltages are applied in the FTMS magnetic field such that ions rotate around the magnetic field axis in a sheet that is parallel to two RF surfaces. When operating this embodiment of the invention, rotating ions in the ICR cell experience minimum electric field gradients along the center axis of the FTMS cell, resulting in improved resolving power during mass to charge analysis.

The invention can be configured with a wide range of vacuum ion sources including but not limited to, Electron Ionization (EI), Chemical Ionization (CI), Laser Desorption (LD), Matrix Assisted Laser Desorption (MALDI), Fast Atom Bombardment (FAB), and Secondary Ion Mass Spectrometry (SIMS), intermediate vacuum pressure ion sources including but not limited to Glow Discharge (GD) and intermediate pressure Matrix Assisted Laser Desorption (IP MALDI) and atmospheric pressure ion sources including but not limited to Electrospray (ES), Atmospheric Pressure Chemical Ionization (APCI) and Pyrolysis MS, Inductively Coupled Plasma (ICP). Hybrid mass spectrometers comprising RF surfaces and ion guides configured according to the invention may comprise quadrupole, three dimensional ion traps, linear ion traps, TOF, magnetic sector or Orbitrap mass to charge analyzers.

DETAILED DESCRIPTION OF THE PREFERRED EMBODIMENTS

Figure 1:
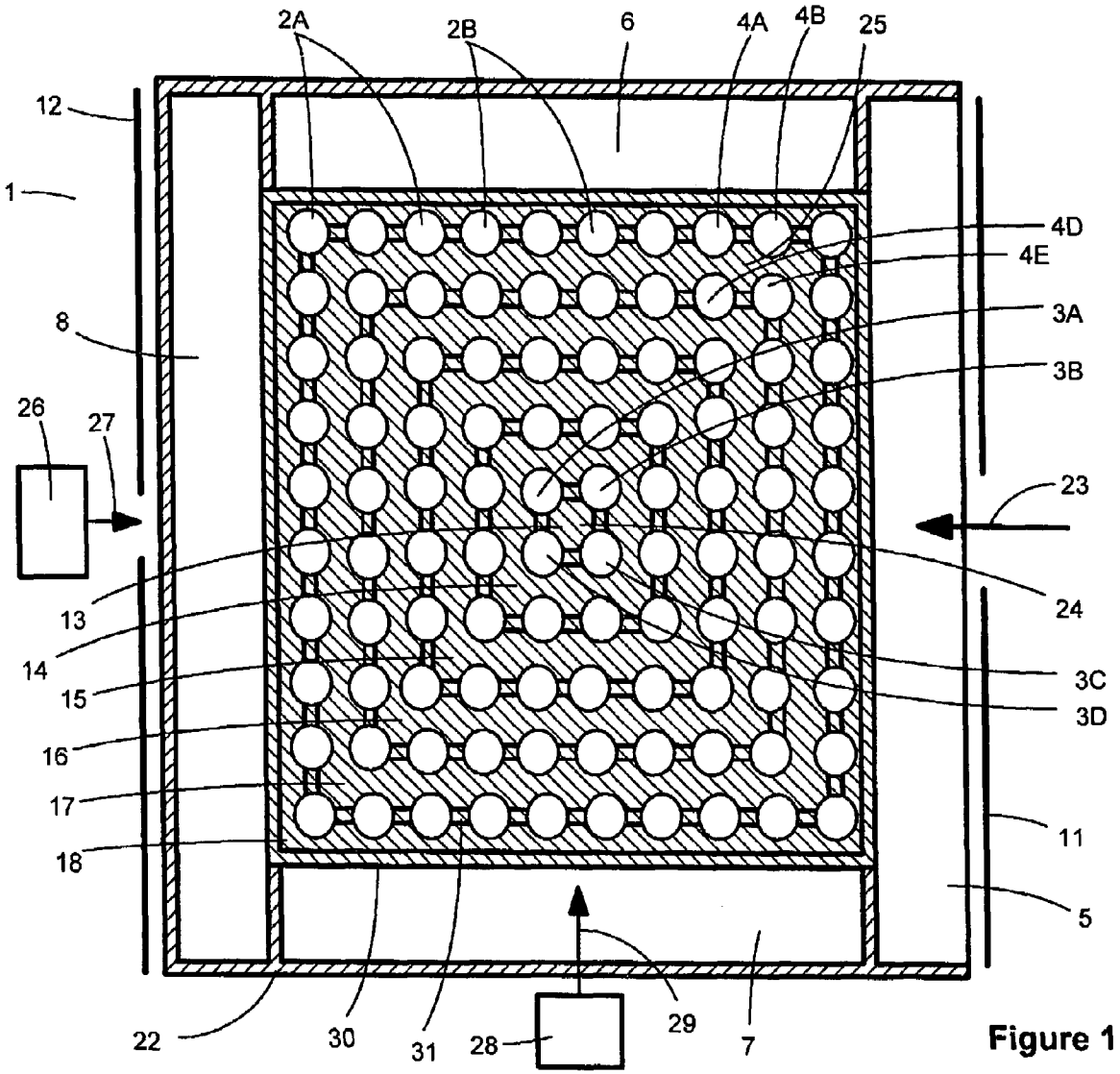
FIG. 1 is a top view diagram of one embodiment of an RF surface configured with spherical RF electrodes and concentric rings of backing electrostatic electrodes and positioned in the pulsing region of a TOF mass analyzer.

A series of electrodes spaced in a grid pattern, to which RF of opposite phase and appropriate voltage is applied to adjacent RF electrodes, generates a field that reflects ions away from the surface. In the absence of a retarding field above the surface, ions of appropriate m/z and kinetic energy are reflected. As described by Whitehouse and Welkie in U.S. Pat. No. 6,683,301 B2, incorporated herein by reference, ions can be confined to a volume of space directly above the RF surface when an electrostatic retarding field is maintained above the surface, trapped by the RF pseudo potential wells. In one aspect of the present invention, the shape and size of the electrode tips, and the spacing between them, are adjusted such that an ion population is confined to localized volumes of space above gaps between the electrodes during ion trapping operation. Multiple Electrostatic electrodes configured behind and to the sides the RF surface, in the present invention, improve trapping efficiency, provide control of ion motion along the RF surface and provide control of the position of trapped ions in the pseudo potential wells along the RF surface Different DC offset potentials can be applied to sets of RF electrodes to provide additional control of ion motion along the RF surface and to provide steering or focusing of ions as they are accelerated away from the RF surface. Neutral collision gas can be added to provide collisional cooling of ion kinetic energy for ions trapped at the RF surface.

RF surfaces, configured according the invention, are incorporated into the pulsing region of TOF mass to charge analyzers RF surfaces configured into TOF MS pulsing regions can be run in multiple operating modes providing multiple functions. Ion trapping and pulsing functions of the RF surface operated in the pulsing region of a TOF mass spectrometer increases TOF MS duty cycle and resolving power. Additional improvement in TOF MS resolving power can be achieved by compression of trapped ion spatial spread in the TOF pulsing region prior to pulsing ions into the TOF flight tube. Compression of trapped ion spatial spread is achieved by application of the appropriate RF and electrostatic voltages during timing sequences in the TOF pulsing cycle. Pulsed or accelerated ion trajectories through the TOF flight tube can be steered at the RF surface by adjusting the relative electrostatic or DC potentials applied to RF surface electrodes during the TOF pulsing cycle. Ions trapped in pseudo potential wells along the RF surface are effectively accelerated into the TOF flight tube from point sources Steering ion trajectories from multiple RF surface point sources, minimizes ion beam distortion compared with steering of a broader ion beam using steering electrodes after pulsing ions into the TOF flight tube. Ion trajectories can be steered to single or multiple ion reflectors or to multiple detectors in the TOF flight tube during mass to charge analysis. Ions trapped along the RF surface in the TOF pulsing region can be subjected to laser cooling of ion kinetic energy or laser induced dissociation fragmentation prior to pulsing the trapped ion population into the TOF flight tube. The applied RF amplitude or frequency can be changed or ramped during ion trapping to eliminate ion m/z values that fall outside the RF trapping stability window.

Figure 2:
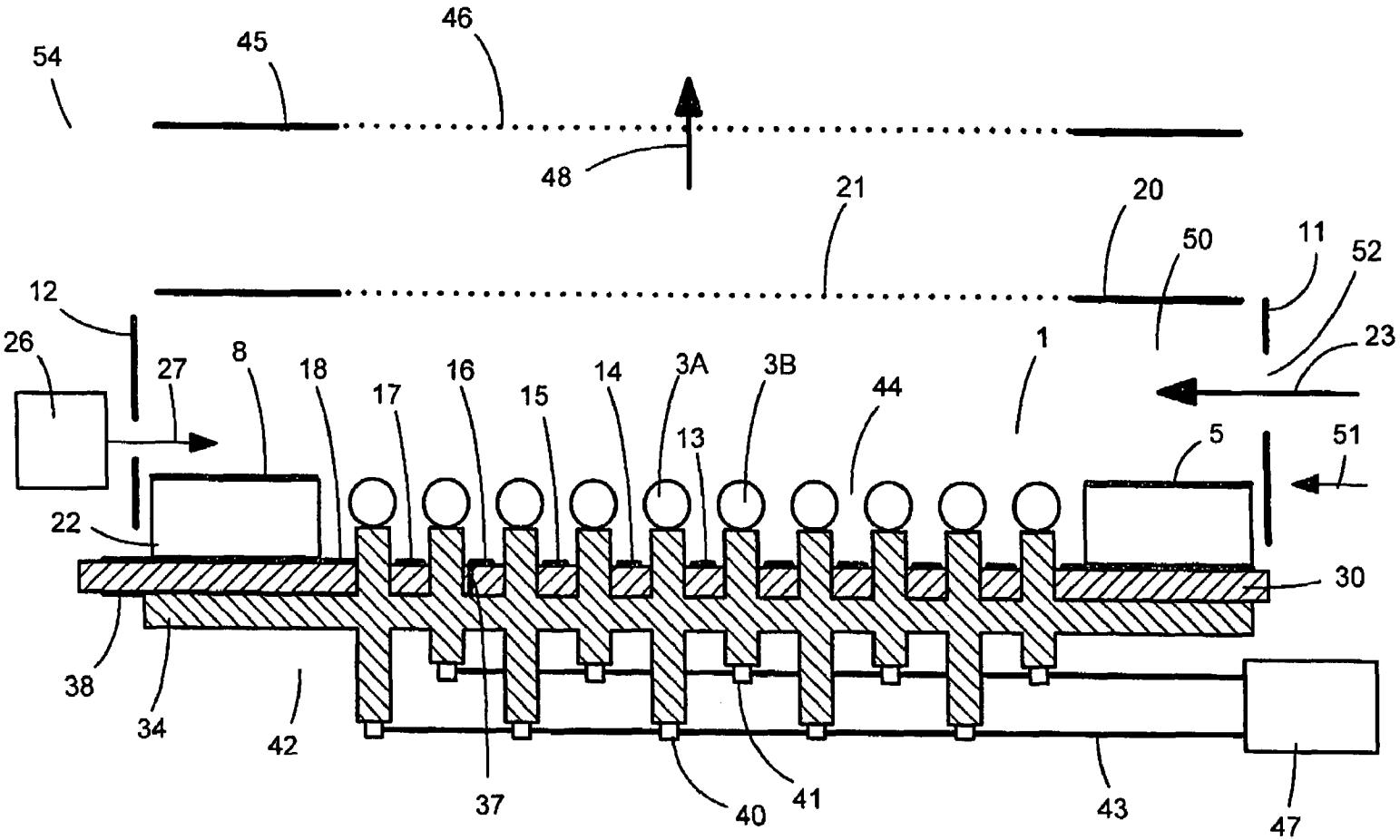
FIG. 2 is a side diagram view of RF surface shown in FIG. 1 comprising spherical RF electrodes.

One embodiment of the invention comprising spherical RF electrodes is diagrammed in FIGS. 1 and 2. FIG. 1 is a top view and FIG. 2 is a side view of RF surface assembly 1 comprising spherical RF electrodes 2A and 2B, side surface electrostatic electrodes 5, 6, 7 and 8, entrance side electrode 11, side electrode 12, back electrodes 13 through 18 and front electrode 20 with grid section 21. All spherical RF electrodes comprising RF surface assembly 1, including spherical RF electrodes 2, 3 and 4 are held in position and electrically isolated by RF electrode insulator 34. Insulator 34 comprises dielectric material including but not limited to ceramic or alumina, silica, plastic or glass Ceramic materials may be molded, machined or laser cut green and fired, silica may be etched or laser cut, and plastic or glass may be machined or molded or other material forming known in the art may be applied to produce the required configuration for RF electrode insulator 34. Adjacent RF electrodes are electrically insulated from each other and from surrounding electrostatic electrodes. In the embodiment shown in FIGS. 1 and 2, RF spherical electrodes are connected to reduced diameter electrode posts that pass through holes in insulator 34. For example posts 40 and 41, connected to RF spherical electrodes 3A and 3B respectively, pass through holes in insulator 34 holding spherical electrodes 3A and 3B in position and providing electrical connection with RF and DC power supply 47. Sine wave alternating current or AC in the Radio Frequency or RF frequency range is applied to all spherical electrodes comprising RF surface assembly 1. Such RF electrical potentials are applied with an AC frequency typically in the range between one hundred kilohertz to several megahertz. Opposite or approximately opposite phase RF voltage is applied to adjacent RF spherical electrodes as indicated by crosshatch and clear spheres shown in FIGS. 1 and 2.

One or more DC offset potentials are applied to sets of spherical Electrodes Different DC offset potentials may be applied to sets of RF electrodes through appropriate capacitor and resistor elements, as is known in the art, to provide one means of controlling ion motion along the RF surface. In the embodiment shown in FIG. 2, all RF electrodes are connected to a common offset potential through RF and DC power supply 47. The RF surface embodiment shown in FIGS. 1 and 2 comprises RF electrodes arranged in repeating patterns of four electrodes forming quadrupole electrode sets. For example, four RF electrodes 3A, 3B, 3C and 3D define a four RF electrode set that creates a pseudo potential well and trapping region 24 between them during ion trapping operation. As a second example, electrodes 4A, 4B, 4C and 4D define a four RF electrode set creating pseudo potential well and trapping region 25 between them during ion trapping operation. In the embodiment shown in FIGS. 1 and 2, all spherical RF electrodes including 2A, 2B, 3A through 3D and 4A through 4D form a planar surface. Alternatively the RF electrodes may be configured to form different shaped surfaces including but not limited to curved, curved spherical, parabolic or hyperbolic shapes or angled in a cone or terraced shape. In addition to RF electrodes, RF surface assembly 1 comprises multiple surrounding electrostatic electrodes to provide additional control of ion trajectories, trapping and manipulation along the RF surface.

Figure 3:
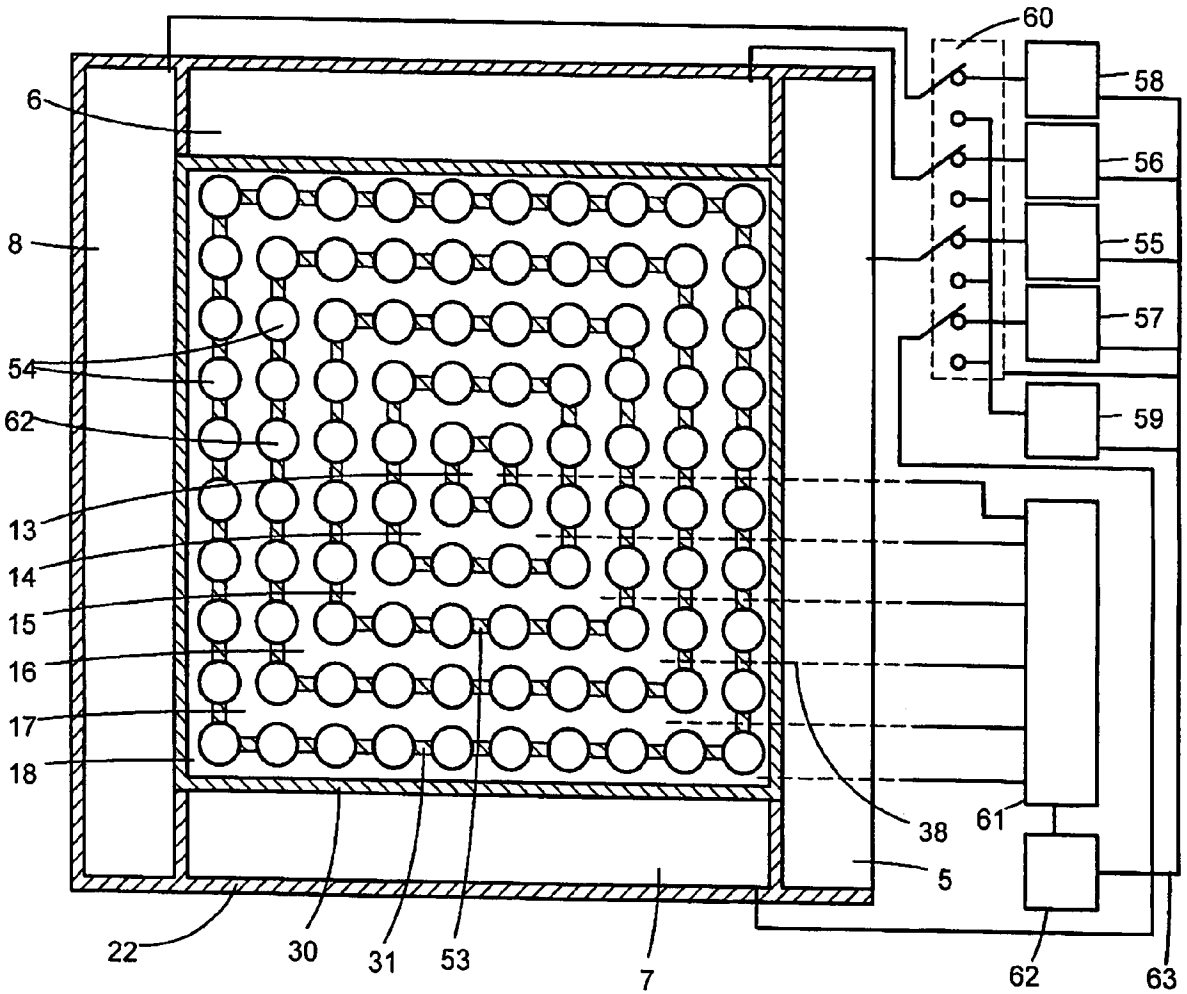
FIG. 3 is a top view diagram of the backing electrode circuit board configured in the RF surface diagrammed in FIG. 1

RF surface assembly 1 comprises four separate planar electrostatic side electrodes 5, 6, 7 and 8 configured on the top side of circuit board 22. Figure Electrostatic electrodes 13, 14, 15, 16, 17 and 18 are configured in concentric square shapes centered at RF electrode set 3A, 3B, 3C and 3D. Entrance side electrode 11 and side electrode 12 are configured outside and to the sides of RF surface assembly 1. Electrostatic electrodes 20 and 45 with grid portions 21 and 46 respectively are positioned above and parallel to plane 51 formed by RF surface assembly 1. Direct Current (DC) or electrostatic electrical potentials are applied to the electrostatic electrodes to control ion motion and trapping near RF surface 51 and to control ion motion during the acceleration, focusing and steering of ions accelerated away from RF surface assembly 1 during TOF pulsing cycles. In one embodiment of the invention, circuit board 22 is fabricated with separate electrostatic electrodes 5, 6, 7 and 8 configured on its top surface as diagrammed in FIGS. 1, 2 and 3. FIG. 3 is a top view diagram of circuit board 22 mounted on the top face of circuit board 30 as a subassembly in RF surface assembly 1. Circuit board 30 comprises through holes 54 drilled to provide clearance for insulator 34 posts to protrude through circuit board 22 as shown in FIG. 2. Electrical conductive traces such as 38 configured on the back side of circuit board 30 connects with front electrode 16 by electrical connections or vias such as via 37 through circuit board 30. Concentric ring front electrodes 13 through 18 are electrically insulated from each other by gaps in circuit board conductive traces such as 31 and 53 between back electrodes 17 and 18 and 15 and 16 respectively. Individual voltages are applied to back electrodes 13, 14, 15, 16, 17 and 18 through connections to multiple output power supply 61, Planar side electrodes 5, 6, 7 and 8 are connected to power supplies 55, 56, 57 and 58 respectively during ion trapping and manipulation The supply of voltages applied to planar electrodes 5 through 8 from DC power supplies 55 through 58 respectively during ion trapping is rapidly switched to power supply 59 through switch 60 during a TOF pulsing cycle to accelerate ions into the TOF flight tube. Voltages applied to back electrodes 13 through 18 remain constant or are switched through power supply 61 during a TOF pulsing cycle. Power supplies 55 through 59, power supply 61 and switch 60 are controlled through logic unit 62 during a TOF pulsing cycle.

Pulsed or continuous neutral gas 27 can be added through side electrode 12 from gas flow controller 26 to provide collisional damping of ion kinetic energy during ion trapping along RF surface 51. Alternatively, neutral gas can be introduced along with ions 23 through opening 52 in electrode 11 from upstream vacuum pumping stages during operation of RF surface assembly 1. Laser or light source 28 is configured to direct photons 29 along surface 51 of RF surface assembly 1 to cool or fragment trapped ions. Laser or light source 28 may focus light beam 29 at specific locations or raster beam 29 across RF surface 51. Photo dissociation of trapped ions occurs when ions absorb sufficient energy from photons to undergo fragmentation, RF surface assembly 1 as diagrammed in FIGS. 1 and 2 is configured in orthogonal pulsing region 54 of a TOF mass spectrometer. An example of one TOF ion pulsing cycle operated according to the invention will be described below to illustrate one embodiment of the RF surface assembly ion trapping and release functions. TOF pulsing region 54 can be configured to provide poor neutral molecule pumping conductance from gap 50 to maximize gas pressure at RF surface 51 for collisional cooling while minimizing the gas and vacuum pressure in the TOF tube. For example, if the local background pressure in gap 50 were maintained at approximately $5\times10^{-5}$ torr due to gas conductance from upstream vacuum stages, ions trapped at RF surface 51 would be subject to collisional cooling but would experience little or no collisions when accelerated into the TOF flight tube. The TOF flight tube vacuum pressure can be maintained in the low $10^{-7}$ torr range with modest size vacuum pumps and restricted neutral molecule conductance from the TOF pulsing region In one embodiment of the invention, TOF pulsing region 54 is configured with a surrounding structure that prevents loss of neutral gas. In addition, electrodes 20 and 45 with grids 21 and 46 respectively are mounted in an electrically insulated tunnel as diagrammed in FIG. 5 to reduce neutral gas conductance into TOF flight tube 105.

In one embodiment of the invention, RF surface assembly 1 is configured to trap ions having an initial trajectory approximately parallel to RF surface 51. The tops of RF spherical electrodes 2, 3 and 4 and planar DC electrodes 5, 6, 7 and 8 define the plane of RF surface 51 in RF surface assembly 1. Ion beam or gated ion packet 23 enters gap 50 between RF surface 51 and front or counter electrode 20 with grid 21 in a trajectory substantially parallel to RF surface 51. RF and DC offset potentials are applied to all RF electrodes comprising RF surface assembly 1. Electrostatic potentials are applied to front electrode 20 with grid 21 and planar side electrodes 5, 6, 7 and 8 relative to the RF electrode offset potential, to form a DC electric field that directs ions 23 toward RF surface 51 as they traverse gap 50. The potentials applied to side electrodes 11 and 12, and planar side electrodes 5, 6, 7 and 8 are set higher in amplitude than the RF electrode offset potential, forming a DC energy well with the RF electrode surface positioned at the bottom of the DC energy well. The electrostatic voltages applied to electrodes 6, 7 and 8 are set above the kinetic energy of the ions 23 entering gap 50 of TOF pulsing region 54 to retard the forward ion motion and direct the ions toward the center region of RF surface 51. Electrostatic repelling potentials are applied to backing electrodes 13 through 18. As ions 23 move toward RF surface 51 directed by the DC far field in gap 50, they are prevented from hitting the RF electrodes by near field repelling force formed by the applied RF voltage. Ions move along RF surface 51 losing kinetic energy through collisions with neutral background gas and are eventually trapped in pseudo potential wells between electrode sets. The back electrode DC repelling field penetrating through gaps between RF electrodes prevents ions trapped in pseudo potential wells from moving through and below RF surface 51 and hitting back DC electrodes 13 through 18. The DC voltage values applied to back electrodes 13 through 18 and forward electrode 20 with grid 21 relative to the applied RF electrode DC offset potential determine the position of trapped ions relative to RF surface plane 51. Increasing the voltage amplitude applied to back electrodes 13 through 18 will move trapped ions to a position above RF surface 51 allowing the ions to skate across RF surface 51. Reducing back electrode voltage will move trapped ions into or slightly below RF surface 51 in the center region between RF electrode sets.

Figure 4A:
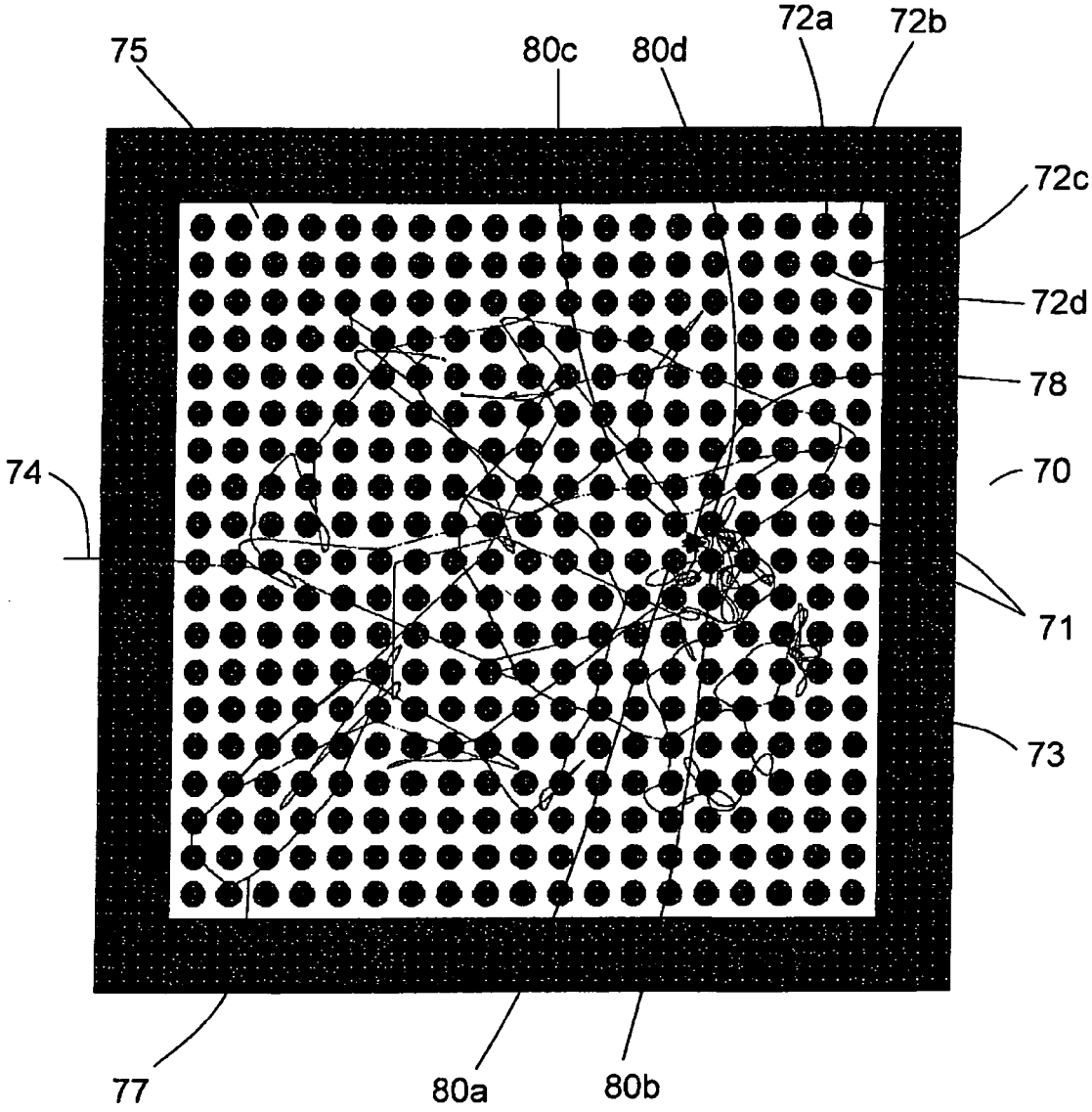
FIG. 4A is a top view of the RF surface similar to that diagrammed in FIG. 1 showing a calculated trajectory of ion motion along the surface for the same potential applied to all backing electrodes.
Figure 4B:
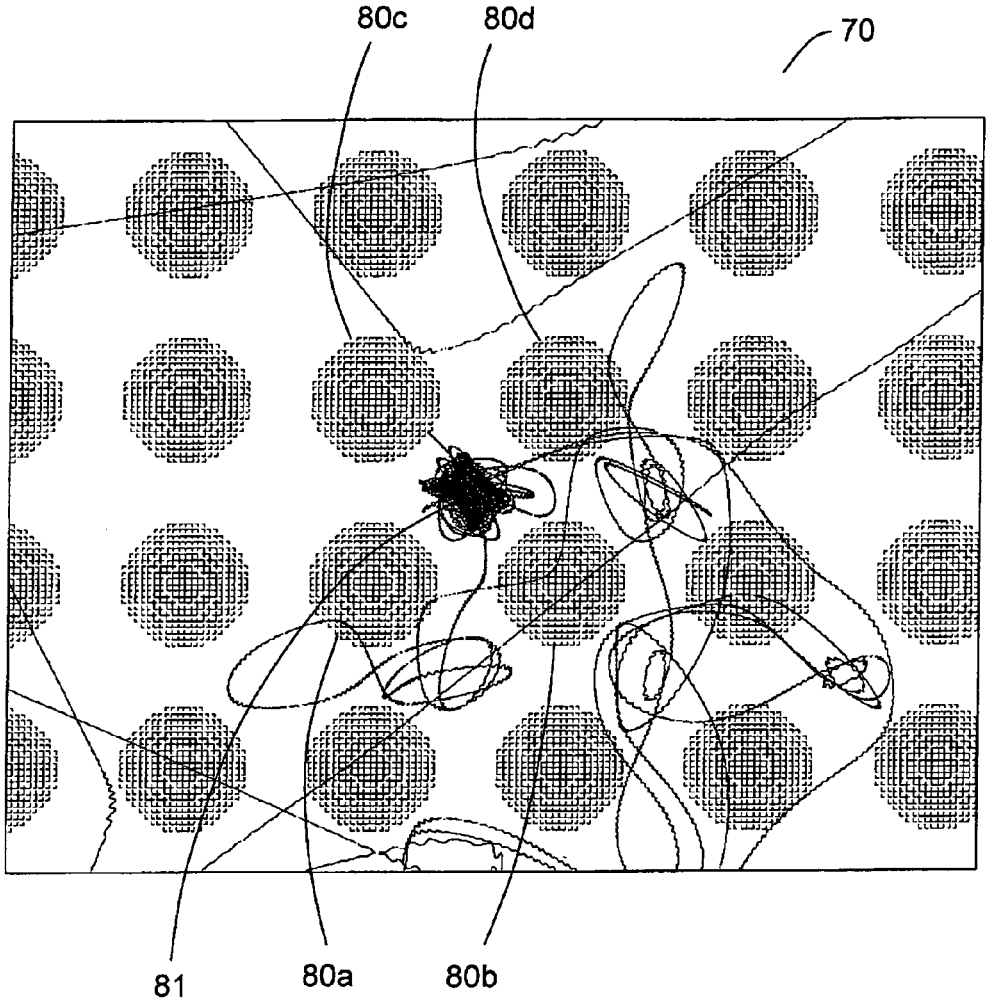
FIG. 4B is a magnified top view of the ion trajectory shown in FIG. 4A.
Figure 4C:
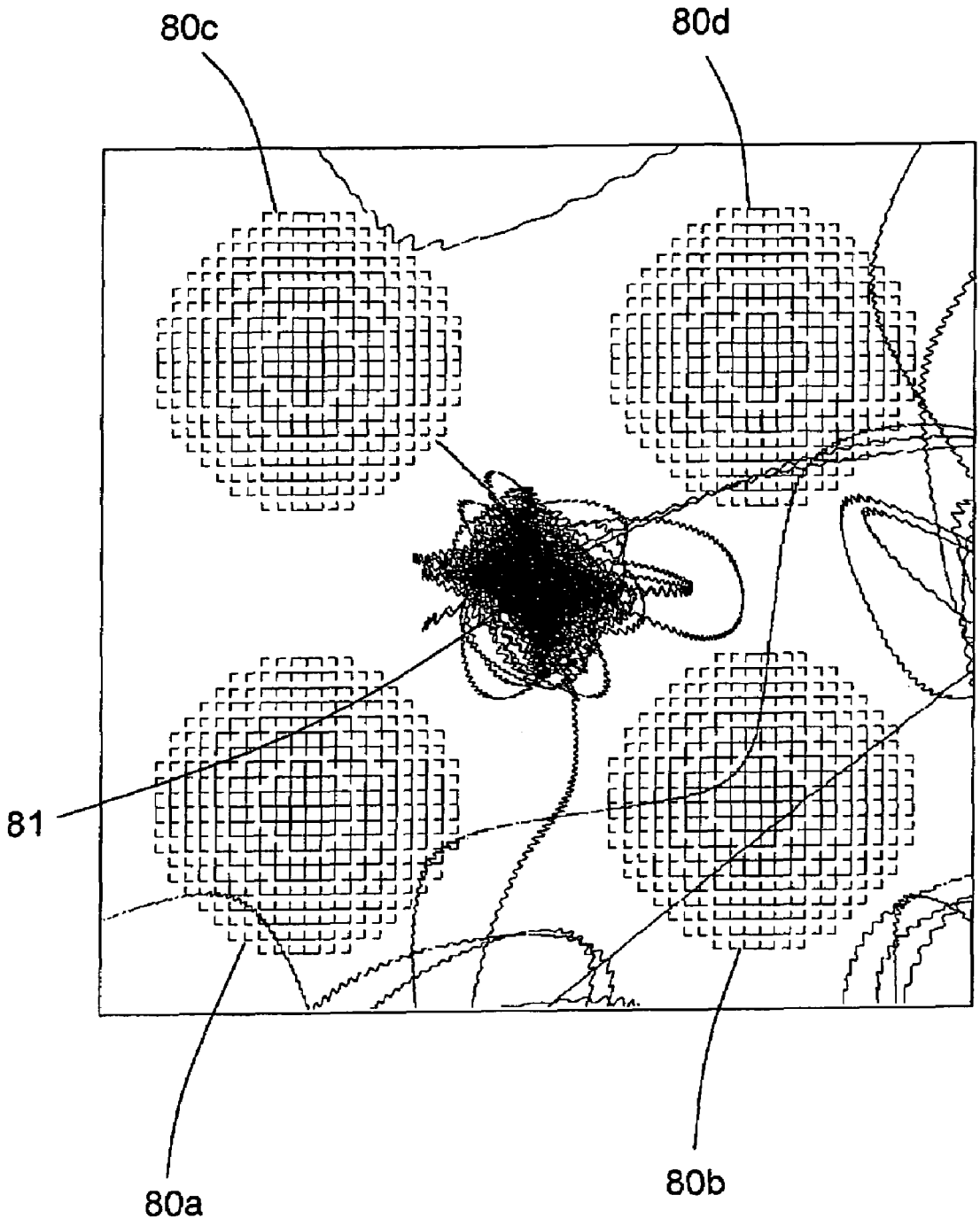
FIG. 4C is a magnified top view of the trapping region of the ion trajectory shown in FIG. 4A
Figure 4D:
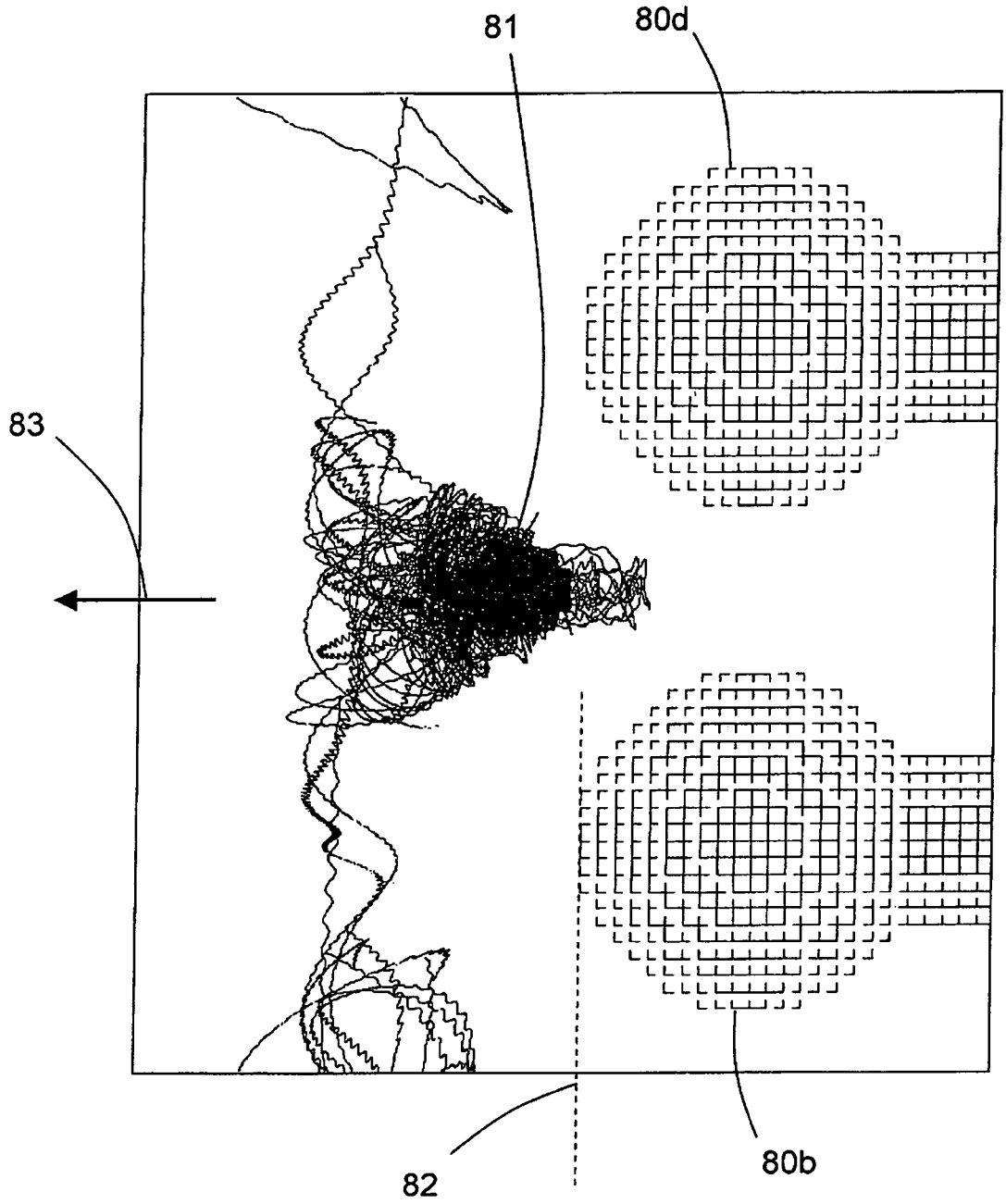
FIG. 4D is a side view of the ion trajectory simulation shown in FIG. 4C.

FIGS. 4A, 4B, 4C and 4D show a calculated ion trajectory along RF surface 70 with spherical RF electrodes configured in a pattern as described for RF surface assembly 1. The ion trajectory calculation was run using the software program SIMION 7.0 (David A Dahl 43ed ASMS 1995, pg. 717) with factors added to emulate ion collisions with neutral background gas. FIG. 4A shows a top view of RF surface 70 comprising spherical RF electrodes 71 each configured with a 1 millimeter (mm) diameter. The diameter of a circle drawn inside of each set of four spherical electrodes just touching each of the four electrodes in a set, such as that formed by the inscribed diameter of RF electrodes 72A, 72B, 72C and 72D, equals 1.128 mm. Planar side electrode 73 is electrically connected to the forward electrode not shown in FIG. 4A. Single back electrode 75 is maintained at a uniform DC potential behind the RF electrode surface. The RF voltage applied to RF electrodes 71 was set at 400 volts peak to peak (Vptp) with a frequency of 5 MHz. The RF electrode offset potential was set to zero volts. The DC electrical potential applied to back electrode 75 was set to +100 Volts (V). The electrostatic or DC potential applied to side 73 and front electrode was set to +11 V. Ion 74 enters the gap above RF surface 70 with a translational energy of 10 electron volts (ev) and moves toward RF surface 70 due to the front electrode voltage directing ion 74 toward RF surface 70. As ion 74 moves above RF surface 70 with trajectory 77, as shown in FIG. 4A, it loses kinetic energy due to collisions with neutral background gas. Eventually ion 74 is trapped in a pseudo potential well at position 78 between RF electrodes 80A, 80B, 80C and 80D. Magnified top view of trapped ion 74 trajectory 81 is shown in FIGS. 4B and 4C Ion collisions with neutral background gas reduces the kinetic energy of trapped ion 74, effectively collapsing the trajectory of ion 74 towards the bottom of the pseudo potential well at the center of RF electrode set 80A, 80B, 80C and 80D. FIG. 4D is a magnified side view of spherical electrodes 80 C and 80D showing the trajectory of kinetic energy damped ion 74. As the kinetic energy of ion 74 cools through collisions with background neutral molecules, the ion movement collapses to a small volume centered between RF electrodes 80A, 80B, 80C and 80D sitting just above RF surface plane 82.

The ion trapping trajectory calculation shown in FIGS. 4A through 4D illustrates the compression of ion trajectories in the direction of TOF tube axis 48 or 83 by trapping ions on RF surface 51 or 70 prior to pulsing ions into a TOF flight tube for mass to charge analysis. Reducing the spatial spread of an ion population prior to pulsing the population of ions into the TOF flight tube, increases TOF resolving power and mass measurement accuracy. Typically ion beam 23 enters TOF orthogonal pulsing region 54 gap 50 having a width of 1 to 3 mm with non parallel ion trajectories due to inevitable imperfections in upstream ion beam focusing. The non parallel trajectories of ions 23 moving across gap 50 contribute to random ion energies in the direction of TOF axis 83 or 48 uncorrelated to spatial spread when ions are pulsed into the TOF flight tube. As is known in the art, ion reflectors configured in TOF flight tubes can be tuned to reduce the effects of ion energy spread or ion spatial spread but not both if ion energy and spatial spread are uncorrelated Correlated ion energy and spatial spread occurs in orthogonal TOF pulsing when a parallel trajectory ion beam 23 traverses gap 50 parallel to RF surface 51 and front electrode grid 21. This ideal case is rarely achieved in practice. By trapping ions in pseudo potential wells formed between RF electrode sets along RF surface 70 or 51, the spatial and energy spread of an ion population can be reduced prior to pulsing the ion population into the TOF flight tube. As shown in FIGS. 4A through 4D, ion beam 23 entering gap 50 with a cross section of 2 mm can be trapped in multiple pseudo potential wells and subjected to collisional cooling prior to pulsing into the TOF flight tube. Ion spatial spread in the TOF flight tube axis direction can be reduced to a few tenths of a millimeter prior to pulsing into the TOF tube. With reduced spatial spread, initial ion energy spread in the TOF axis direction can be focused at the TOF detector surface using ion reflectors in the TOF flight tube, increasing resolving power and mass measurement accuracy. As will be described below, additional spatial compression can be achieved by applying a transient increase in relative electrode potentials to briefly compress the trapped ion trajectories prior to pulsing ions into the TOF flight tube.

Ions trapped in pseudo potential wells are pulsed into the TOF flight tube by simultaneously turning off the RF voltage applied to the RF electrodes, switching planar electrode potentials close to the RF electrode offset potential and rapidly reversing the voltage applied to forward electrode 20 with grid 21 and electrode 45 with gird 46 to accelerate ions away from RF surface 51 and into the TOF flight tube. To accelerate positive polarity ions into the TOF flight tube with zero volts applied to the offset potential to the RF electrodes, negative polarity voltages are rapidly switched to electrodes and grids 20121 and 45/46. Conversely, positive voltage polarity is applied to electrodes and grids 20/21 and 45/46 to accelerate negative polarity ions into the TOF flight tube. Voltages applied to back electrodes 13 through 18 and planar side electrodes 5 through 8 can be switched synchronized with the TOF ion acceleration pulse to optimize the accelerated ion trajectory down the TOF flight tube. Alternatively, the offset potential applied to RF electrodes comprising RF surface 51 can be rapidly increased to accelerate trapped ions into the TOF flight tube. For positive ion acceleration into the TOF flight tube, positive polarity offset potential is rapidly switched to the RF electrodes while the RF voltage is turned off. Negative polarity offset voltage is switched to the RF electrodes to accelerate negative polarity ions into the TOF flight tube during a TOF pulsing cycle. Alternatively, opposite polarity DC voltages can be switched to the offset potential of RF electrodes and the forward electrodes with grids 20/21 and 45/46. The acceleration of ions from gap 50 in pulsing region 54 into the TOF drift or flight tube can be described as pushing ions out of, pulling ion from or push pull of ions from pulsing region 54 gap 50 as ion acceleration voltages are applied to electrodes in TOF pulsing region 54.

Figure 5:
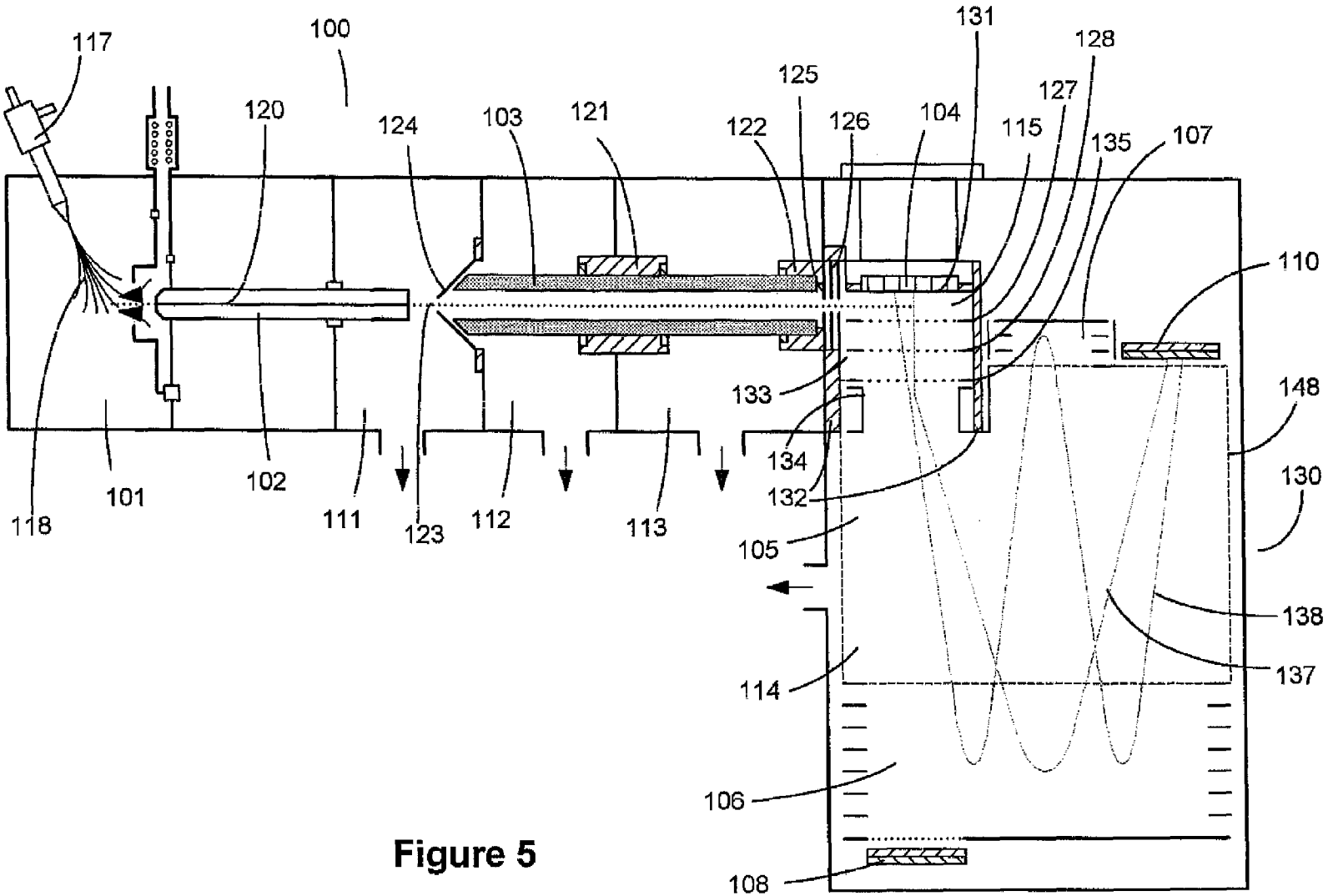
FIG. 5 is a diagram of an orthogonal pulsing TOF mass analyzer configured with the RF surface assembly shown in FIG. 1.

One embodiment of a Time-Of-Flight mass to charge analyzer configured according to the invention is diagrammed in FIG. 5. Hybrid TOF mass spectrometer 100 comprises Electrospray (ES) ion source 101, dielectric capillary 102, multipole ion guide and ion trap 103, RF surface assembly 104 configured in orthogonal pulsing region 115 of TOF flight tube 105. Ions are generated in ES source 101 from sample solution sprayed, with or without pneumatic nebulization assist, from ES inlet probe 117. The resulting ions produced from the Electrospray ionization in Electrospray ion source 101 are directed into capillary bore 120 of capillary 102. The ions are swept though bore 120 of capillary 102 by the expanding neutral gas flow into vacuum and enter the first vacuum pumping stage 111. The potential energy of the ions passing through capillary 102 changes from the entrance to exit end as described in U.S. Pat. No. 4,542,293 incorporated herein by reference. A portion of the ions exiting capillary 102 continue through skimmer orifice 123 in skimmer 124 and pass into multipole ion guide 103 where they are radially trapped as they traverse the length of ion guide 103. Multipole ion guide 103 extends into second and third vacuum stages 112 and 113 respectively. Multipole ion guide 103 can be operated in RF only single pass or trapping and release mode, mass to charge selection mode or ion fragmentation mode as described in U.S. Pat. Nos. 5,652,427 and 5,689,111 and 6,011,259 incorporated herein by reference Hybrid TOF 100 can be operated in MS or MS/MS$^n$ mode with ion mass to charge selection and gas phase collision induced dissociation (CID) functions occurring ion guide 103. Ion guide 103 comprises ion tunnel or conduit sections 121 and 122 configured according to the present invention and described in more detail below.

Ions exiting ion guide 103 pass through ion guide exit lens 125 and focusing lens 126 and are directed into pulsing region or first accelerating region 115 of Time-Of-Flight mass analyzer 130 with a trajectory that is substantially parallel to RF surface 131 and counter or front electrodes 127 and 128. The planes described by RF surface 131 and front electrodes 127 and 128 are perpendicular to the axis of Time-Of-Flight drift or flight tube 105 RF surface assembly 104 is configured as described for RF surface assembly 1 shown in FIGS. 1 and 2. Electrodes 127 and 128 are equivalent to electrodes 20 and 45 shown in FIGS. 1 and 2 and described above Electrical insulator 132 surrounding TOF pulsing region 133 forms a tunnel like structure to minimize gas conductance from pulsing region gap 115 into TOF flight tube 105. Ion collisions with neutral gas molecules entering pulsing region gap 115 from upstream vacuum pumping stage 113 provide collisional cooling of ion kinetic energy for ions trapped along RF surface 131. Ions entering gap 115 from guide 103 operating with a continuous or pulsed ion beam are directed to RF surface 131 where they are trapped. Trapped ions at RF surface 131 undergo cooling of translational energies due to collisions with neutral background gas. Ions accelerated from RF surface 131 pass through grids in electrodes 127, 128 and 135 and enter TOF drift or flight tube 105. Ions can be steered using steering electrode set 134 in TOF flight tube 105 or can be steered directly from RF surface 131 as described above. As an example, ions following ion trajectory 137 in TOF flight tube 105 are steered by steering electrode set 134 to make a single pass through first ion reflector 106 before impacting on multichannel plate detector 110. Alternatively, ions following ion trajectory 138 are steered from RF surface 131 to make a double reflection through first ion reflector 106 and second ion reflector 107 before impinging on detector 110. Multiple ion reflections in TOF flight tube 105 improve TOF resolving power at some reduction in sensitivity due to ion loss on ion reflector entrance grids. Alternatively, ions can be accelerated into TOF flight tube 105 with no steering and impinge on linear flight path detector 108. A description of the timing sequence of a TOF pulsing cycle conducted using TOF pulsing region 133 comprising RF surface assembly 104 is given below.

Figure 6B:
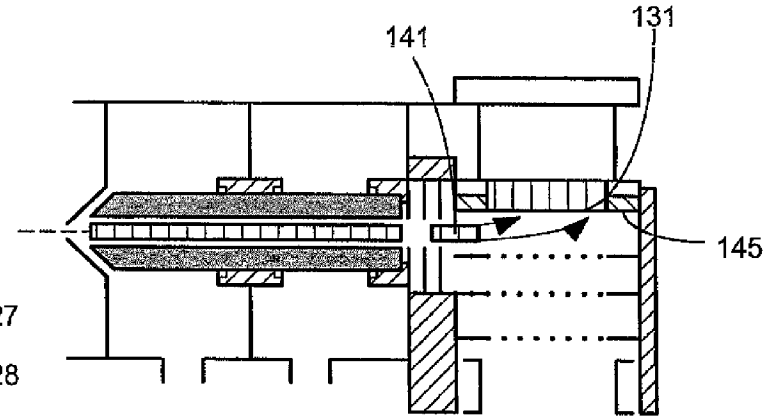
FIGS. 6A through 6D are cross section diagrams of an orthogonal TOF pulsing region comprising an ion trapping RF surface sequentially showing a TOF pulsing region ion trap and pulse sequence.
Figure 6A:
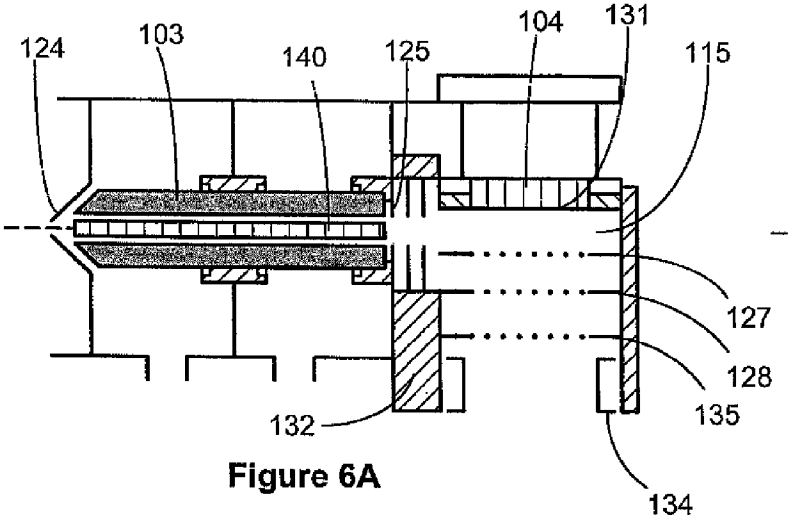
Figure 6D:
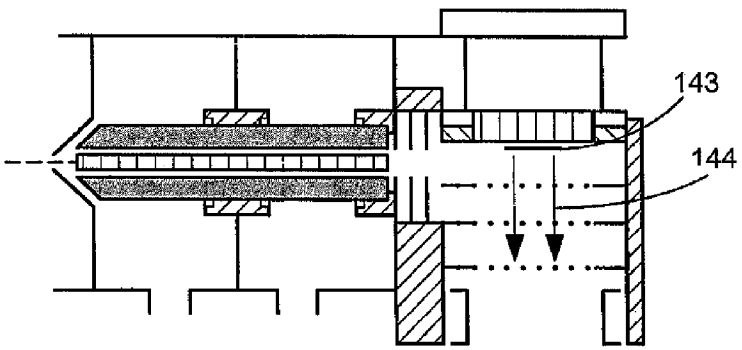
Figure 6C:
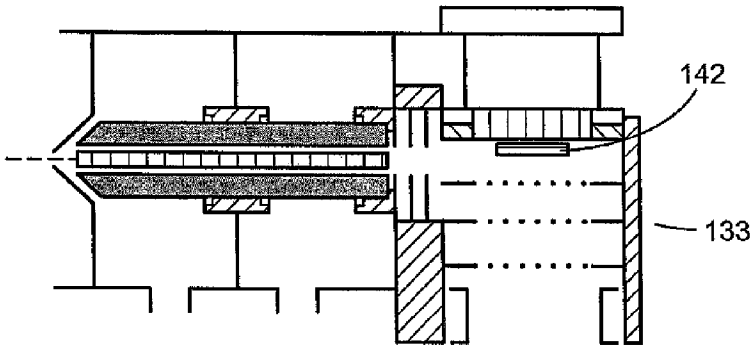

FIGS. 6A, 6B, 6C and 6D show the TOF pulsing sequence of one embodiment of TOF pulsing region 133 operation. FIG. 6A shows TOF pulsing region 133 just after an ion pulse into TOF tube 105 has occurred. RF voltage is reapplied to the RF electrodes comprising RF surface 131 and all voltages applied to surrounding DC lenses are reset for trapping ions at RF surface 131. Ions 140 are radially and longitudinally trapped in ion guide 103 by the RF voltage applied to the poles of ion guide 103 and by trapping DC voltages applied to skimmer 124 and ion guide exit electrode 125. In FIG. 6B a DC voltage is applied to ion guide exit electrode 125 to release ions from the exit end of ion guide 103. After a period of time, trapping voltage is again applied to ion guide exit electrode 125 to stop the release of ions from ion guide 103 and resume ion trapping of remaining ions in ion guide 103. Ion packet 141 released from ion guide 103 moves into pulsing region gap 115. Voltages applied to front electrode 127, RF surface 131 and planar side electrodes 145 direct ion packet 141 toward RF surface 131 as shown in FIG. 6B. Ions comprising ion packet 141 are trapped at RF surface 131 as shown in FIG. 6C. Once ion packet 141 has entered pulsing region gap 115, the voltage applied to front electrode 127 and planar side electrodes 145 can be increased above the initial ion energy value to improve ion trapping efficiency at RF surface 131 and to move ion motion toward the center of RF surface 131. Trapped ion population 142 undergoes collisions with neutral background gas which reduce the trapped ion kinetic energy as shown in FIG. 6C The ion trajectories of kinetic energy cooled ion population 142 can be compressed by briefly increasing the voltage amplitude applied to front electrode 127, back electrodes, planar side electrodes 145 and the RF electrodes comprising RF surface 131 just prior to accelerating ion population into TOF flight tube 105. Spatially compressed ion packet 143 is accelerated into TOF flight tube 105 by switching off the RF voltage and rapidly switching the DC potential applied to front electrode 127 and planar side electrodes 145 as shown in FIG. 6D. When spatially compressed ion packet 143 has entered TOF flight tube 105, RF and DC voltages in TOF pulsing region 133 are reset to trap another ion packet released from ion guide 103.

Ions can be accelerated into TOF flight tube by different combinations of voltages applied or switched to electrodes surrounding gap 115 in TOF pulsing region 133. When the offset potential applied to the RF electrodes comprising RF surface 131 is held constant, trapped ions 143 can be accelerated or pulled through the grid of electrode 127 by switching the voltage applied to electrode 127. For example, if the offset potential applied to the RF surface electrodes equals ground or zero volts, the accelerating or pulling potential applied to electrode 127 comprises negative polarity for positive ions and positive polarity for negative ions. Electrode 135 is connected to TOF flight tube or drift region surrounding electrode 148 as diagrammed in FIG. 5. Connected electrodes 135 and 148 are maintained at negative or positive kilovolt potentials applied to during positive or negative ion mass to charge analysis respectively. For positive ion acceleration into TOF flight tube 105, the potential applied to electrodes 127 and 128 is switched from a few volts positive, maintained during ion trapping, to a negative potential for ion acceleration into TOF drift region 105 maintained at negative kilovolt potentials. The reverse polarity case occurs for negative ion acceleration into TOF drift region 105. Alternatively, the offset potential applied to the RF electrodes and the DC potentials applied to planar side electrodes 145 and RF surface back electrodes can be switched to a positive potential to accelerate positive polarity ions into TOF drift region 105 or negative polarity to accelerate negative polarity ions into TOF drift region 105. Raising the potential applied to RF surface assembly 104 accelerates ions out of gap 115 through the grid of electrode 127 by effectively pushing them out. Alternatively, ion packet 143 ions can be accelerated from gap 115 by a simultaneous push and pull, achieved for positive ions by raising the voltage applied to RF surface assembly 104 electrodes in the positive polarity direction while applying a negative polarity accelerating potential to electrodes 127 and 128. The relative DC voltage values applied to RF surface assembly 104 electrodes, electrodes 127, 128, 135/148, the electrodes of ion reflectors 106 and 107 and detector 110 are set during ion acceleration and drift time to maximize TOF mass to charge analysis resolving power and sensitivity.

Figure 7:
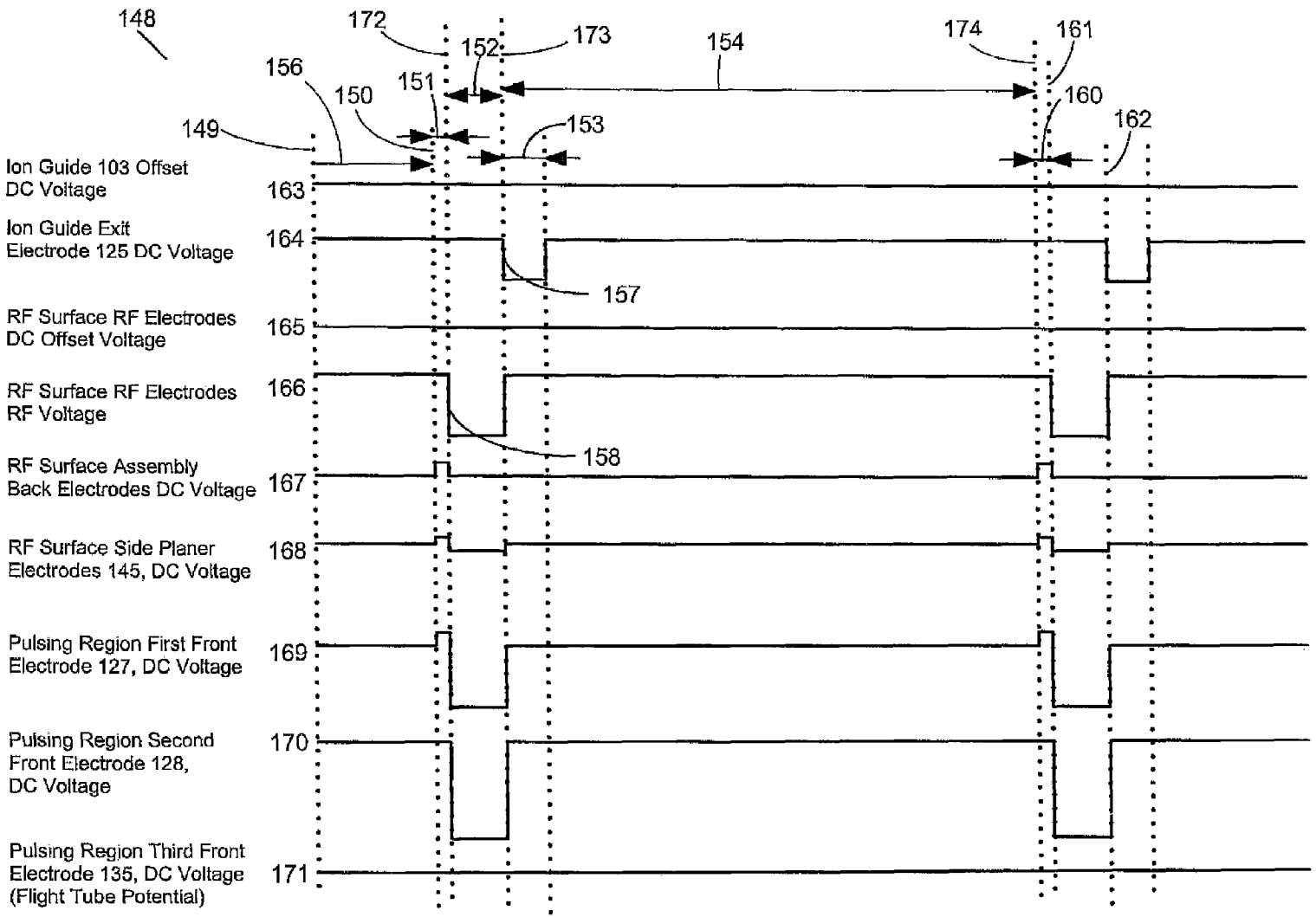
FIG. 7 is a timing diagram of a TOF pulsing sequence followed in FIGS. 6A through 6D.

Timing diagram 148 in FIG. 7 shows one example of a TOF pulsing sequence, for positive polarity ion mass to charge analysis, operated according to the invention. Lines 163 through 171 represent the voltage amplitudes applied to ion guide 103 DC offset (163), ion guide exit electrode 125 (164), RF surface 131 RF electrodes DC offset (165), RF surface 131 RF electrodes RF voltage (166), RF surface assembly 104 back electrodes DC voltage (167), RF surface assembly 104 side planar electrodes 145 DC voltage (168), TOF pulsing region first front electrode 127 DC voltage (169), TOF pulsing region second front electrode 128 DC voltage (170) and TOF pulsing region third front electrode 135 or TOF flight tube DC voltage 148 (171). Timing diagram 148 begins at timing point 149 in the middle of a TOF acquisition pulsing cycle. At timing point 149 and along time period 156, ions are traveling through TOF tube 105 and hitting detector 110 while ion population 142 is trapped at RF surface 131 and is undergoing collisional cooling of translation energy as shown in FIG. 6C. At timing point 150 trapped ion population 142 is subjected to spatial compression by an increase in the voltage applied to DC electrodes surrounding RF surface 131. The compression time lasts short time period 151. At time point 172, the RF voltage applied to the RF electrodes is switched off as shown at event 158 along RF voltage amplitude line 166. Simultaneously, DC voltages on front electrodes 127 and 128 are switched low to accelerate positive polarity ions into TOF flight tube 105 while RF surface back, side and offset DC voltages are switched to provide an optimal DC field at RF surface 131 for accelerating ions uniformly into TOF flight tube 105. Time point 172 is illustrated in FIG. 6D.

Ion acceleration voltages are held for time duration 152 which is sufficient time for the highest mass to charge value ion to pass through the grid in electrode 135. At time point 173 a new TOF the RF voltage is turned on and the DC voltages in pulsing region 133 are set to allow ions to enter gap 115 and be directed to RF surface 131 as shown in FIG. 6A Simultaneously, the voltage applied to ion guide exit lens 125 is switched to allow the release of trapped ions 140 from ion guide 103 as shown at event 157 along DC voltage amplitude line 164. After time period 153 has elapsed, the voltage applied to ion guide exit lens 125 is raised to trap remaining ions in ion guide 103 as shown in FIG. 6B. Released ions comprising ion packet 141 enter gap 115 and are directed towards RF surface 131 while the previously pulsed ion packet 143 is traversing TOF flight tube 105 toward detector 110 separating in time by mass to charge value. Time period 154 is set to provide sufficient time for the highest m/z value ion to hit detector 110 completing the TOF spectrum acquisition for the TOF pulse starting at time period 172. While the previous pulsed packet is traversing TOF flight tube 105, the translational energies of ions in ion packet 142 trapped at RF surface 131 are being cooled due to collisions with background gas. At time point 174 the amplitude of DC voltages applied to DC electrodes surrounding RF surface 131 are increased to spatially compress trapped ion packet 142 for the short time period 160. This begins a new pulsing cycle. The new spatially compressed ion packet 143 is pulsed into TOF flight tube 105 beginning at time point 161 analogous to time point 172 of the previous TOF pulse. Ion accelerating potentials applied to electrodes are maintained up to time point 162 as the TOF pulsing cycle is repeated. TOF spectra acquired for each TOF pulse cycle are typically summed to form a summed TOF spectrum that is saved in a data file.

The total TOF pulse cycle time shown in the example timing diagram 148 in FIG. 7 is the sum of time periods 151, 152 and 154. Rapid TOF pulse rates minimize space charge build by trapped ions at RF surface 131. The ion accumulation at RF surface 131 provides very high duty cycle TOF m/z analysis for a wide range of ion m/z values. When operating the RF surface in TOF pulsing region 133, higher sensitivity can be achieved over a broader mass range compared with trappulse operation described in U.S. Pat. No. 5,689,111 incorporated herein by reference. Reduction of the trapped ion population spatial and energy spread prior to pulsing into the TOF flight tube increases TOF resolving power compared to conventional orthogonal pulsing TOF mass to charge analysis. The RF surface effectively decouples the energy spread of the initial ion population from the ion population pulsed into the TOF flight tube providing improved consistency in TOF performance with reduced upstream tuning constraints. TOF pulsing region 133 comprising RF surface assembly 104 can be operated in conventional orthogonal pulse and trappulse modes when ion trapping at RF surface 131 is turned off. Ion reflector 106 can be configured at an angle relative to the centerline of TOF flight tube 105 to reflect ions accelerated from trapping surface 131 onto detector 110 without the need to steer the accelerated ion beam.

Figure 8:
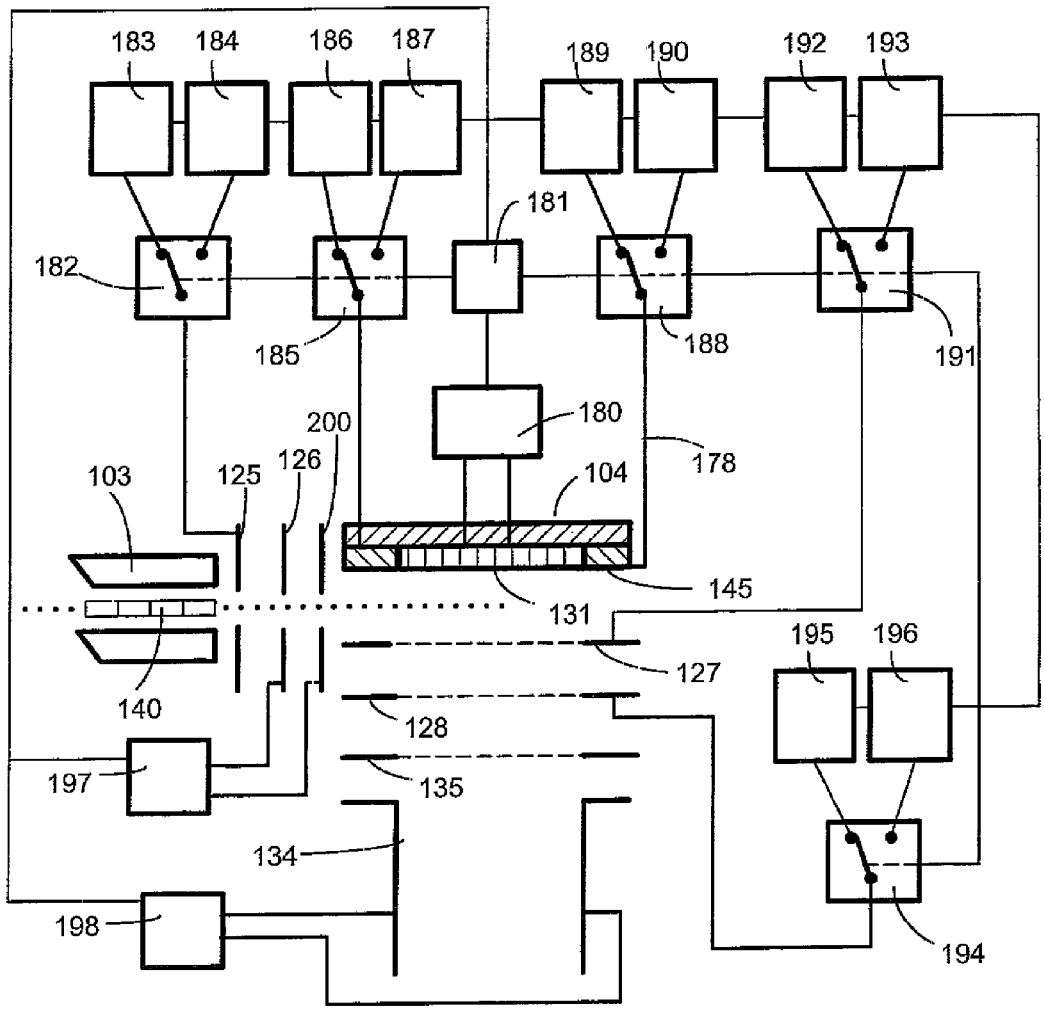
FIG. 8 is a diagram of one embodiment of the power supply connections and switches providing electrical potentials to an RF surfaced configured in an orthogonal pulsing TOF mass analyzer.

The voltage switching sequences described above for a TOF pulse cycle are applied and controlled through the electronics circuit assembly shown as an example in FIG. 8. Elements common to those shown in FIGS. 5 and 6 have retained the same number in FIG. 8. RF electrodes configured in RF surface assembly 104 are connected to RF and DC offset power supply 180. Back electrodes configured in RF surface assembly 104 are connected to DC power supplies 186 and 187 through switch 185. Side planar electrodes 145 are connected to DC power supplies 189 and 190 through switch 188. First forward electrode 127 is connected to DC power supplies 192 and 193 through switch 191, Second forward electrode 128 is connected to DC power supplies 195 and 196 through switch 194. Ion guide exit lens 125 is connected to DC power supplies 183 and 184 through switch 182. Electrodes 126 and 200 are connected to dual output DC power supply 197 and steering electrode set 134 is connected to dual output DC supply 198. Switches 182, 185, 188, 191 and 194 and all power supplies are controlled by logic unit 181 during TOF pulsing sequences with ion trapping at RF surface 131. Rapid voltage switching and timing sequences shown in timing diagram 148 in FIG. 7 are software and hardware controlled through logic unit 181. Logic unit 181 may comprise a commercially available computer or a custom electric circuit. Switches 182, 185, 188, 191 and 194 allow rapid and precise switching between respective power supplies to rapidly apply appropriate voltages to DC electrodes during a TOF pulsing sequence. The applied voltages and switching timing sequence can be changed through the software control program running in logic unit 181.

Figure 9:
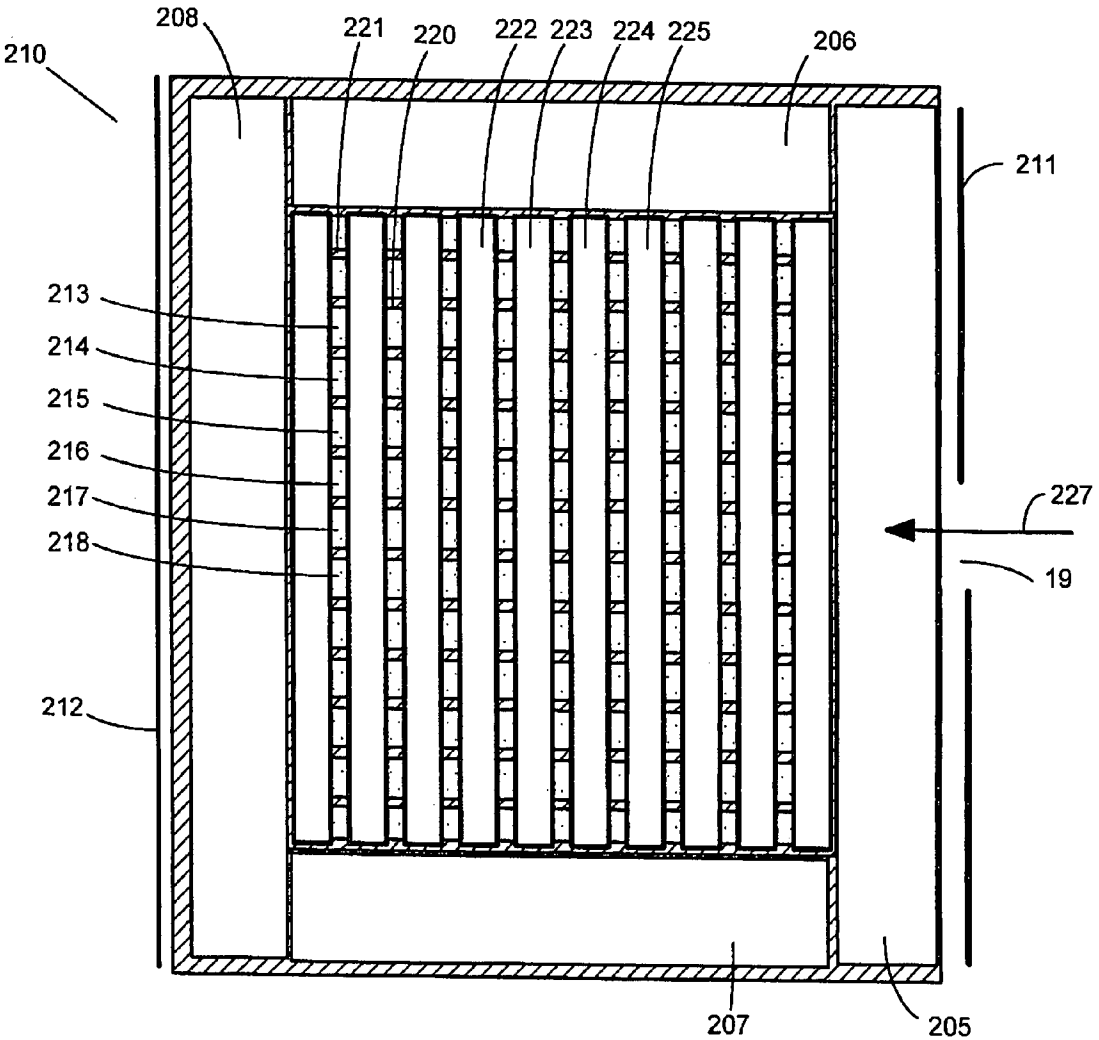
FIG. 9 is a top view diagram of an RF surface configured with linear backing electrodes and with linear RF electrodes oriented perpendicular to the primary ion beam in an orthogonal TOF pulsing region.

An alternative embodiment of an RF surface assembly configured in a pulsing region of a TOF mass to charge analyzer is diagrammed in FIG. 9. RF surface assembly 210 comprises linear RF electrodes including RF electrodes 222, 223, 224 and 225 extending the length of RF surface 231 and oriented perpendicular to incoming ion beam 227. RF surface assembly 210 comprises linear DC back electrodes including 213, 214, 215, 216, 217 and 218 configured underneath and perpendicular to linear RF electrodes 222 through 225. Back electrodes including electrodes 213 through 218 are separated by electrically insulating gaps including 220 and 221. Planar side DC electrodes 205, 206, 207 and 208 surround all RF electrodes including RF electrodes 222 through 225 and are positioned in the plane formed by the tops of the RF electrodes including RF electrodes 222 through 225. Side electrodes 211 and 212 are positioned on either side of RF surface assembly 210 to provide additional electric field shaping and to aid in optimizing ion trapping and release functions. Side electrodes 211 and 212, planar side electrodes 5 through 8 and back electrodes 213 through 218 serve a similar function as the side, planar side and concentric ring back electrodes configured in RF surface assembly 1 shown in FIG. 1 and described above DC voltages applied to planar side electrodes 205 through 208 are set during trapping to form a DC energy well with RF surface 231 that aids in trapping ions at RF surface 231. Separate or common DC voltages may be applied to back electrodes including electrodes 213 through 218 to direct ions to spread out along RF surface 231 or to move ions toward specific locations on RF surface 231. The amplitude of DC voltage applied to back electrodes 213 through 218 can be adjusted to move trapped ions into or above the plane of RF surface formed by the tops of RF electrodes 222 through 225

Figure 10A:
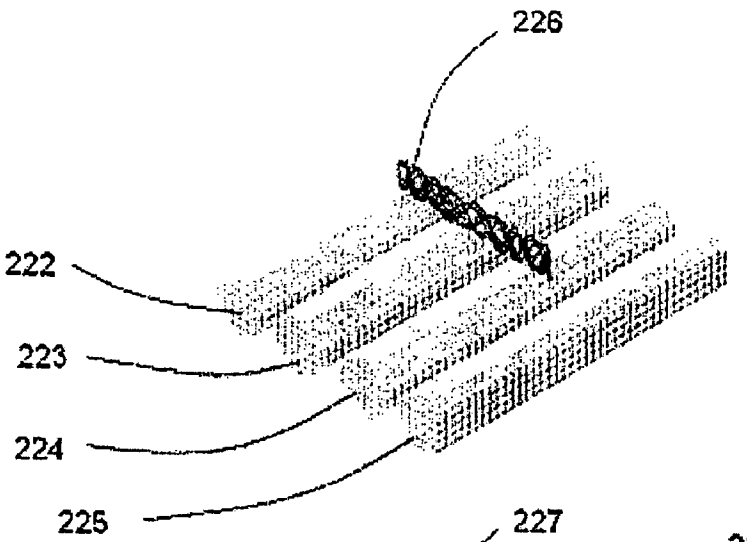
FIG. 10A is an isometric view of the RF surface diagrammed in FIG. 9 showing a calculated ion trajectory along the RF surface.
Figure 10B:
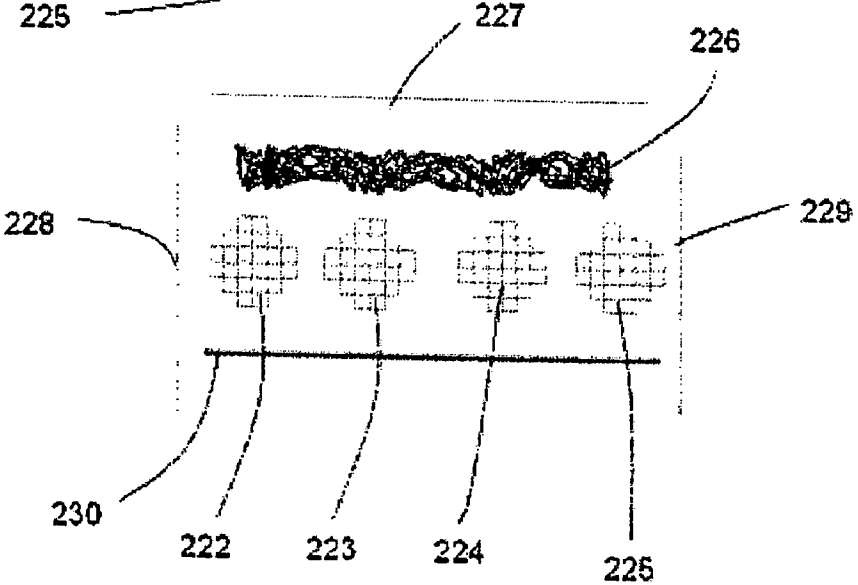
FIG. 10B is a side view of the calculated ion trajectory shown in FIG. 10A.

RF electrodes including RF electrodes 222 through 225 may be configured as rods, wires traces on circuit boards or other fabrication techniques known in the art. Linear RF electrodes 222 through 225 may be segment along the electrode length allowing further manipulation of trapped ion populations by adjusting the relative offset potentials applied to different segments of the segmented linear RF electrodes Planar side electrodes and back electrodes may be configured as conductive traces on circuit boards similar to the circuit board configuration described for RF surface assembly 1 shown in FIGS. 1 and 2. FIGS. 10A and 10B show calculated ion trajectory 226 for an ion trapped above a portion of RF surface 231 with minimum collisional damping of ion translational energy. Ions are trapped by the RF voltage and DC offset voltage applied to RF electrodes 222 through 225 and the DC voltages applied to front electrode 227, back electrode 230 and side electrodes 228 and 229 as shown in FIGS. 10A and 10B. FIG. 10A is an isometric view of a portion of RF surface 231 and FIG. 10B is a side view of a portion of RF surface assembly 210. Increasing the background pressure at RF surface 231 would reduce trapped ion translational energies through ion collisions to neutral background molecules.

Figure 11:
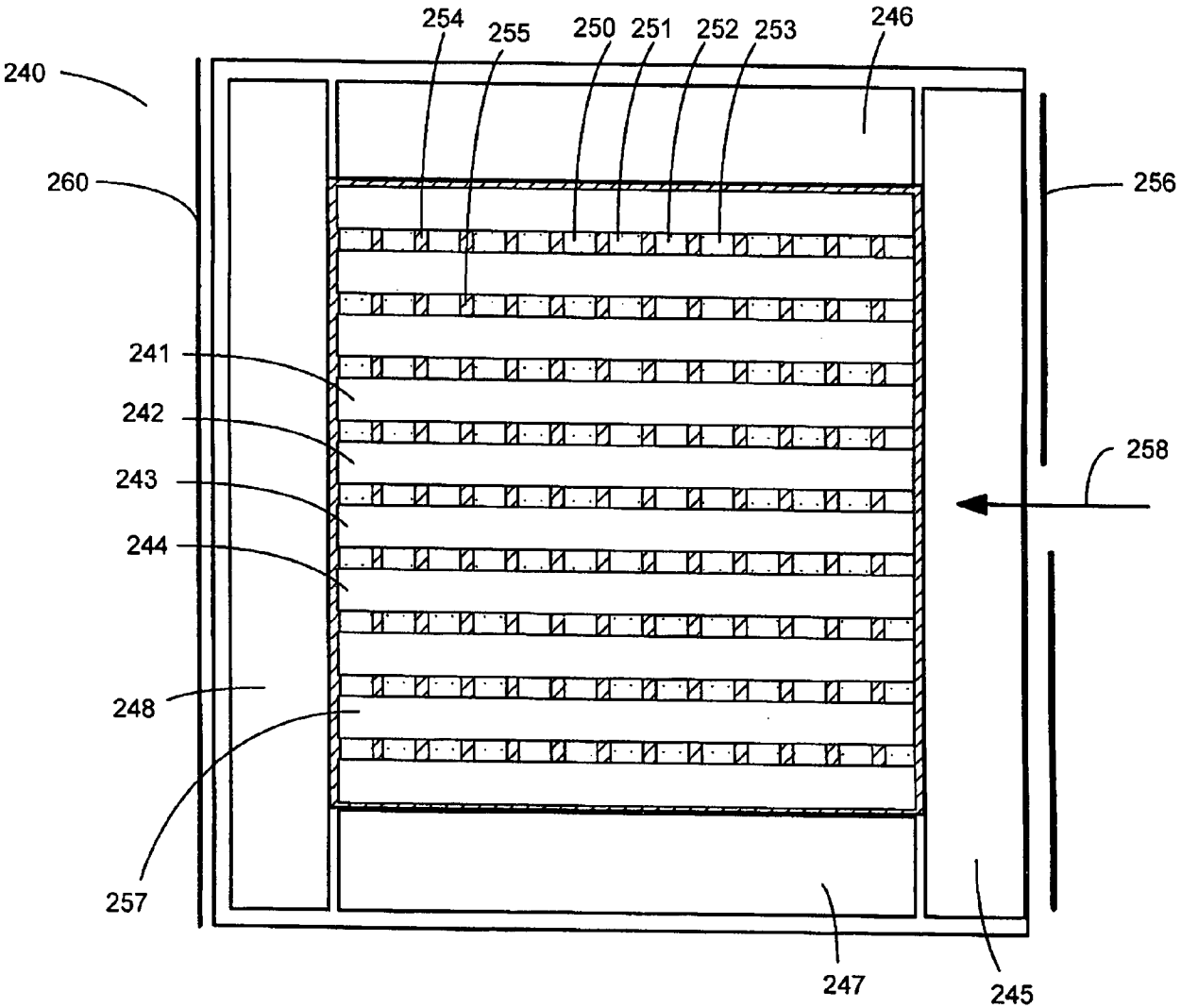
FIG. 11 is a top view diagram of an RF surface configured with linear backing electrodes and with linear RF electrodes oriented parallel to the primary ion beam in an orthogonal TOF pulsing region.

An alternative embodiment of an RF surface assembly electrode configured in a TOF pulsing region is diagrammed in FIG. 11. RF surface 240 comprises linear RF electrodes including 241, 242, 243 and 244 oriented parallel to the initial direction of ion beam 258 RF surface assembly 240 is configured similar to RF surface assembly 210 but is rotated 90 degrees relative to the incoming ion beam in a TOF pulsing region. Back electrodes including electrodes 250, 251, 252 and 253 separated by electrically insulating gaps including 254 and 255 are configured perpendicular to linear RF electrodes 241 through 244. Voltages applied to side electrodes 256 and 260 and planar side electrodes 245, 246, 247 and 248 are set to form a DC potential energy well containing RF trapped ions moving along RF trapping surface 257. Similar to RF trapping surface assembly 210, voltages applied to back electrodes 250 through 253 can be set adjust trapped ion position relative to the plane of RF surface 257 defined by the top of linear electrodes 241 through 244. Initial ion trajectories entering parallel to linear RF electrodes 242 and 243 can be constrained to move along the gaps between RF electrodes 241 through 244 by applying the appropriate RF offset and DC fields to surrounding electrodes. Spatial compression of ion trajectories may be improved prior to pulsing into a TOF flight tube using the parallel RF surface 257 linear electrode orientation compared with the embodiment shown in FIG. 9. In alternative embodiments of the invention, ions may be directed toward RF trapping surfaces from any direction prior to trapping. Depending on specific applications and TOF pulsing region embodiments, ions may directed toward the RF surface from the front through the front electrode grid, from behind through a ion guide gap in the RF surface or from the sides. Ion populations from different sources and directions can be mixed on trapping RF surfaces. Ions trapped on RF surfaces can be reacted with neutral reagent gas or fragmented with laser or photon induced dissociation.

Figure 12:
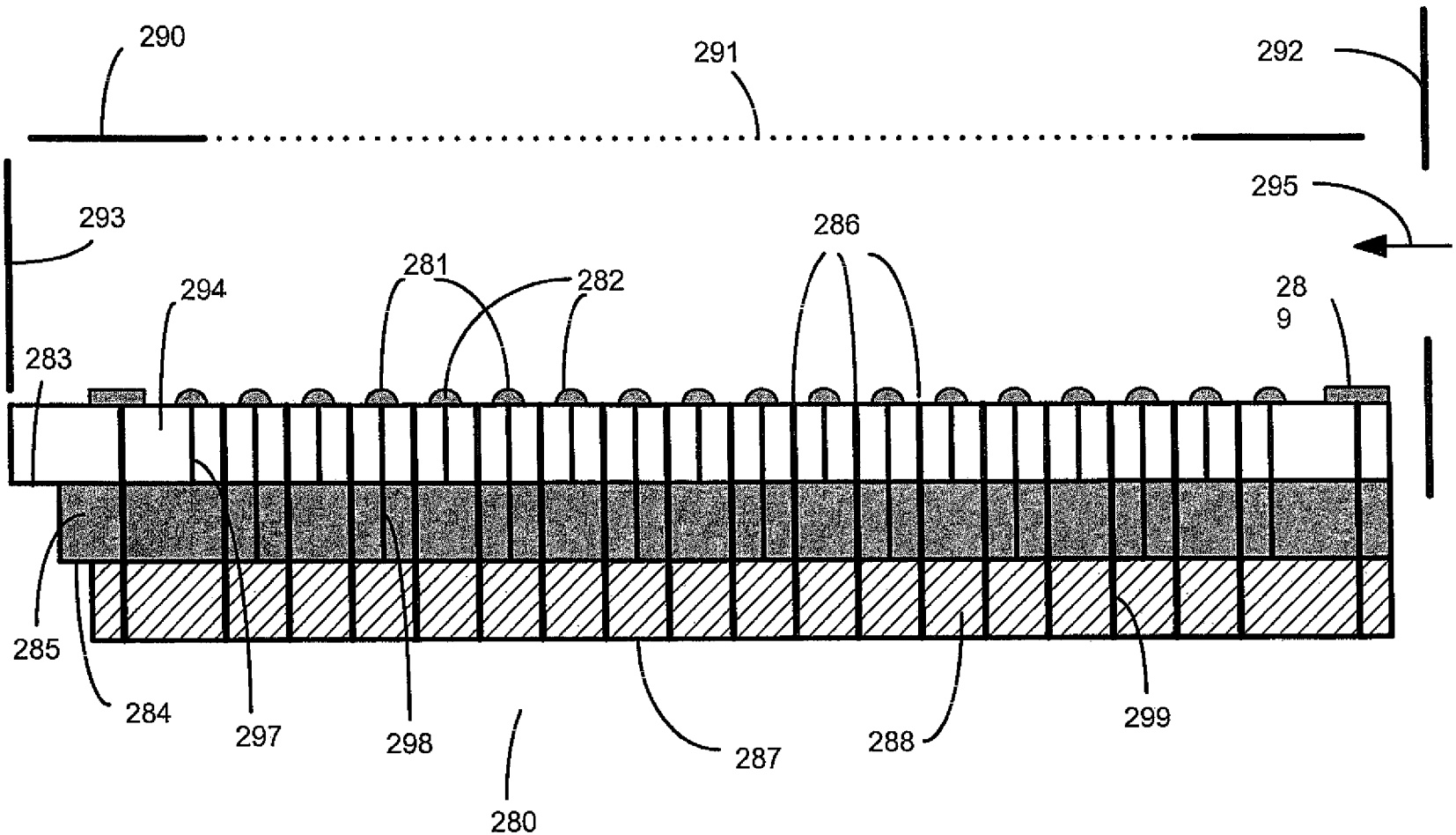
FIG. 12 is a diagram of an alternative embodiment of the RF surface comprising a layered structure configured in the pulsing region of a TOF mass to charge analyzer.

RF surfaces can be constructed using different fabrication techniques. In an alternative embodiment of the invention diagrammed in FIG. 12, small RF electrode dimensions can be achieved using a layered circuit board or layered micro fabrication approach. Smaller and denser RF surface electrode assemblies provide very near field RF trapping above which trapped ions more closely approximate an ideal thin flat continuous sheet of ions prior to pulsing into a TOF flight tube. As described above, reducing the spatial spread of trapped ions prior to pulsing into a TOF mass to charge analyzer improves TOF MS resolving power and mass measurement accuracy. RF surface assembly 280 comprises three dielectric layers 294, 285 and 288 RF electrodes 281 and 282 shaped as half spheres are configured along the top side of dielectric layer 294. Similar to the spherical RF electrode embodiment diagrammed FIGS. 1 and 2, opposite RF voltage phase is applied to adjacent RF electrodes 281 and 282. RF electrodes 281 with common RF phase applied are connected to conductive trace 284 configured on the bottom side of second dielectric layer 285 through vias or through conductive channels 298 RF electrodes 282 with opposite applied RF phase, are connected to conductive trace 283 configured on the bottom side of first dielectric layer 294 through vias or through conductive channels 297. Back DC electrodes 286 positioned in the gaps between RF electrodes 281 and 282 and planar side DC electrodes 289 connect to conductive trace 287 configured on the bottom side of dielectric layer 288 through vias or conductive through channels 299. Separate DC voltages are applied to side electrodes 292 and 293 and front electrode 290 with grid 291. Electrical connections to RF and DC power supplies are made to conductive traces configured on the bottom sides of each dielectric layer or circuit board. Operation of RF surface assembly 280 and surrounding DC electrodes with or without collisional cooling of trapped ions in the pulsing region of a TOF mass to charge analyzer is similar to RF surface assembly embodiments described above. Layered or micro fabricated devices as diagrammed in FIG. 12 reduce the cost and assembly time of multiple RF electrode RF surfaces devices while improving performance for specific applications.

Figure 13:
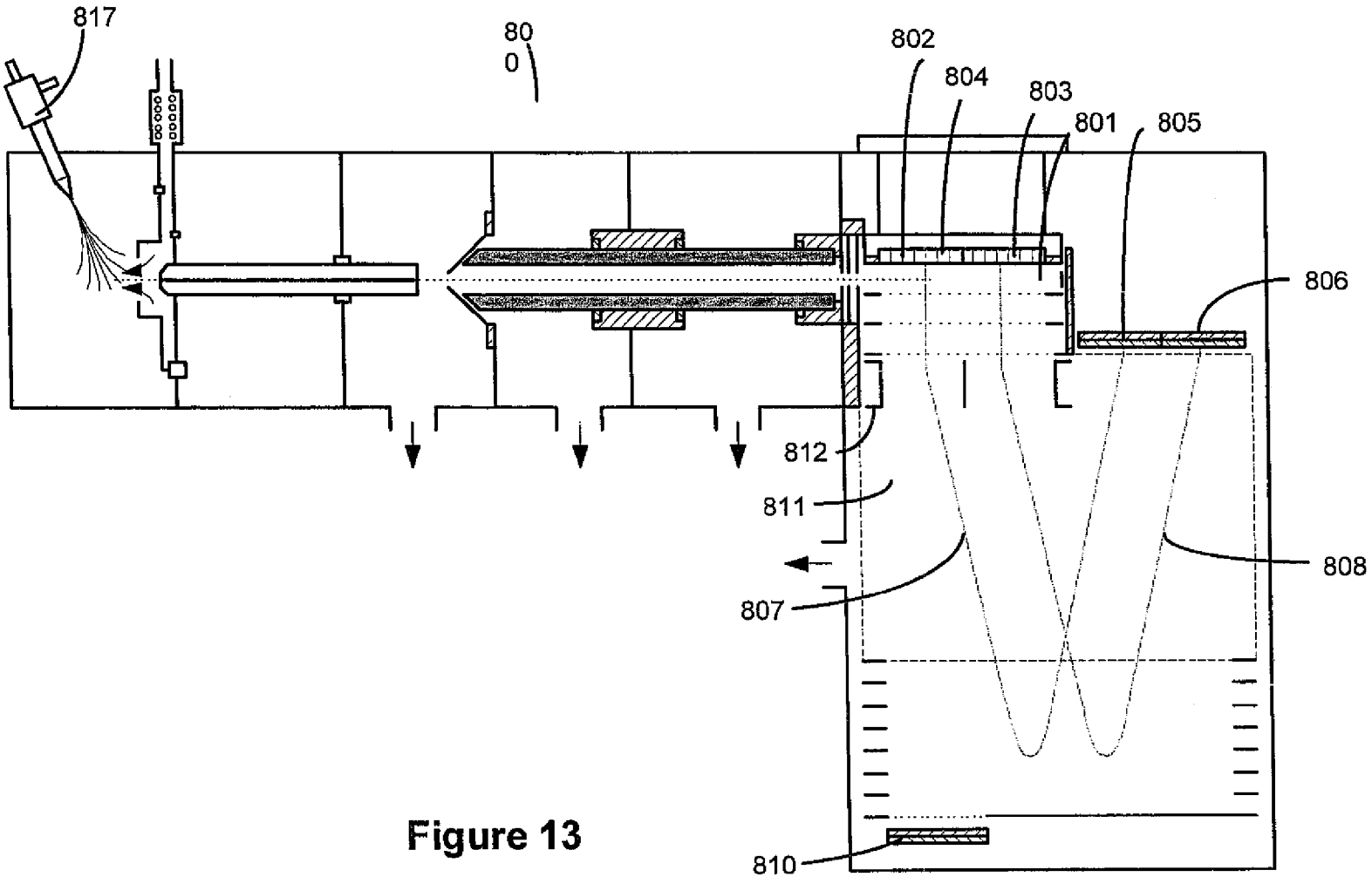
FIG. 13 is a diagram of an orthogonal pulsing TOF mass analyzer configured with a dual RF surface in the TOF pulsing region and dual multichannel plate detectors.

In alternative embodiments of the invention, RF surfaces can be configured with alternative RF surface contours or shapes. The control of trapped ion location along RF trapping surfaces can be used to steer accelerated ions along different flight paths in TOF flight tubes. An alternative embodiment of RF surface 804 is configured in pulsing region 801 of hybrid TOF mass to charge analyzer 800 as diagrammed in FIG. 13. The length of RF surface 804 is increased to allow the storage of an ion population in two RF surface regions 802 and 803 of RF surface assembly 804. Hybrid TOF MS 800 comprises two multichannel plate detectors operated at separate gain. Ions trapped along RF surface region 802 are accelerated into TOF flight tube 811 and impinge on first TOF detector 805. Ions trapped along RF surface region 803 are accelerated into TOF flight tube 811 and impinge on second TOF detector 806. Ion signals acquired from TOF detectors 805 and 806 can be combined to increase the dynamic range and amplitude signal resolution in TOF mass to charge analysis. Alternatively, ions accelerated from RF surface region 802 can be directed to impinge on third TOF detector 810 while ions simultaneously accelerated from RF surface region 804 can be directed to impinge on TOF detector 805 or 806 by applying appropriate voltages to two section steering electrode assembly 812.

Figure 14:
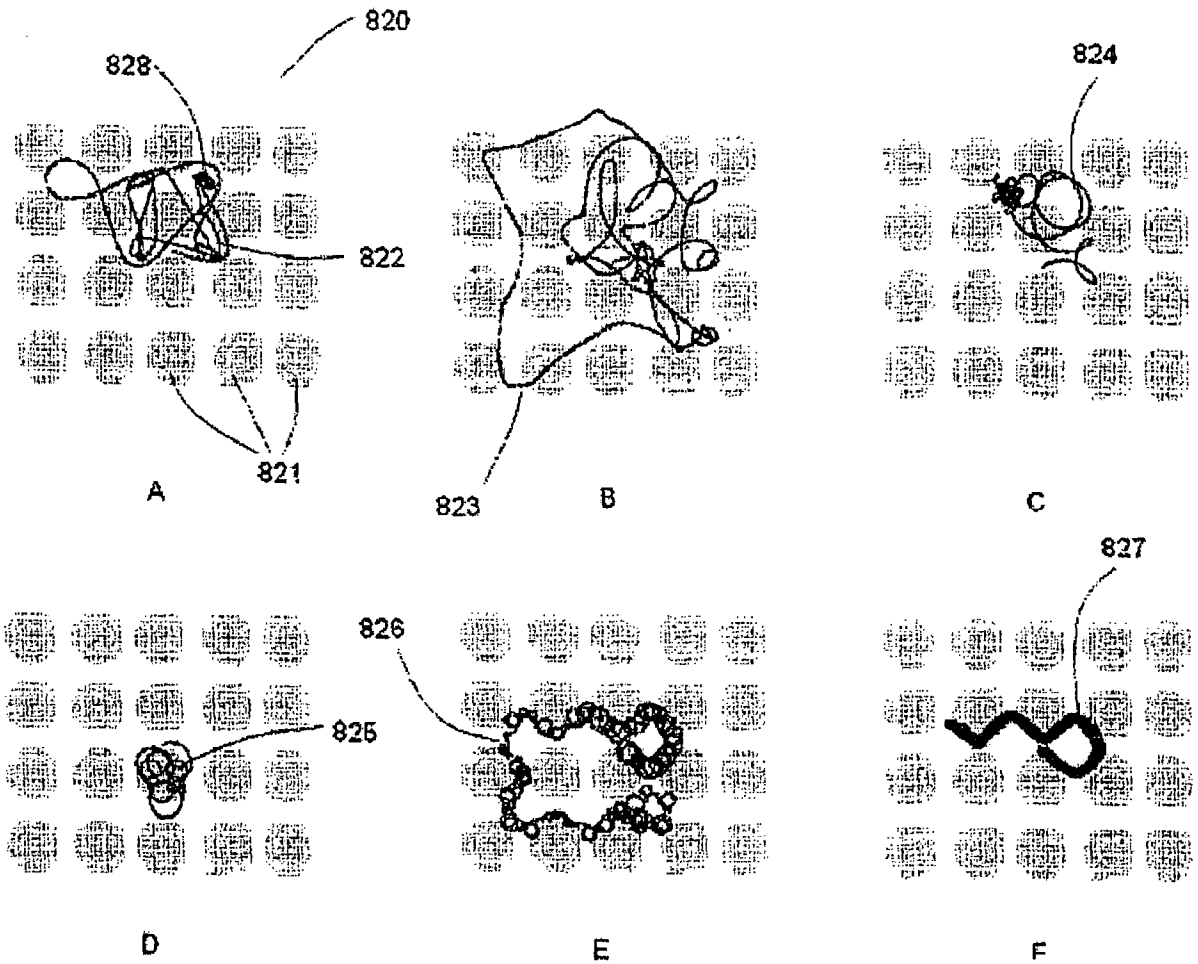
FIG. 14A through F show are calculated ion trajectories of ions trapped above an RF surface in the presence of a cross magnetic field.

In an alternative embodiment of the RF surface, a magnetic field can be applied in addition to the electric fields described to provide further control of trapped ion trajectories at the RF surface. When a magnetic field is added, trapped ion trajectories exhibit complex motions due to combined effects of the magnetic field, RF fields and electrostatic fields. Trapping efficiency can be enhanced, ion motion across the surface can be controlled, and, for appropriate phase space conditions, ion to mass selection can be achieved operating with a combination of RF and magnetic fields. A magnetic field can be advantageously applied along the x, y or z axis of the RF surface. FIGS. 14A through 14E show examples of calculated ion trajectories with and without the presence of an auxiliary magnetic field applied perpendicular to the plane of the RF surface RF surface 820 comprising an array of spherical RF electrodes 821 is configured similar to RF surface assembly 1 diagrammed in FIGS. 1 and 2. In FIGS. 14A through 14E the initial ion kinetic energy parallel to RF surface 820 is 1 eV FIG. 14A shows ion trajectory 822 calculated with RF and DC electric fields applied during ion trapping at RF surface 820, as described above, in the absence of a magnetic field. Ion trajectory 822 moves over multiple RF pseudo potential wells experiencing multiple turning points prior to being trapped in pseudo potential well 828. In FIGS. 14B, 14C, 14D, 14E and 14F the magnetic field is applied perpendicular to the RF surface plane with magnetic field strength set to 0.1, 0.25, 0.5, 1 and 3 Tesla (T) respectively As shown in FIG. 14B with a 0.1 T magnetic field added to the RF and DC electrical trapping fields, ion trajectory 823 acquires a complex motion with a large radial trajectory motion due to the force of the magnetic field. This lower magnetic field strength can be useful to spread out the ions along the surface to reduce space charge effects. As the magnetic field strength is increased, as illustrated in FIGS. 14C, 14D, 14E and 14F, the radial component due to the magnetic field force decreases and the frequency of motion about this radius increases as shown in ion trajectories 824, 825, 826 and 827 respectively. At higher magnetic field strength, ion motion tracks the electrical equipotential surface generated by the RF and DC voltages applied to electrodes comprising surface RF surface assembly 820 as is evident in calculated ion trajectories 826 and 827 of FIGS. 14E and 14 F respectively. The magnetic field produces a spiral ion motion as the ion moves along the RF surface. This spiral ion motion increases the ion flight path allowing more rapid collisional cooling of ion translational energy for a given background pressure or provides sufficient collisional cooling of ion kinetic energy at lower background pressures. The addition of a magnetic field to the operation of an RF surface permits the trapping of ions above the RF surface, almost entirely independent of the initial ion phase space conditions and reduces collision gas pressure requirements.

Figure 15:
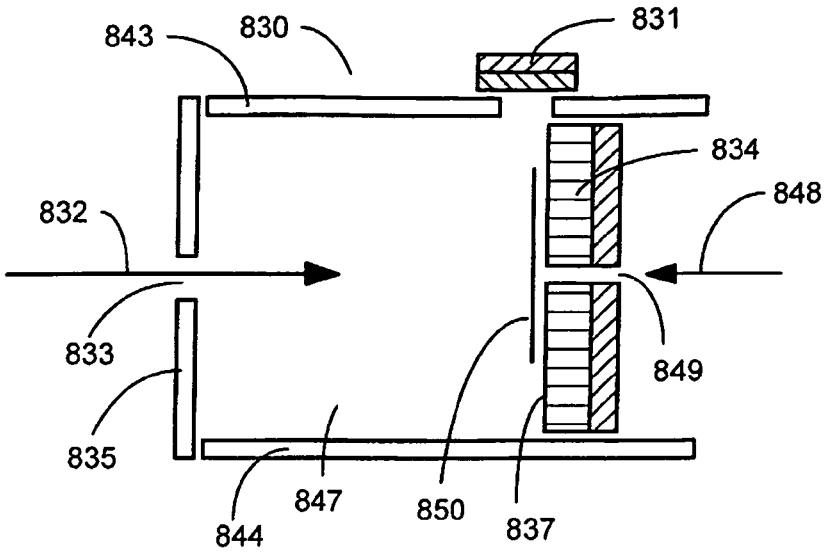
FIG. 15 is side view diagram of an RF surface embodiment configured in a cross magnetic field mass to charge analyzer.
Figure 16:
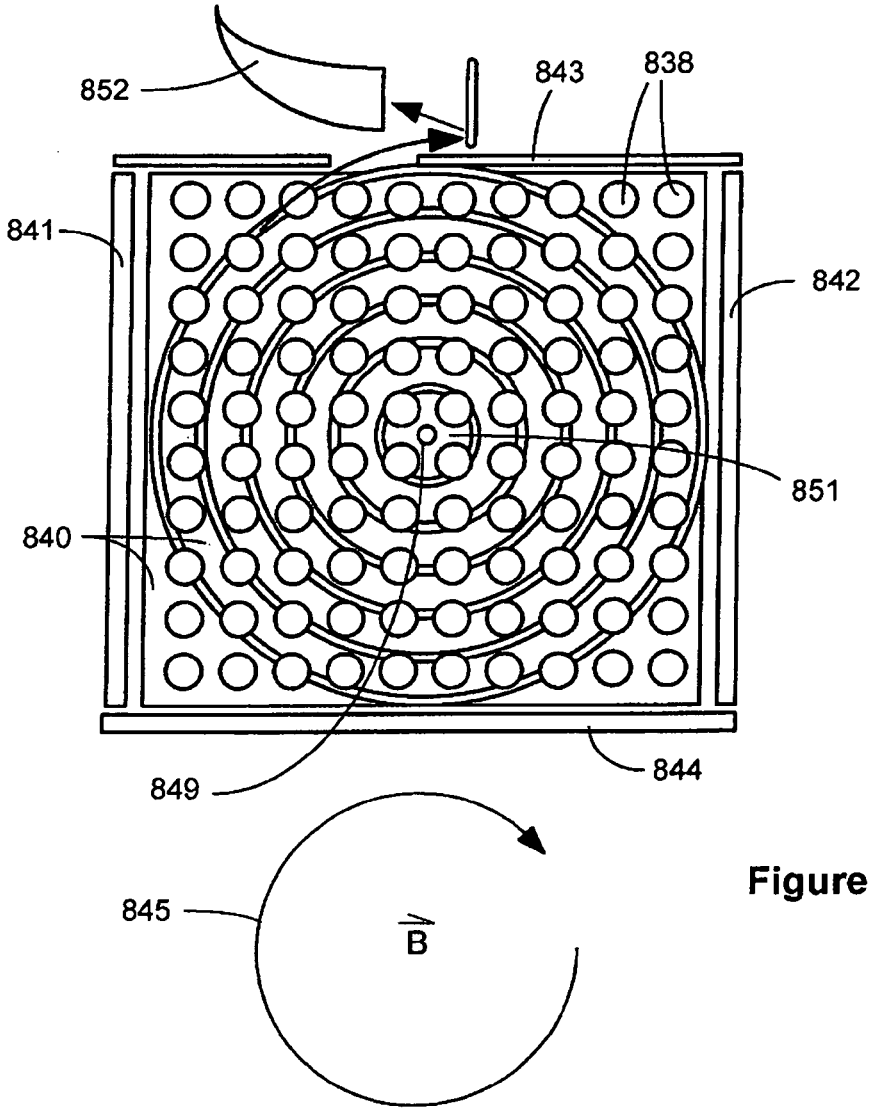
FIG. 16 is a front end view diagram of the RF surface cross magnetic field mass to charge analyzer diagrammed in FIG. 15

Alternative embodiments of RF surfaces can be configured and operated in different mass to charge analyzer types to provide unique or improved performance. An alternative embodiment of the RF surface is diagrammed in FIG. 15 wherein RF surface assembly 834 is configured as an ion trapping surface in mass to charge analyzer 830. Mass to charge analyzer 830 employs crossed magnetic 845 and RF electric fields to effect a mass to charge dependent extraction of trapped ions to external detector 831. A cross section side view of mass to charge analyzer 830 is diagrammed in FIG. 15 and a front cross section view of RF surface mass to charge analyzer 830 is shown in FIG. 16. Ions 832 are directed into mass to charge analyzer volume 847 through orifice 833 in electrode 835. Ions travel toward RF surface assembly 834 where they are trapped above RF surface 834 as described previously by the combined forces imposed by the RF and DC voltages applied to RF electrodes 238, DC electric fields applied to back electrodes 840, side electrodes 841, 842, 843 and 844, front electrode 835 and magnetic field 845. Magnetic field 845 is applied perpendicular to the plane of RF surface 834, permeating RF surface assembly electrodes and surrounding electrodes with minimum distortion due to the non-magnetic materials employed. Neutral gas molecules may be introduced into volume 847 or RF surface mass to charge analyzer 830 to provide collisional cooling of trapped ion kinetic energy. Alternatively, laser beam 848 may be directed through orifice 849 in RF surface assembly or along the plane of trapped ion population 850 to effect laser cooling of trapped ion kinetic energy. Individual back electrodes 840 are configured as concentric conductive rings to provide control of trapped ion motion above RF surface 837. Trapped ions move toward the center region 851 of RF surface 837 directed by magnetic field 845 and electrostatic forces from DC voltages applied to electrostatic DC back electrodes 840, side electrodes 841 through 844 and front electrode 835 combined with laser or collisional cooling of ion kinetic energy. The trapped ions population is then 'chirped' or accelerated out from center region 851 by a transient electric field applied to DC back electrodes 840 and side electrodes 841 through 843. Accelerated ions have the same kinetic energy, so ions of different mass-to-charge will have a different rotational frequency above RF surface 837 rotating around center region 851 of RF surface 837. The rotational motion of the ions can be capacitively detected, as is well-known with a Fourier Transform ICR device. Alternatively, the ions may be displaced radially, responding to a common frequency applied to back and/or side electrodes and orbit at different radii due to different kinetic energies dependent on ion mass to charge. A radial electric field may be used in scanning mode to move the orbits of ions to larger radii, eventually exiting the RF field and detected with electron multiplier detector 852 or multichannel plate detector 831.

Figure 17:
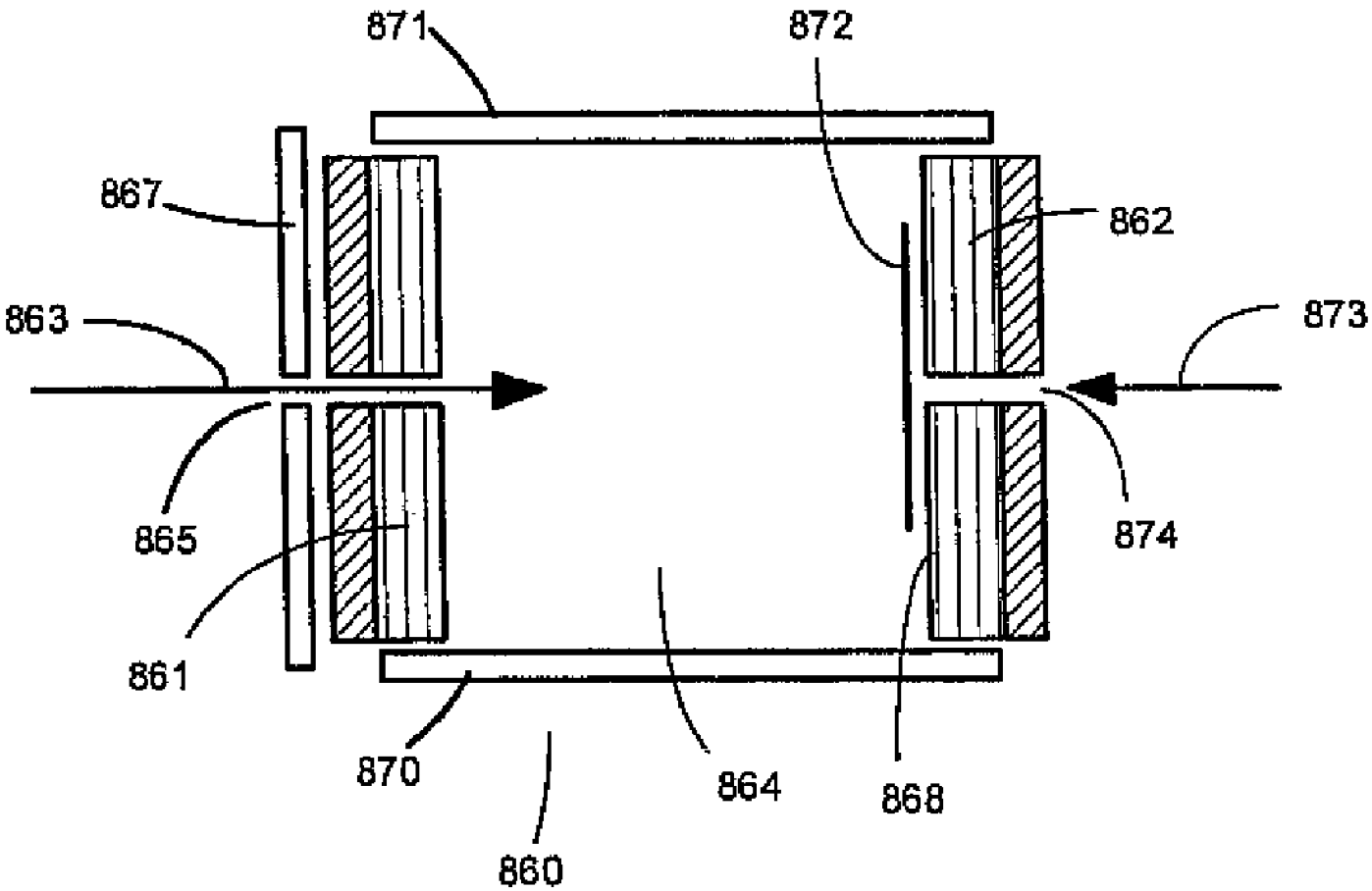
FIG. 17 is a side view diagram of an FTICR MS cell comprising RF surface assemblies.

In an alternative embodiment of the invention, two RF surface assemblies 861 and 862 are configured in analysis cell 860 of a Fourier Transform Inductively Coupled Resonance mass spectrometer (FTICR MS or FTMS) as diagrammed in FIG. 17. Ions 863 are directed into FTICR MS analyzer cell 860 through orifice 865 in electrode 867 and RF surface assembly 261. Ions travel toward RF surface 868 where they are trapped as described previously by the combined RF, electrostatic and magnetic field forces generated by RF voltages applied to RF electrodes and DC voltages applied to surrounding DC electrodes Neutral gas molecules may be introduced in FTMS cell 860 for collisional cooling of trapped ions 872. Alternatively, laser beam 873 may be directed through orifice 874 in RF surface assembly 862 to effect laser cooling of trapped ion kinetic energy. By adjusting the relative potentials applied to electrodes comprising RF surface assemblies 861 and 862 and the DC potential applied to surrounding electrodes 870 and 871, ions are directed toward the center of RFMS cell 860. The ions are then 'chirped' out from the center of FTMS cell 860 to larger orbits for detection through capacitive coupling with FTMS cell 860 side pickup electrodes 870 and 871 RF surface assemblies 861 and 862 configured in FTMS cell 860 increase trapping efficiency for ions with a broader energy spread than can be trapped with a DC electrode FTMS cell. In addition, the voltages applied to electrodes comprising RF surface assemblies 861 and 862 can be set equal after ion chirping and during ion detection to minimize variations in DC field along the axis of FTMS cell 860. The near field axial direction trapping provided by the operation of RF surfaces 861 and 862 with back and surrounding electrodes provides essentially an electrostatic field free region in volume 864 during mass to charge analysis improving the FTMS analysis resolving power.

During operation of the embodiments of the invention described above and shown in FIGS. 1 through 17, ions are trapped at or above RF surfaces and released or accelerated from the RF surfaces. Alternative embodiments of the RF surface comprise ion guides integrated into the RF surface. Ions trapped along the RF surface of such RF surface embodiments are directed to move into and through the ion guide integrated into the RF surface. Front DC electrodes configured with RF surfaces comprising ion guides, aid in focusing and trapping ions and transferring ions through orifices into vacuum from atmospheric pressure ion sources or through partitions in multiple vacuum stages. DC focusing electrodes configured with RF surface and ion guide embodiments of the invention improve ion transport efficiency from atmospheric pressure into vacuum and through multiple vacuum stages in mass spectrometer instruments. Alternative embodiments of the integrated RF surface and ion guide assemblies are configured and operated to provide multiple functions in addition to ion transport. Ion guide assemblies comprising ion tunnel or conduit sections along the ion guide length reduce neutral gas transmission between vacuum stages while providing efficient ion transmission. Ion guides configured in RF surfaces may extend through multiple vacuum stages and comprise multiple segments along the ion guide length. Ion transport, ion trapping, mass to charge selection, collision induced dissociation (CID) fragmentation, ion mobility separation and ion-neutral and ion-ion reaction functions can be performed in ion guides comprising entrance regions configured in RF surfaces.

Figure 18:
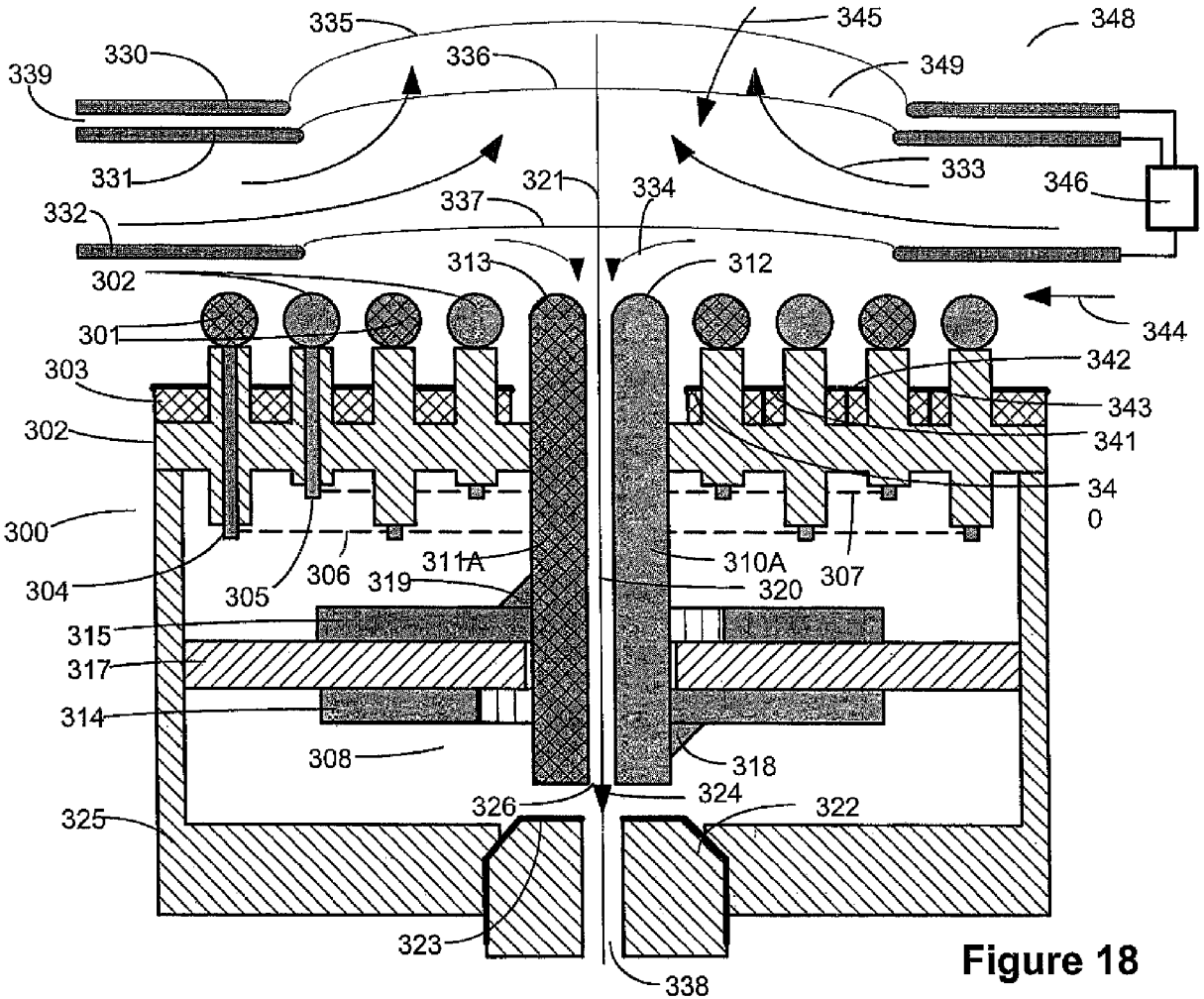
FIG. 18 is cross section diagram of an RF surface comprising an ion guide and multiple electrostatic electrodes in an atmospheric pressure ion source.
Figure 19:
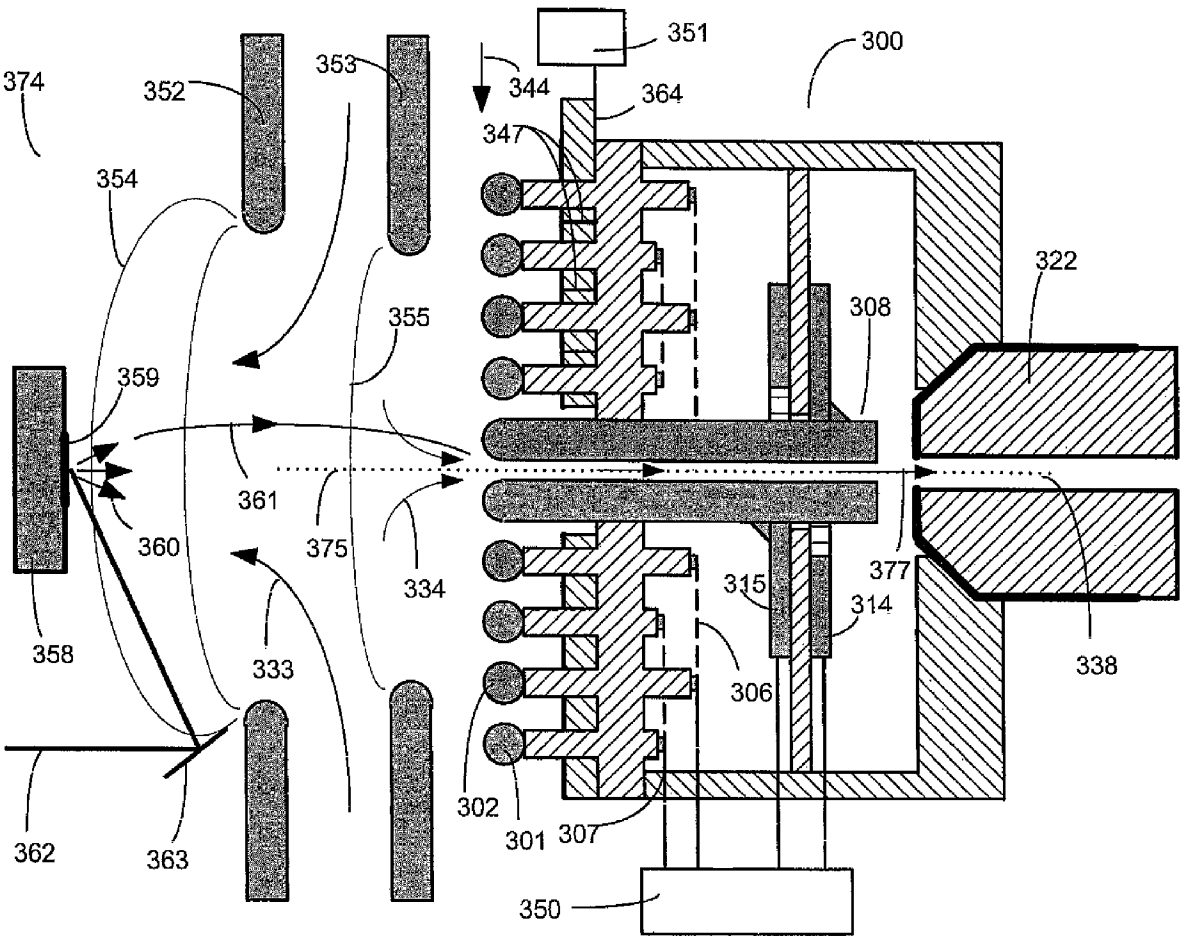
FIG. 19 is a cross section diagram of an RF surface comprising an ion guide in an atmospheric pressure MALDI ion source.
Figure 20:
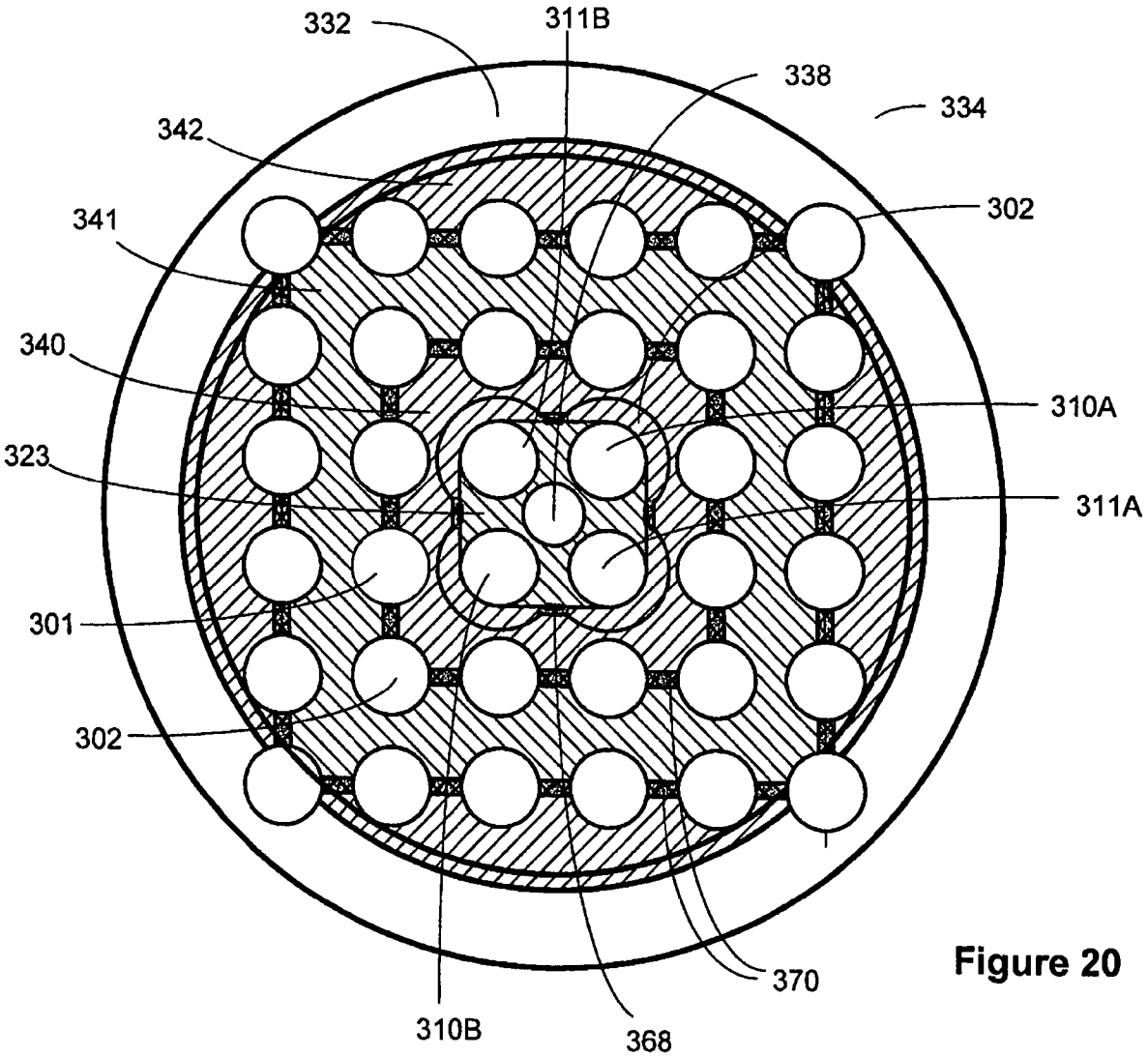
FIG. 20 is a top view of the RF surface with ion guide as shown in FIG. 18.

Spherical electrode RF surface assembly 300 comprising multipole ion guide assembly 308 configured and operated at or near atmospheric pressure is diagrammed in FIGS. 18, 19 and 20. A side cross section view of RF surface assembly 300 comprising multipole ion guide assembly 308 configured with forward DC electrodes 330, 331 and 332 and capillary 322 with orifice or bore 338 into vacuum is diagrammed in FIG. 18 FIG. 19 shows a side cross section view of RF surface assembly 300 configured in an atmospheric pressure ion source comprising Matrix Assisted Laser Desorption Ionization (MALDI) and forward DC electrodes 352 and 353. A magnified top view of RF surface assembly 300 is diagrammed in FIG. 20. A top view diagram of the center portion of back electrode circuit board 303 of RF surface assembly 300 is diagrammed in FIG. 21. Referring to FIGS. 18, 19, 20 and 21, RF surface assembly 300 comprises spherical electrodes 301 and 302 and the hemisphere shaped entrance ends 312 and 313 of ion guide poles 310A, 310B, 311A and 311B comprising multipole ion guide assembly 308. RF voltage of opposite phase is applied to adjacent electrodes 301 and 302 comprising RF surface 344. Similar to operation of RF surface assembly 1 diagrammed in FIGS. 1 and 2 described above, four RF surface spherical electrodes surrounding a common center region form a four electrode set Four electrodes 310A, 310B, 311A and 311B form a four hemisphere shaped RF electrode set at RF surface 344 and extend through RF surface assembly 300 forming multipole ion guide 308. All RF electrodes comprising RF surface 344 are evenly spaced in the embodiment of RF surface 300 shown in FIGS. 18 through 20. Common RF amplitude and frequency and a common DC offset is applied to all RF spherical electrodes including 301 and 302 with opposite RF phase applied to adjacent electrodes. The same RF frequency and phase is applied to ion guide electrodes 310A, 310B, 311A and 311B, however, a different RF amplitude and DC offset may be applied to optimize ion focusing and transmission into ion guide center channel 320. Ion guide poles or electrodes 310A, 310B, 311A and 311B slide through an opening in RF surface insulator 302 and through opening 371 in back electrode circuit board 303. Ion guide poles or electrodes 310A, 310B, 311A and 311B are electrically insulated from surrounding spherical RF electrodes and back DC electrodes. In one embodiment of the invention, hemisphere shaped entrance ends 312 and 313 of ion guide electrodes 310A, 310B, 311A and 311B are configured parallel to the tops of surrounding spherical electrodes 301 and 302 along RF surface 344. Alternatively, RF surface assembly 300 can be configured with hemisphere shaped entrance ends 312 and 313 of multipole ion guide assembly 308 positioned above or below the plane of RF surface 344. Ion guide assembly 308 is configured as a subassembly within RF surface assembly 300 and can be repositioned relative to RF surface 344 to optimize performance for a given application.

Figure 21:
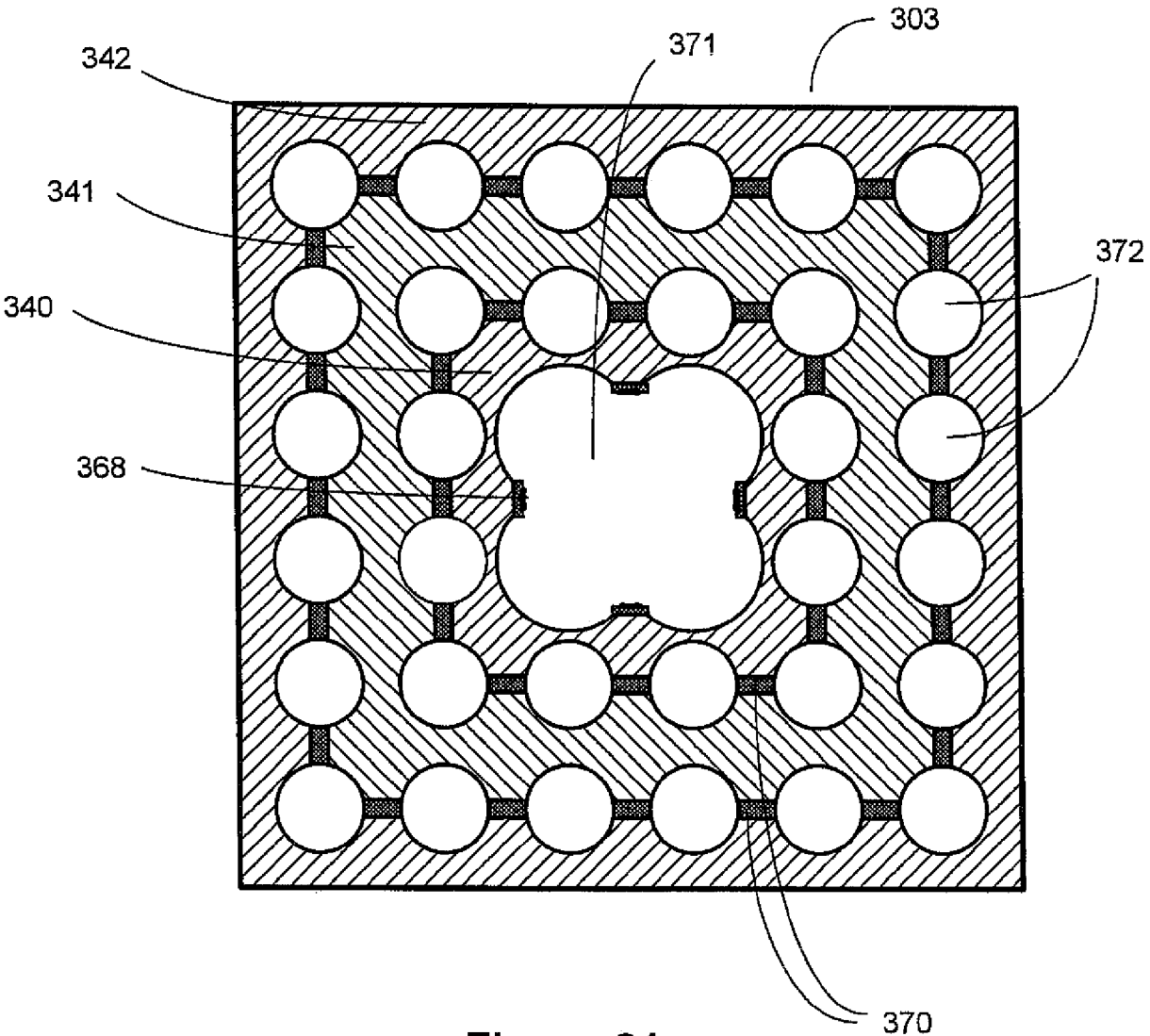
FIG. 21 is a top view of the backing electrode circuit board configured in the RF surface shown in FIGS. 18 and 19

Spherical electrodes 301 comprising RF surface assembly 300 with common RF voltage applied, connect to RF power supply 350 through connecting posts 304 extending through insulator 302 with conductor or circuit board 306 linking all common voltage RF spherical electrodes. Similarly, spherical electrodes 302 comprising RF surface assembly 300 with common RF voltage applied, connect to RF power supply 350 through connecting posts 305 extending through insulator 302 with conductor or circuit board 307 linking all common voltage RF spherical electrodes. Multipole ion guide assembly 308 mounting electrodes 314 and 315, separated by insulator 317, are electrically and mechanically attached to electrode pairs 310A with 310B and 311A with 311B through connections 319 and 318 respectively. Multipole ion guide assembly 308 may be constructed as described in U.S. Pat. No. 5,852,294 incorporated herein by reference or comprise other construction types known in the art. Mounting electrodes 315 and 316 and insulator 317 are configured to minimize the neutral gas conductance opening size along multipole ion guide assembly 308 as described in U.S. Pat. No. 5,852,294. Multipole ion guide electrodes 310A and 310B connect to RE power supply 350 through mounting electrode 314. Similarly, multipole ion guide electrodes 311A and 311B connect to RF power supply 350 through mounting electrode 315. Separate concentric back electrodes 340, 341, 342 and 343 configured on the top surface of circuit board 303 are separated by electrically insulating gaps 370 on back electrode circuit board 303 as shown in FIG. 21. Back electrodes 340 through 343 connect to DC power supply 351 through vias 347 in circuit board 303 and conductive traces 364 on the back side of circuit board 303. The voltages applied to back electrodes 340 through 343 are set to optimize the DC repelling field penetration between spherical RF electrodes during RF surface operation DC front electrodes 330, 331 and 332 connect to DC power supply 346. All RF and DC power supplies are connected to a logic unit for software program or manual control.

Referring to FIG. 18, ions 345 generated in atmospheric pressure ion source 348 are directed through opening 349 in front DC electrodes 330 and 331 driven by the focusing electric fields formed from the electrostatic potentials applied to front DC electrodes 330, 331 and 332 and the offset potentials applied to RF electrodes comprising RF surface assembly 300. DC electric accelerating and focusing fields, as depicted for illustration by lines 335, 336 and 337, focus ions 345 toward centerline 321 as they move against heated countercurrent drying gas 333 toward RF surface 344. DC voltages applied to back electrodes 340 through 343 and the RF and DC voltage applied to RF electrodes comprising RF surface 344 provide a near repelling field preventing approaching ions 345 from hitting electrodes comprising RF surface assembly 300. Ions trapped above RF surface 344 move toward centerline 321 driven by relative voltages applied to concentric back electrodes 340 through 343 and by gas flow 334 sweeping through the center channel 320 in multipole ion guide assembly 308. Ions entering channel 320 are swept through the length of ion guide 308 driven by gas flow and exit at ion guide exit end 326. The voltage applied to DC electrodes 368 shown in FIG. 21 is set to counteract or shield the repelling DC field applied to back electrode 340 from penetrating into channel 320 of multipole ion guide 308. Shielding or neutralizing the DC repelling electric field in channel 320 allows the ions traversing the length of ion guide 308 to pass by the back electrode plane driven by gas dynamics. The same gas flow that sweeps ions 324 through the length of ion guide channel 320, continues to sweep ions 324 into and through orifice or bore 338 in capillary 322. Ions entering vacuum from atmospheric pressure through capillary bore 338 are mass to charge analyzed as will be described below. Electrically insulating and mounting element 325 provides a mounting function for RF surface assembly 300 with capillary 322 while providing a gas seal to insure that all gas flow passing through capillary bore 338 also passes through multipole ion guide channel 320. The offset potential applied to ion guide electrodes 310A, 310B, 311A and 311B is maintained close to or equal to the DC voltage applied to capillary entrance electrode 323. By maintaining a neutral DC electric field in entrance region of capillary 322, ion movement into capillary bore 338 is driven primarily by gas dynamics and not electric fields that, when present, can direct ions to impinge on capillary entrance electrode 323.

The embodiment of the invention shown in FIG. 18 combines DC and RF fields with gas dynamics forces to improve ion transmission from atmospheric pressure ion sources into vacuum. The RF fringing fields generated at the entrance end of multipole ion guide 308, configured in RF surface assembly 300, provides a repelling force to prevent ions from impinging on multipole ion guide 308 electrodes operating at or near atmospheric pressure in atmospheric pressure ion source 348. Multiple electrostatic front electrodes 330 and 331, configured with small separating gap 339, and front electrode 332 are configured to provide maximum focusing of ions from a large gas volume toward center of RF surface 344. A weak electric field is maintained between DC electrode 332 and the offset potentials applied to RF electrodes comprising RF surface assembly 300 to minimize the electrostatic force driving ions onto the RF electrodes. Collisional damping of ion motion at atmospheric pressure reduces the near field RF repelling force generated by the RF electrodes. The RF and DC offset voltages applied to RF electrodes comprising RF surface 344 and the DC voltages applied to surrounding DC electrodes are set to provide a balance of electric field strength and gas dynamics to maximize ion transmission efficiency into and through ion guide 308. RF voltage applied to RF electrodes including 310 and 302 and multipole ion guide electrodes 310A, 310B, 311A and 311B provides sufficient repelling force to compensate for the ion defocusing forces occurring in the weak electrostatic fields as ions approach centerline 321 of RF surface 344. Focusing ions in DC only fields toward a DC capillary entrance electrode results in a substantial loss of ion current on the capillary entrance electrode Near the capillary entrance, strong focusing electric DC only fields drive the ions to the face and edge of the capillary entrance electrode overcoming the gas flow forces sweeping into the capillary orifice into vacuum A weak DC only focusing electric field in an atmospheric pressure ion source fails to focus ions effectively to the centerline reducing ion current entering a capillary orifice into vacuum. Multipole ion guide 308 forms an effective ion transport device at atmospheric pressure bridging a strong DC focusing electric far field with a minimum or zero DC field at the capillary entrance electrode allowing gas dynamics to provide the dominate force sweeping ions into bore 338 of capillary 322. The near RF field generated by RF electrodes comprising RF surface assembly 300 prevents ions from impinging on electrode surfaces when defocusing occurs in weak DC fields maintained near RF surface 344.

Referring to FIG. 19, atmospheric pressure MALDI ion source 374 comprises MALDI target 358 with sample 359, RF surface assembly 300 and front DC electrodes 352 and 353. Laser beam 362 is directed to impinge on sample 359 positioned on MALDI target 358 using mirror 363. Ions 360 produced by a laser pulse are focused toward ion source centerline 375 and directed toward RF surface 344 by DC fields depicted for illustration by lines 354 and 355. Ions following trajectories 361 moving toward RF surface 344 are driven by DC electrostatic fields against countercurrent gas flow 333. As ions 360 approach RF surface 344 their trajectories are controlled by a balance of back electrode repelling DC fields penetrating through gaps between RF electrodes, repelling near RF electric fields, attracting DC offset potentials, gas dynamics and forward DC fields imposed by DC voltages applied to front electrodes 352, 353 and MALDI target 358. Ions directed toward centerline 375 of RF surface 344 are swept into and through multipole ion guide 308 by gas flow 334. Ions 377 exiting ion guide 308 are swept into and through capillary bore 338 by the same gas flow 334. RF surface assembly 300 can be configured with alternative ion guide geometries and different orifices into vacuum. Orifices into vacuum can be configured as but not limited to dielectric capillaries, heated conductive capillaries, sharp edged orifices, nozzles or other orifice shapes known in the art. RF surface assembly 300 may comprise alternative RF electrode shapes including but not limited to grids and points, linear, point or spherical electrodes arranged in patterns that accommodate specific ion guide geometries. Ion guide 308 may be configured as a quadrupole, hexapole, octapole or an guide with a higher number of poles. Ion guide electrode cross section shapes may be round, flat or hyperbolic. Alternatively, Ion guide 308 may be configured with sequential RF disks. The electrodes or poles comprising multipole ion guide 308 may be segmented along the length of ion guide 308 with different DC offset potentials applied to different ion guide segments. The ability to apply multiple DC offset potentials to ion guide 308 electrodes provides additional control to move ions through the length of segmented ion guide 308 or to trap ions in guide 308 during ion source operation. Segmented ion guide 308 can be operated as an ion mobility separation device in atmospheric pressure MALDI ion source 374 to provide separation of ions by ion mobility prior to mass to charge analysis.

RF surface assemblies comprising multipole or sequential disk ion guides and front and back DC electrodes can be configured and operated in vacuum to improve ion transmission efficiency through vacuum stages and through partitions between vacuum pumping stages. Multipole ion guides, configured according to the invention, extend through vacuum partitions providing an efficient ion tunnel or conduit while minimizing neutral gas conductance. Multipole ion guides configured according to the invention, serve both as RF surfaces and ion guides extending into multiple vacuum stages. Ion guides may be configured with one or more ion tunnel or conduit sections and multiple open vacuum pumping sections where neutral gas is pumped away through gaps between ion guide electrodes. Ion guides operated in vacuum may comprise segments with different offset potentials applied to different segments along the ion guide length. Ion guides configured according to the invention, can be operated to provide mass to charge selection or isolation, CID fragmentation, ion-neutral and ion-ion reaction regions, ion mobility separation and/or ion trapping and release functions.

Figure 22:
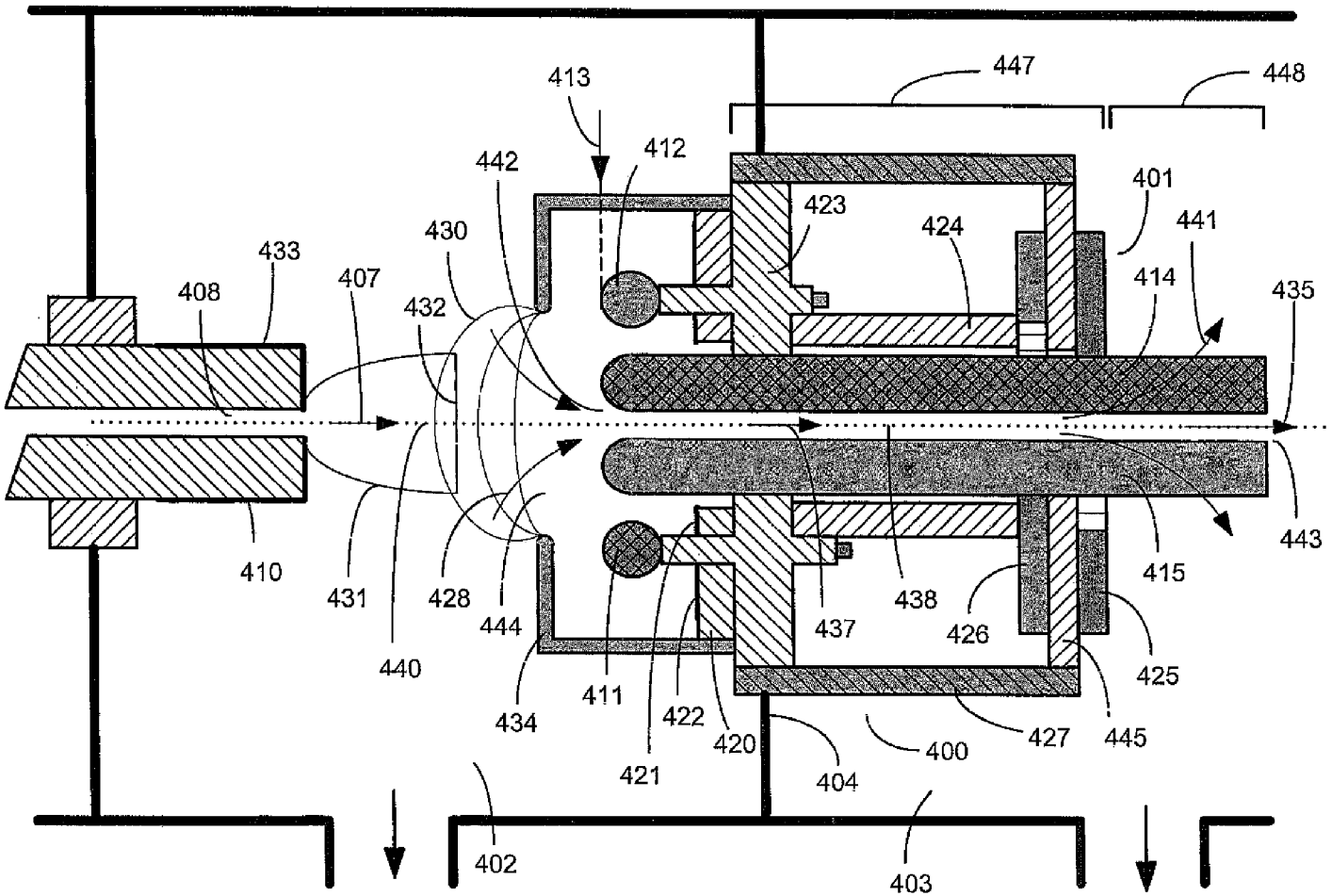
FIG. 22 is a cross section side view of a spherical electrode RF surface comprising a multipole ion guide and an ion tunnel section extending from a first vacuum pumping stage into a second vacuum pumping stage.

RF surface assembly 400 comprising multipole ion guide assembly 401 is configured to transfer ions from vacuum stage 402 into vacuum stage 403 through vacuum partition 404 as diagrammed in FIG. 22, Opposite Phase RF voltage is applied to adjacent electrodes on RF surface 413 as previously described, Spherical RF electrodes 411 and 412 held in position by insulator 423 form RF surface 412 with Multipole ion guide electrode 414 and 415. Entrance end 442 of multipole ion guide extends into vacuum pumping stage 402 and ion guide exit end extends into vacuum pumping stage 443. Back electrodes 421 and 422 are configured on the top surface of circuit board 420, Repelling electrical potentials are applied to back electrodes 421 and 422 to move ions above RF surface and toward centerline 440 where they enter ion guide channel 438. Repelling potentials applied to back electrodes 421 and 422 prevent ions from remaining trapped in the RF pseudo potential wells formed between RF spherical and multiple ion guide electrode sets. Neutral gas flowing from an atmospheric pressure ion source axis bore 408 of capillary 410 as a free jet expansion into vacuum stage 402 forming barrel shock 431 and normal shock 432 as is known in the art. The size of barrel shock and the position of normal shock 432 along axis 440 are determined by the background vacuum pressure maintained in vacuum stage 402. Capillary 410 is positioned in vacuum stage 402 so that normal shock 432 occurs in just outside of opening 444 of DC electrode 434 tons 407 exiting capillary bore 408 are swept along by the neutral carrier gas and the DC electric fields formed by DC electrical potentials applied to capillary exit electrode 433 and electrode 434 and the offset potential applied to RF electrodes comprising RF surface 413. Ions passing through normal shock 432 continue to move through subsonic neutral gas flow and are focused toward centerline 440 by and the entrance end 442 of ion guide assembly 401 by DC electric fields depicted approximately by lines 430. Background neutral gas flow 428 flowing through ion guide channel 438 into vacuum pumping stage 403 provides additional force in moving ions 407 into ion guide channel 438. As ions approach RF surface 413 the near RF repelling field and the back electrode DC repelling fields penetrating through gaps between RF electrodes prevent ions from hitting RF electrodes. Ions moving toward RF surface 413 are focused toward centerline 407 due to DC fields 430 and gas flow 428 with translational energy damping due to collisions with background gas. Ions entering channel 438 of multipole ion guide 401 are trapped in the radial direction by the RF voltage applied to multipole electrodes 414 and 415. Gas flow through channel 438 moves radially trapped ions 437 through the length of ion guide 401 exiting in vacuum pumping stage 403 at ion guide exit end 443.

Multipole ion guide subassembly 401, configured in RF surface assembly 400, forms a conduit or channel through vacuum stage partition 404 that minimizes the conductance of neutral gas from vacuum pumping stage 402 to vacuum pumping stage 403 while maximizing ion transport efficiency. Ion guide mounting electrodes 425 and 426 separated by insulator 334 form electrical and mechanical connections to ion guide electrodes 414 and 415 while minimizing the cross sectional area through multipole ion guide 401. Insulators 423 and 445 form a vacuum seal with mounting element 427 preventing gas flow around ion guide 401. Tube element 424 decreases the gas volume surrounding ion guide electrodes 413 and 414 minimizing neutral gas exchange through gaps between ion guide 401 electrodes along length 447 of ion guide 40 between insulator 404 and mounting electrode 425. Gas flow around ion guide electrodes 414 and 415 is prevented or minimized by insulator 423 and mounting electrodes 425 and 426 with insulator 445. Gas exchange through gaps between ion guide electrodes 415 and 416 is minimized by tube element 425 along ion guide section 447. This combination creates a gas flow conduit through channel 438 of ion guide assembly 401 extending the length of ion guide section 447 through which a gas pressure drop occurs in gas flowing between vacuum stages 402 and 403. Neutral gas conductance decreases with increasing conduit section length 447 in ion guide 104 with no loss in ion transfer efficiency though ion guide 401. Longer ion guide conduit section lengths 447 provide higher resistance to gas flow between vacuum pumping stages. This results in lower downstream vacuum pressures for the same vacuum pumping speed or allows the reduction of vacuum pumping speed, vacuum pump size and cost. Alternatively, ion tunnel or conduit sections configured in multipole ion guides extending into multiple vacuum stages allows larger ion guide sizes, for a given vacuum pumping speed, increasing the ion transfer efficiency and ion trapping volume. Ion guide assembly 401 also comprises non conduit or open section 448 along which neutral gas 441 can be pumped away through gaps in ion guide electrodes 414 and 415 while ions remain radially trapped until exiting ion guide exit end 443 at 435.

Ion guide assembly 401 configured in RF surface assembly 400 serves itself a portion of the RF surface for efficiently transferring ions into channel 438 of ion guide 401. Multipole ion guide also provides the functions of efficiently transferring ions from vacuum stage 402 to vacuum stage 403 and trapping ions radially during collisional cooling of ions being transported through the length of ion guide 401. A mono velocity ion beam exiting capillary bore 408 is converted to a mono energetic ion beam in ion guide 401 with exiting ions 435 having an average energy equal to the offset potential of ion guide 401 and a narrow energy spread. Ion guide 401 configured as a quadrupole forms a parabolic energy well in channel 438 that focuses ions to centerline 407 as collisional cooling of ion translation energies occurs. Ion focusing along centerline 407 due to collisional cooling provides a narrow cross section ion beam 435 with low energy spread exiting ion guide 401 at ion guide exit end 443. Channel 438 formed by ion guide 401 serves as the neutral gas conductance conduit from vacuum stage 402 through 403. The length to equivalent diameter ratio of conduit or ion tunnel section 447 of ion guide 401 can range from 2 to 10 to over 100 with longer length to diameter rations providing decreased neutral gas flow for the same upstream vacuum pressure. In alternative embodiments of the invention, ion guide 401 can be configured with segments along its length to move ions selectively along the length of ion guide 401 controlled by axial DC fields. In applications where ions need only be focused from a small cross sectional area into a multipole ion guide, a minimum size RF surface can be configured using only the ion guide electrodes.

Figure 23:
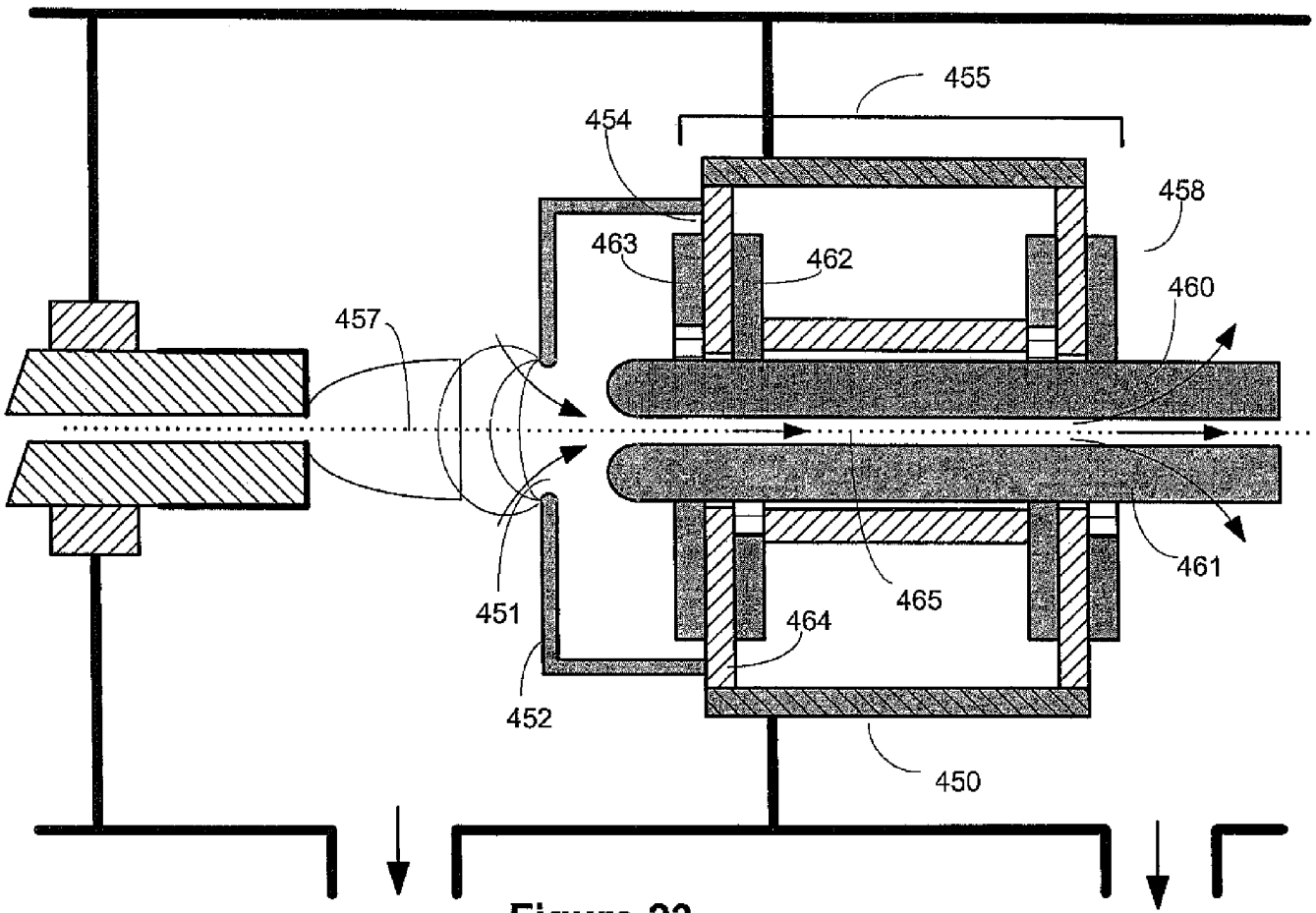
FIG. 23 is a cross section side view of a four electrode RF surface comprising a multipole ion guide and an ion tunnel section extending from a first vacuum pumping stage into a second vacuum pumping stage.

An alternative embodiment to the invention is diagrammed in FIG. 23 wherein multipole ion RF surface and multipole ion guide assembly 450 is configured to replace RF surface assembly 400 shown in FIG. 22, Opening 451 through DC electrode 452 is reduced to sharpen ion focusing towards centerline 457 with reduced DC voltage differentials applied between electrode 452 and the offset potential applied to ion guide 458 electrodes 460 and 461. The length of ion funnel or conduit section 455 of ion guide assembly 458 has been increased and RF electrode insulator 423 has been replaced by mounting electrode 462 and 463 with insulator 464 assembly. Dual mounting electrode sets configured along the length of ion guide assembly 458 strengthens the assembly while further reducing effective cross section area of internal channel 465. Ion guide assembly 458 provides identical functions as described for ion guide assembly 401 described above at reduced size, cost and complexity of operation Larger RF surface and ion guide assembly 400 shown in FIG. 22 can focus ions into ion guide 401 from a larger cross sectional area. When ion populations are constrained to smaller sampling cross sections, ion guide assembly 458 may be preferred to reduce cost and complexity without reducing ion transmission performance. Embodiments of RF surfaces comprising ion guides can be configured to provide maximize performance for specific applications or instrument types while reducing overall instrument cost and complexity.

Figure 24:
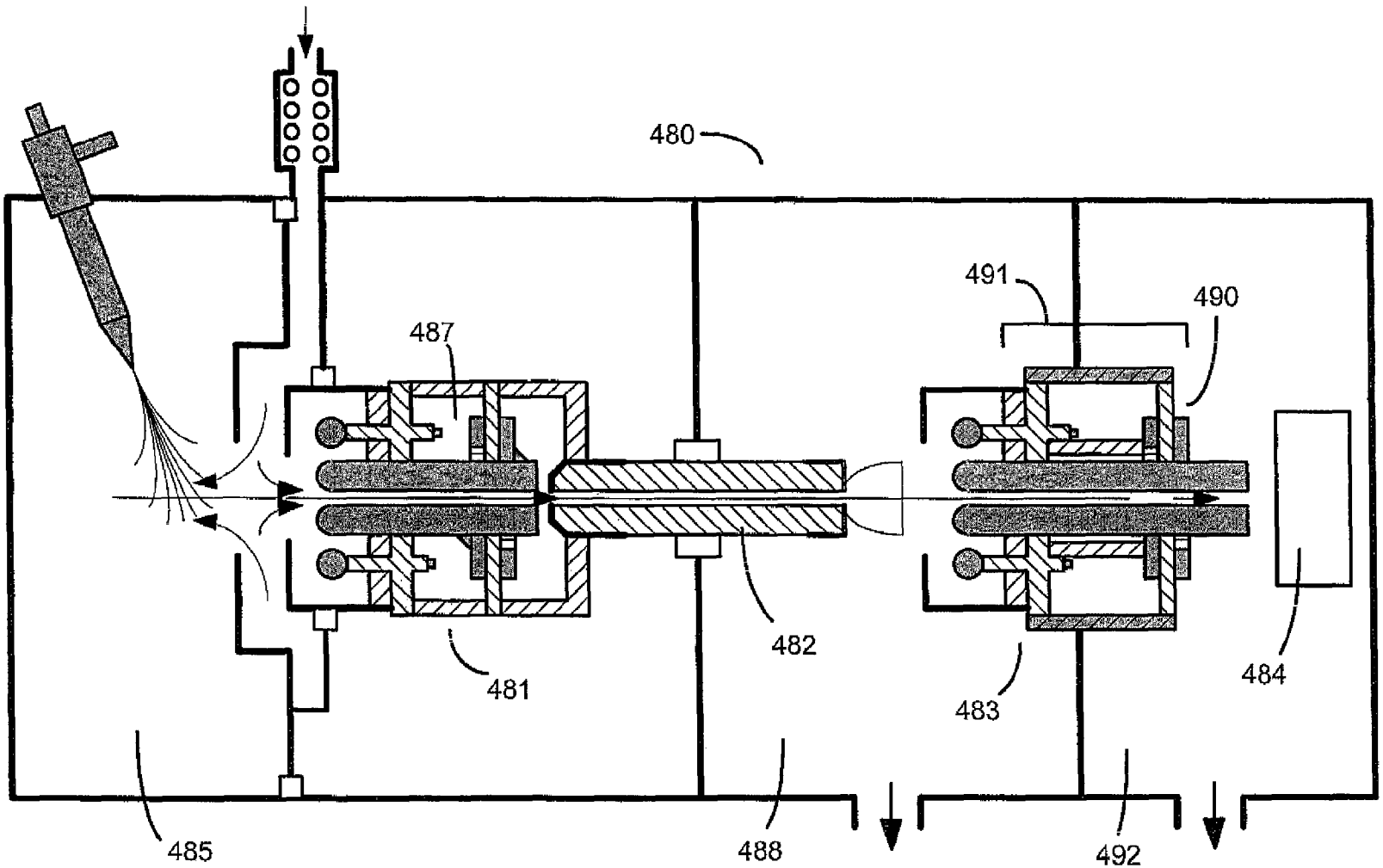
FIG. 24 is a cross section side view diagram of an Electrospray ion source interfaced to a mass to charge analyzer comprising multiple RF surfaces incorporating a multipole ion guides configured in the ion path from atmospheric pressure through multiple vacuum stages.
Figure 25:
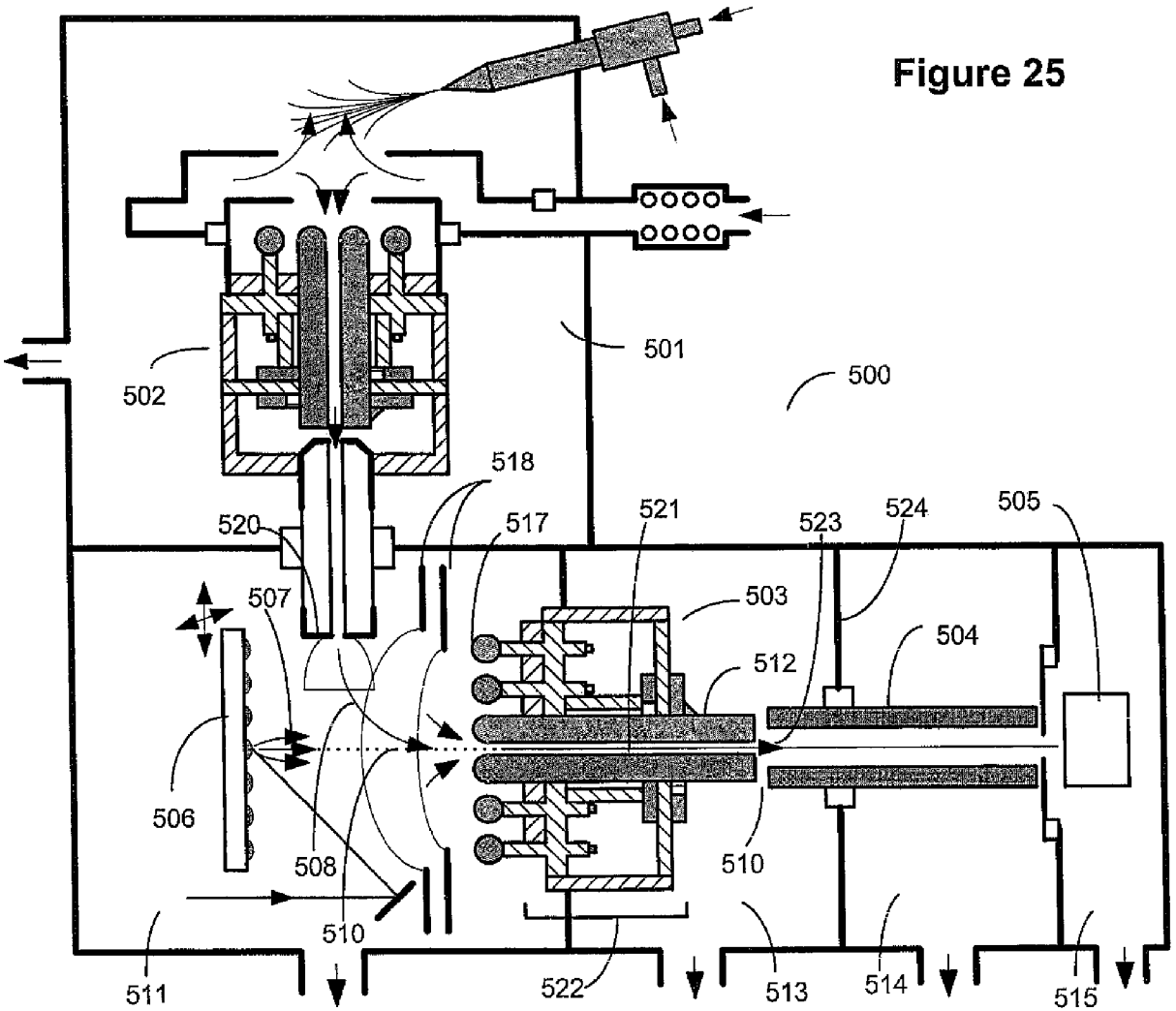
FIG. 25 is a cross section side view diagram of an Electrospray ion source and an intermediate MALDI source interfaced to a mass to charge analyzer comprising multiple RF surfaces incorporating ion guides.

Multiple RF surfaces comprising ion guides can be configured in mass spectrometer instruments to provide optimal analytical performance, Electrospray ion source mass analyzer 480 diagrammed in FIG. 24 comprises Electrospray ion source 485, RF surface ion guide assembly 481 operating at atmospheric pressure, dielectric capillary 482, vacuum RF surface and ion guide assembly 483 and mass analyzer 484 RF surface assembly 481 comprising ion guide assembly 487 provides improved ion transport efficiency from ES source 485 into first vacuum pumping stage 488. RF surface assembly 483 comprising ion guide assembly 490 with ion tunnel or conduit section 491 provides increased ion transfer efficiency from first vacuum stage 488 into second vacuum stage 492. Ions traversing the length of ion guide 490 undergo collisional damping of kinetic energy reducing ion energy spread focusing ions toward the centerline of ion guide 490. Decreasing the cross section and energy spread of the ion beam exiting ion guide 490 improves the performance of down stream ion beam transmission, ion manipulation, ion focusing and mass to charge analysis functions.

Alternative combinations of ion sources and mass to charge analyzers can be configured using RF surfaces comprising ion guides. Atmospheric pressure ion source comprising 501 comprising RF surface and ion guide assembly 502 delivers ions to first vacuum pumping stage 511 in a direction orthogonal to centerline 510 of hybrid mass to charge analyzer 500. MALDI sample target 506 is configured in first vacuum stage 511 positioned orthogonal to centerline 510 RF surface assembly 503 comprising ion guide assembly 512 is configured to transfer ions entering first vacuum stage 511 into second vacuum stage 513. Ions 508 exiting Electrospray ion source 501 are directed toward RF surface 517 and focused to centerline 510 by electrostatic fields maintained in first vacuum chamber 511. The same electrostatic fields direct MALDI generated ions 507 toward RF surface 517 while focusing ions 507 toward centerline 510. Electrospray ion source 501 and MALDI ion generation can occur separately or simultaneously during mass to charge analysis. One source of ions may be used as calibration ions for the second source of ions during mass to charge analysis. Voltages applied to DC electrodes 518, capillary exit electrode 520, MALDI sample target 506 and the RF and back electrodes, comprising RF surface 517, direct ions into channel 521 of ion guide 512. Gas flowing from first vacuum stage 511 into second vacuum stage 513, through ion tunnel or conduit section 522 of ion guide 512, moves ions through ion guide 512. Ions 53 exiting ion guide 512 are directed into ion guide 504 by a difference in offset potentials applied to each ion guide. Typically the background vacuum pressure in second vacuum stage 513 is maintained above $1\times10^{-4}$ torr so that ions accelerated from ion guide 512 into ion guide 504 with sufficient acceleration energy undergo collision induced dissociation CID in guide 504. Alternatively, ions can be transferred from on guide 512 into ion guide 504 at lower axial acceleration energy to avoid CID fragmentation of ions. Ion guide 504 extends into second and third vacuum pumping stages 513 and 514 respectively transferring ions through vacuum partition 524. Ion guide 504 may be operated in single pass or ion trapping and release mode. Parent ions and/or fragment ions traversing or trapped in ion guide 504 undergo collisional cooling of translational energies prior to exiting ion guide 505. Ion guide 504 can be operated in mass to charge selection or isolation, ion fragmentation, MS/MS or MS" mode followed by mass to charge analysis in vacuum fourth vacuum stage 515. Ions exiting ion guide 504 are mass to charge analyzed by mass to charge analyzer 505. Mass to charge analyzer 505 may comprise but is not limited to TOF, quadrupole, triple quadrupole, magnetic sector, three dimensional ion trap, linear ion trap FTMS or orbitrap mass to charge analyzers.

Figure 26:
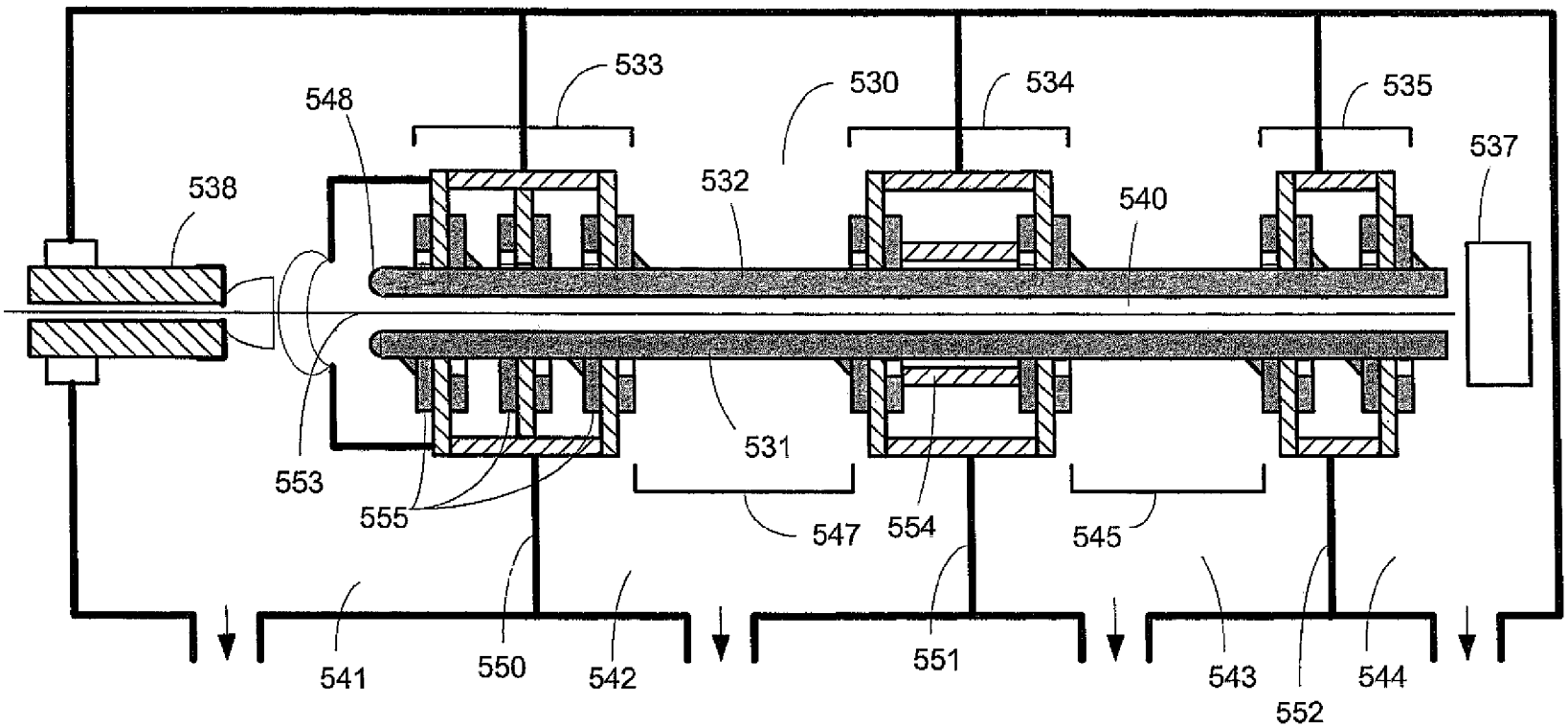
FIG. 26 is a cross section side view diagram of a multipole ion guide extending into four vacuum pumping stages comprising an RF surface, three ion tunnel or conduit sections and two open vacuum pumping sections configured in a mass to charge analyzer.

Multipole ion guides comprising RF surfaces and multiple ion tunnel sections can be configured to extend through multiple sequential vacuum stages improving ion transmission while reducing gas conductance between vacuum pumping stages. A cross section side view diagram of multipole ion guide assembly 530 configured to extend into four vacuum stages is shown in FIG. 26. Multipole ion guide assembly 530 comprises RF surface 548, electrodes 531 and 532, first, second and third ion tunnel sections 533, 534 and 535 respectively and open pumping sections 547 and 543. Ions exiting capillary 538 are directed into center channel 540 of ion guide 534 as previously described. Ions are directed through the length of ion guide by gas flow passing into sequential vacuum pumping stages. Ions entering ion guide center channel 540 at entrance end 553, positioned in first vacuum chamber 541, pass through ion tunnel section 533 and move into second vacuum pumping stage 542. Ions remain trapped in the radial direction as they traverse the length of ion guide 530 passing through second and third vacuum stages 542 and 543 respectively. Ions exit in fourth vacuum stage 544 where they are subjected to further manipulation and/or mass to charge analyzed in mass to charge analyzer 537. Ion tunnel or conduit section 533 comprises three mounting electrode and insulator assemblies 555 configured to minimize the effective neutral gas flow cross section through ion tunnel section 533. The configuration of ion tunnel section 533 minimizes space charge buildup on insulators external to ion guide center channel 540 and reduces neutral gas flow through vacuum partition 550. Alternatively, ion tunnel or conduit section 534 comprises two mounting electrode and insulator assemblies and tube element 554 to minimize neutral gas conductance through vacuum partition 551. Ion tunnel section 535 comprises two mounting electrode and insulator assemblies to reduce neutral gas conductance through vacuum partition 551. A portion of the neutral gas flow passing through ion tunnel sections 532 and 534 passes through gaps between electrodes 531 and 532 and is pumped away along ion guide sections 547 and 545 respectively.

Figure 27A:
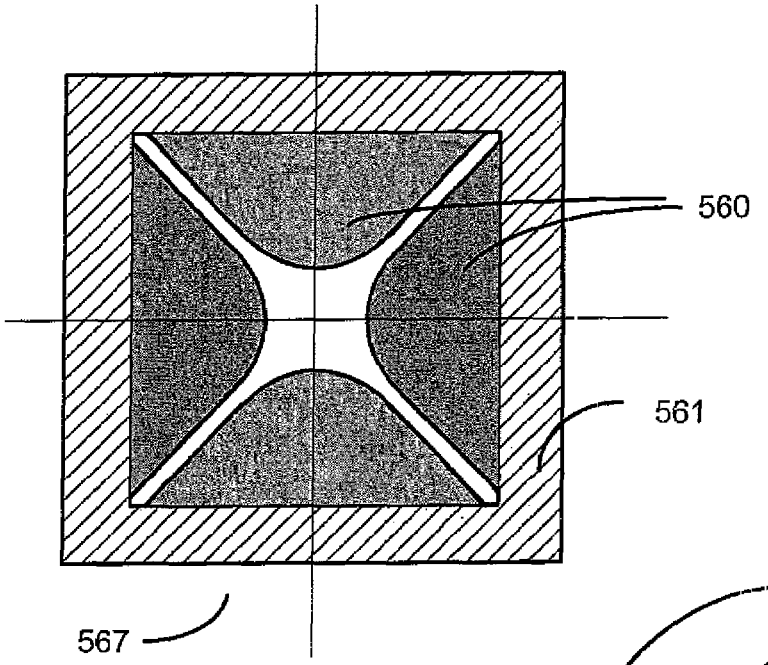
FIG. 27A is an end view section of a quadrupole ion guide conduit region configured with hyperbolic ion guide electrodes.
Figure 27B:
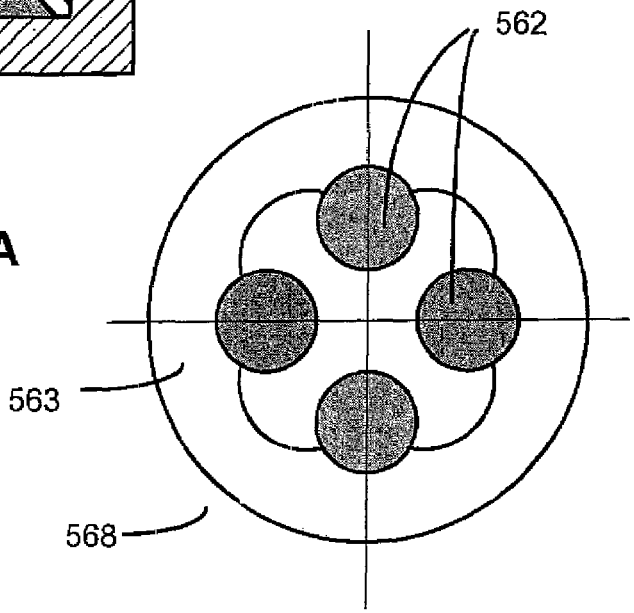
FIG. 27B is an end view section of a hexapole ion guide conduit region configured with round ion guide electrodes.
Figure 27C:
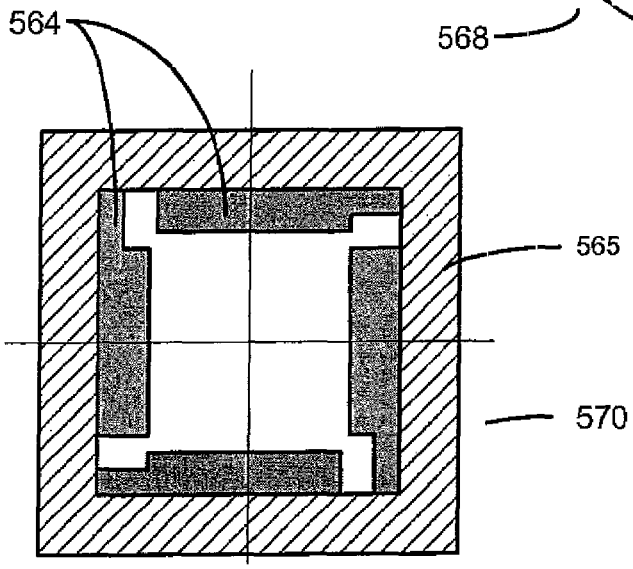
FIG. 27C is an end view section of a quadrupole multiple ion guide conduit region configured with flat ion guide electrodes

Multipole ion guides may be configured with different pole shapes and mounting electrode and insulating elements. Three alternative electrode shapes with insulating elements comprised in ion tunnel sections are diagrammed in FIG. 27. Quadrupole ion guide assembly 567 shown in FIG. 27A comprises electrodes 560 with hyperbolic cross section shapes and square insulator 561 to minimize gas neutral gas flow through ion tunnel or conduit sections Quadrupole ion guide assembly 568 shown in FIG. 27B comprises round cross section electrodes with insulator 563 shaped to minimize gas flow through ion conduit sections. Square quadrupole ion guide 570 shown in FIG. 27C comprises flat electrodes 564 and square insulator 565 to minimize gas flow through conduit sections. Of the three embodiments diagrammed in FIG. 27 round rod quadrupole 568 provides higher gas flow between rods for more efficient vacuum pumping of neutral gas in open ion guide sections. Where open sections are not required along multipole ion guide lengths, the hyperbolic or flat electrode shapes may provide maximum ion transmission while minimizing neutral gas conductance between vacuum pumping stages. The diameter of circle drawn inside and just intersecting the quadrupole electrodes diagrammed in FIG. 27 defines the inner diameter of the center channel of multipole ion guide. The length of ion tunnel sections between vacuum pumping sections extend at least two inner diameters in length and may be configured to extend over tens or hundreds of diameter lengths. As will be described below, long ion guides may comprise sections with different offset potentials applied to aid in controlling ion motion longitudinally along the ion guide length.

Figures 28A, 28B:
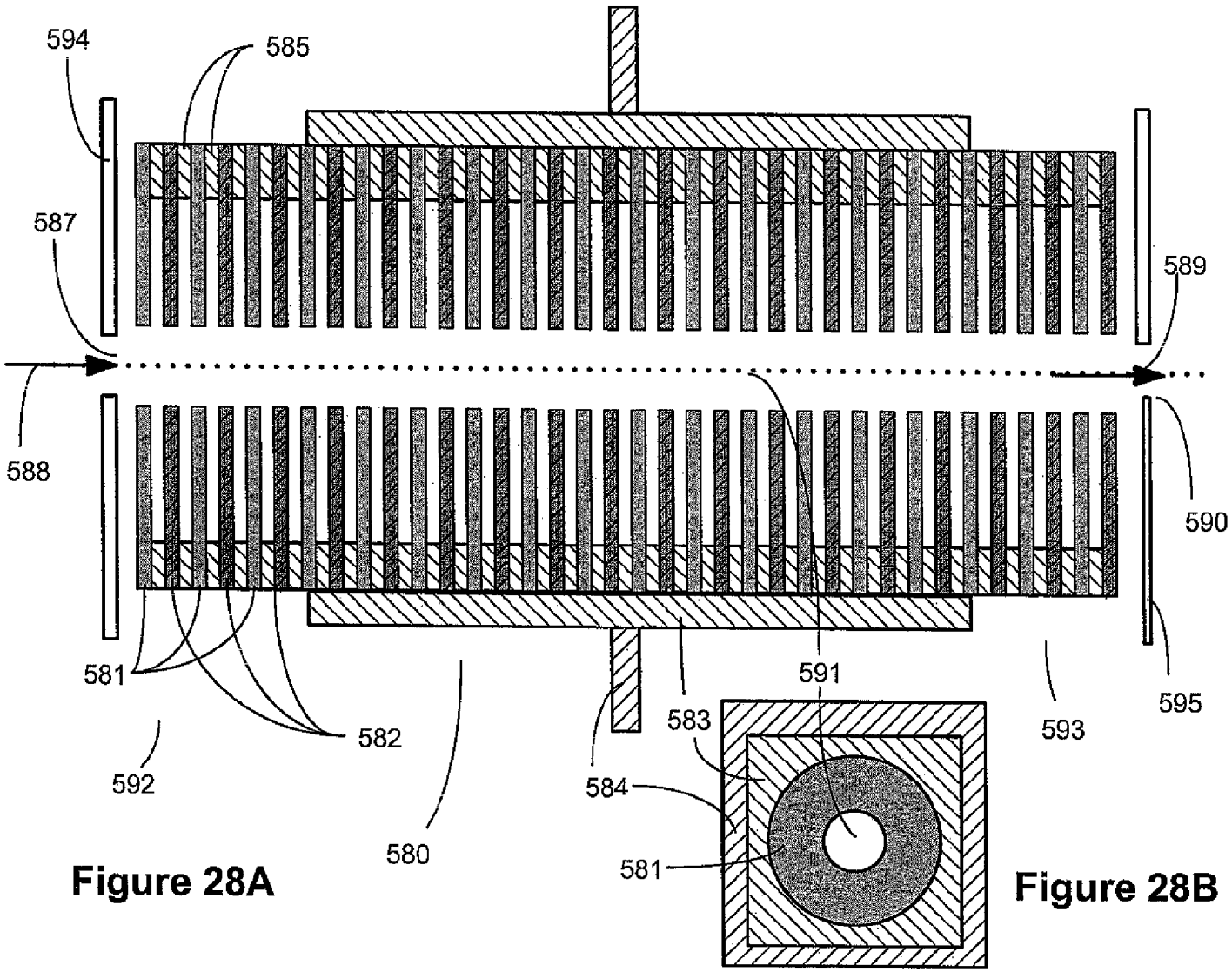
FIG. 28 is a die view cross section of an RF disk electrode multipole ion guide configured as an ion tunnel or conduit between two vacuum pumping stages

Ion guides extending into multiple vacuum pumping stages comprising ion tunnel sections can be configured as multipole or sequential RF disk ion guides. Multipole ion guides can be configured as quadrupole, hexapole, octopoles or ion guides with more than eight poles. One embodiment of a sequential RF disk ion guide comprising an ion tunnel or conduit section configured to mount through a vacuum pumping stage partition is diagrammed in FIG. 28. A side cross section view of sequential disk ion guide 580 is diagrammed in FIG. 28A with an end view diagrammed in FIG. 28 B Sequential disk ion guide assembly 580 comprises sequential disks 581 and 582 where RF voltage of opposite phase but equal amplitude and phase is applied to adjacent disks DC electrodes 594 and 595 are positioned at entrance 587 and exit 590 ends respectively of sequential RF disk ion guide 580 to shield the RF voltage fields produced by the first 581 and last RF disk electrodes., DC voltages are applied to DC electrode 594 to aid in focusing ions into channel 591 of sequential disk ion guide 580. Common DC offset voltage can be applied to sequential disks along the length of sequential disk ion guide 580. Alternatively, different DC offset voltages can be applied to different RF disks along the length of sequential disk ion guide 580 to control movement of ions in the axial direction of ion guide 580. Sequential disk ion guide 580 can be configured in vacuum pumping stages where multiple collisions between ions and neutral gas occur as ions traverse the length of ion guide A moving DC offset waveform or "T" wave can be applied sequentially to RF disk electrodes to move ions progressively through ion guide 580 effecting ion mobility separation of species in the ion population through ion collisions with neutral background gas as is known in the art. Ions can be trapped in or moved through ion guide 580 by applying different DC offset voltages potentials or DC offset voltage gradients to different RF disk electrodes. Ions can be accelerated through ion guide channel 591 with steeper DC offset voltage gradients applied to cause ion CID fragmentation.

Insulating disks 585 configured between RF disks electrodes 581 and 582 along the length of ion guide 580 provide a mechanical spacer and electrically insulating function between RF disk electrodes. Insulating disks 585 also prevent neutral gas flowing through center channel 591 from exiting through the gaps between the RF disk electrodes. Sequential disk ion guide 580 extends from vacuum pumping stage 592 to downstream vacuum pumping stage 593 through vacuum stage partition 584. Ions 588 entering ion guide entrance 587 in vacuum stage 592 transverse the length of ion guide 580 through ion guide center channel 591 and exit at ion guide exit 589 in vacuum pumping stage 593. The length to diameter ratio of ion guide center channel 591 exceeds a ration of 2 to 1 forming an ion tunnel or conduit to transportions efficiently through vacuum partition 580 while reducing neutral gas conductance between vacuum pumping stages 592 and 593. Sequential disk ion guide 580, configured as an ion tunnel between vacuum pumping stages, provides the multiple functions of transferring ions through vacuum stage partitions with collisional cooling of ion kinetic energies and reducing neutral gas conductance between vacuum pumping stages 1*n* addition sequential disk ion guide 580 can be operated to conduct ion trapping and release, ion mobility and ion CID fragmentation functions for ion populations traversing the length of center channel 591 of sequential disk ion guide 580. Sequential disk ion guides can be configured to extend into multiple vacuum system comprising one or more ion tunnel sections and one or more open pumping sections Neutral gas pumping can be achieved in sections of sequential disk ion guide 580 by configuring spacers 585 with radial slots or gaps to allow passage of neutral gas through the gaps between adjacent RF disk electrodes.

Figure 29:
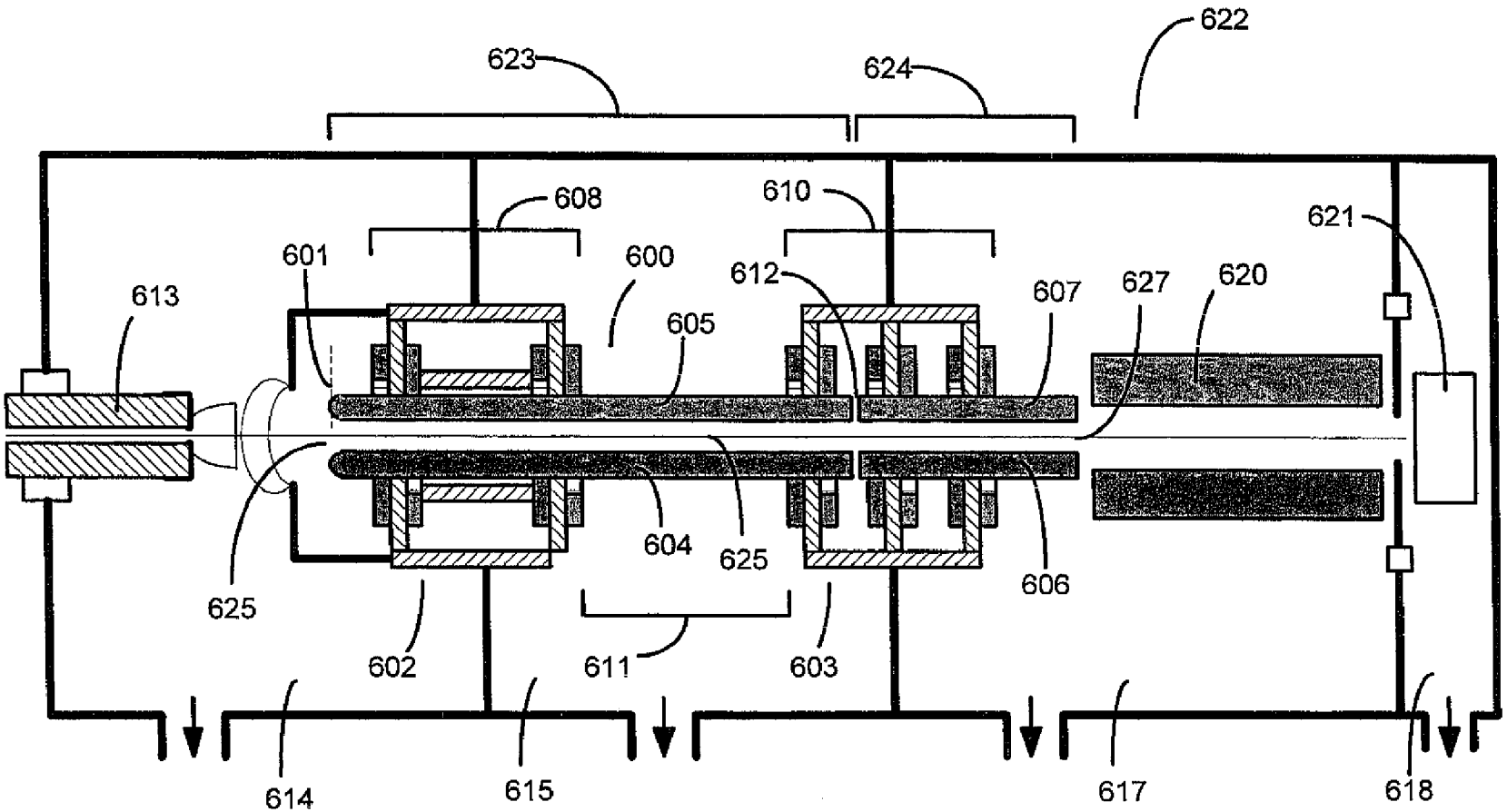
FIG. 29 is a cross section side view of a segmented multipole ion guide configured with two conduit sections interfaced to a larger cross section ion guide.

Multipole ion guides comprising RF surfaces and one or more ion tunnel sections can be segmented with different DC offset voltages applied to different segments to control ion motion in the axial direction along the ion guide length. A cross section side view of segmented multipole ion guide assembly 600 is diagrammed in FIG. 29. Ion guide 600 comprises RF surface 601, first ion tunnel section 608, first multipole segment 623, second multipole segment 624, open pumping section 611 and second ion tunnel section 610. Entrance end 625 of segmented multipole ion guide assembly 600 is positioned in first vacuum pumping stage 614. Multipole ion guide assembly 600 extends through second vacuum pumping stage 615 with exit end 627 positioned in third vacuum pumping stage 617. First multipole ion guide segment 623, comprises electrodes 604 and 605, first ion tunnel section 608 configured to transfer ions between vacuum pumping stages 614 and 615, open vacuum pumping section 611 in vacuum pumping stage 615 and a portion of second ion tunnel section 610. Second multipole ion guide segment 624 comprises electrodes 606 and 607 and a portion of second ion tunnel section configured to transfer ions between vacuum stages 615 and 617. In one embodiment of the invention, the same RF amplitude frequency and phase are applied to linearly aligned electrodes in first and second multipole ion guide segments 623 and 624 respectively. Different DC offset potentials can be applied to multipole ion guide segments 623 and 624 to control ion motion through multipole ion guide 600. In an alternative embodiment of the invention the same RF frequency and phase is applied to multipole ion guide segments 623 and 624 with the ability to apply different RF amplitudes.

Ions exiting capillary 613 are directed into center channel 625 of multipole ion guide 600. Ions move through the length of multipole ion guide segment 623 driven by gas flow from vacuum pumping stage 614 into vacuum pumping stage 615. Different DC offset potentials are applied to first and second multipole ion guide segments 623 and 624 respectively. In one operating mode, relative DC offset potentials are applied to ion guide segments 623 and 624 to move ions from first segment 623 into 624. In a second operating mode relative DC offset potentials are applied to ion guide segments 623 and 624 to trap ions in first segment 623. In a third operating mode, the DC offset potentials applied to ion guide segment 623 and multipole ion guide 620 are set at greater amplitude than the DC offset potential applied to ion guide segment 624, trapping ions in multipole ion guide segment 624. Ions can be accelerated from first segment 623 into second 624 with sufficient energy to cause ion CID fragmentation. Conversely, ions trapped in second segment 624 can be accelerated into first segment 623 to cause ion CID fragmentation. In the embodiment shown, gap 612 separating first segment 623 and second segment 624 is positioned in ion tunnel section 610. The kinetic energy of ions traversing multipole ion guide 600 is collisionally cooled reducing ion energy spread. Ions exiting multipole ion guide 600, pass into multipole ion guide 620 where they are transferred to mass to charge analyzer 621, positioned in vacuum pumping stage 618, with or without further ion manipulation in multipole ion guide 620. Segmented multipole ion guide assembly 600 can be configured with more than two and with breaks between segments positioned in different locations along multipole ion guide assembly 600.

Figure 30:
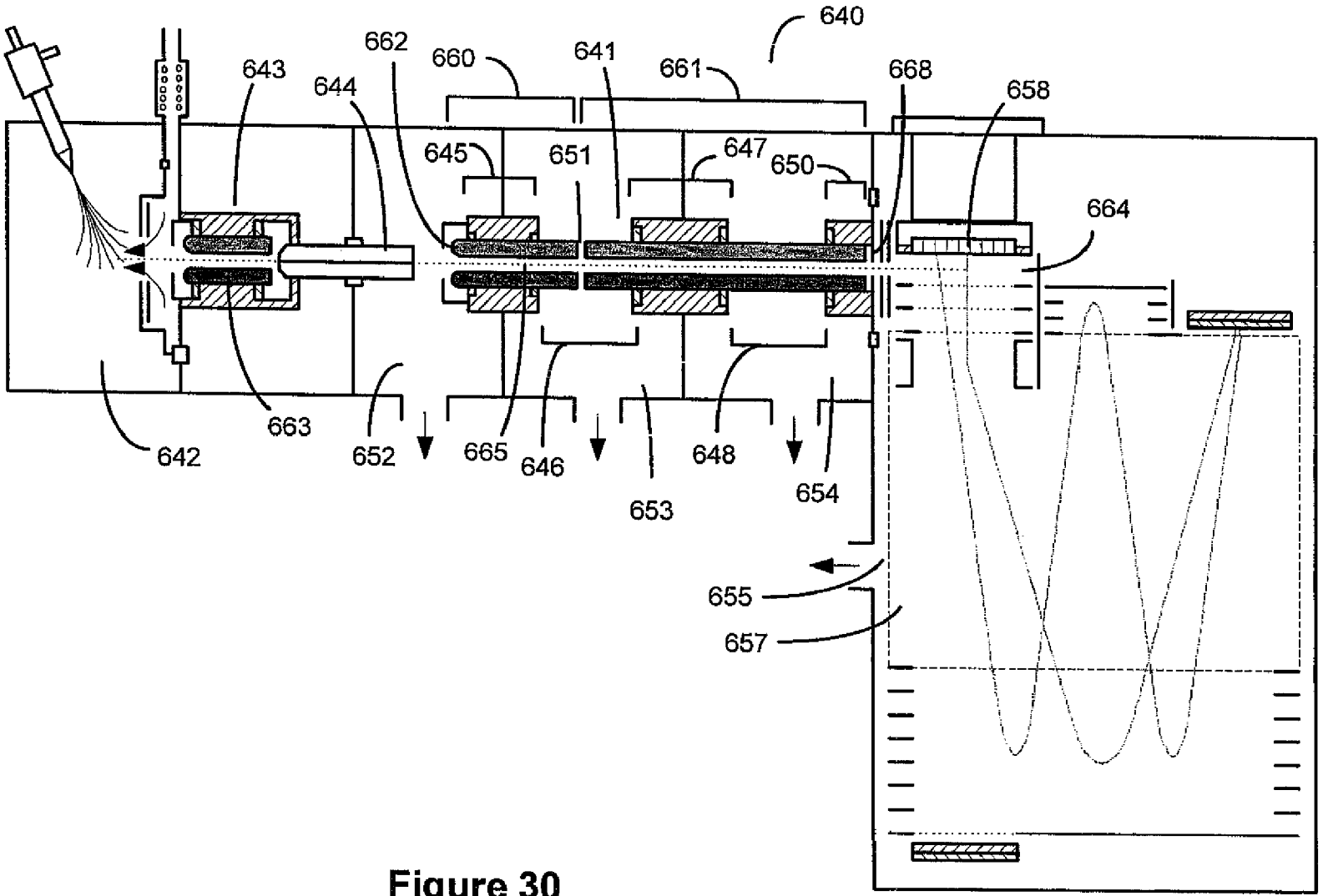
FIG. 30 is a cross section side view of a segmented multipole ion guide configured in an orthogonal pulsing TOF mass analyzer.

A cross section side view of hybrid multipole ion guide TOF mass to charge analyzer 640 comprising two segment multipole ion guide 641 is diagrammed in FIG. 30. Segmented multipole ion guide assembly 641 comprises RF surface 662, first segment 660, first ion tunnel section 645, first open vacuum pumping section 646, second segment 661, second ion tunnel 647, second open pumping section 648 and third ion tunnel 650. Hybrid multipole ion guide TOF mass to charge analyzer 640 comprises Electrospray ion source 642, atmospheric pressure RF surface assembly comprising ion guide assembly 663, capillary 644, segmented multipole ion guide assembly 641, RF surface 658 in TOF orthogonal pulsing region 664 and multipole ion reflector, multiple detector TOF flight tube 657. Two segment multipole ion guide assembly 641 extends from first vacuum pumping stage 652, through second vacuum pumping stage 653 and extends into third vacuum pumping stage 654. Ion tunnels or conduits 645, 647 and 650 reduce the neutral gas flow between vacuum stages while retaining high ion transfer efficiency Gap 651 separating first multipole ion guide segment 660 and second segment 640 is positioned in open vacuum pumping section 646 located in second vacuum stage 653. Common RF amplitude, frequency and phase is applied electrodes sequentially aligned in to both ion guide segments 660 and 661. Ions produced in Electrospray ion source 642 are directed through multipole ion guide 663 of RF surface assembly 643 and into the bore of capillary 644. Ions swept through the bore of capillary 643 exit in first vacuum stage 652 and are focused into center channel 655 of segmented multipole ion guide 641. Ions traversing through ion tunnel 645, configured along first ion guide segment 660, move into second ion guide segment 661 driven by a difference in DC offset potentials maintained between first and second ion guide segments 660 and 661 respectively. Ions can be accelerated from first ion guide segment 660 into second ion guide segment 661 with sufficient energy to cause ion CID fragmentation. Ions may be trapped in second ion guide segment 661 by raising the DC potential applied to ion guide exit electrode 668. The kinetic energy of ions traversing the length of second ion guide segment 661 in single pass or trap and release mode is collisionally cooled, reducing the energy spread the ion beam entering TOF pulsing region 664. Ions entering TOF pulsing region 664 may be trapped above RF surface 658 and subsequently accelerated into TOF flight tube 657 and mass to charge analyzed as described above TOF flight tube is configured in fourth vacuum pumping stage 657.

Figure 31:
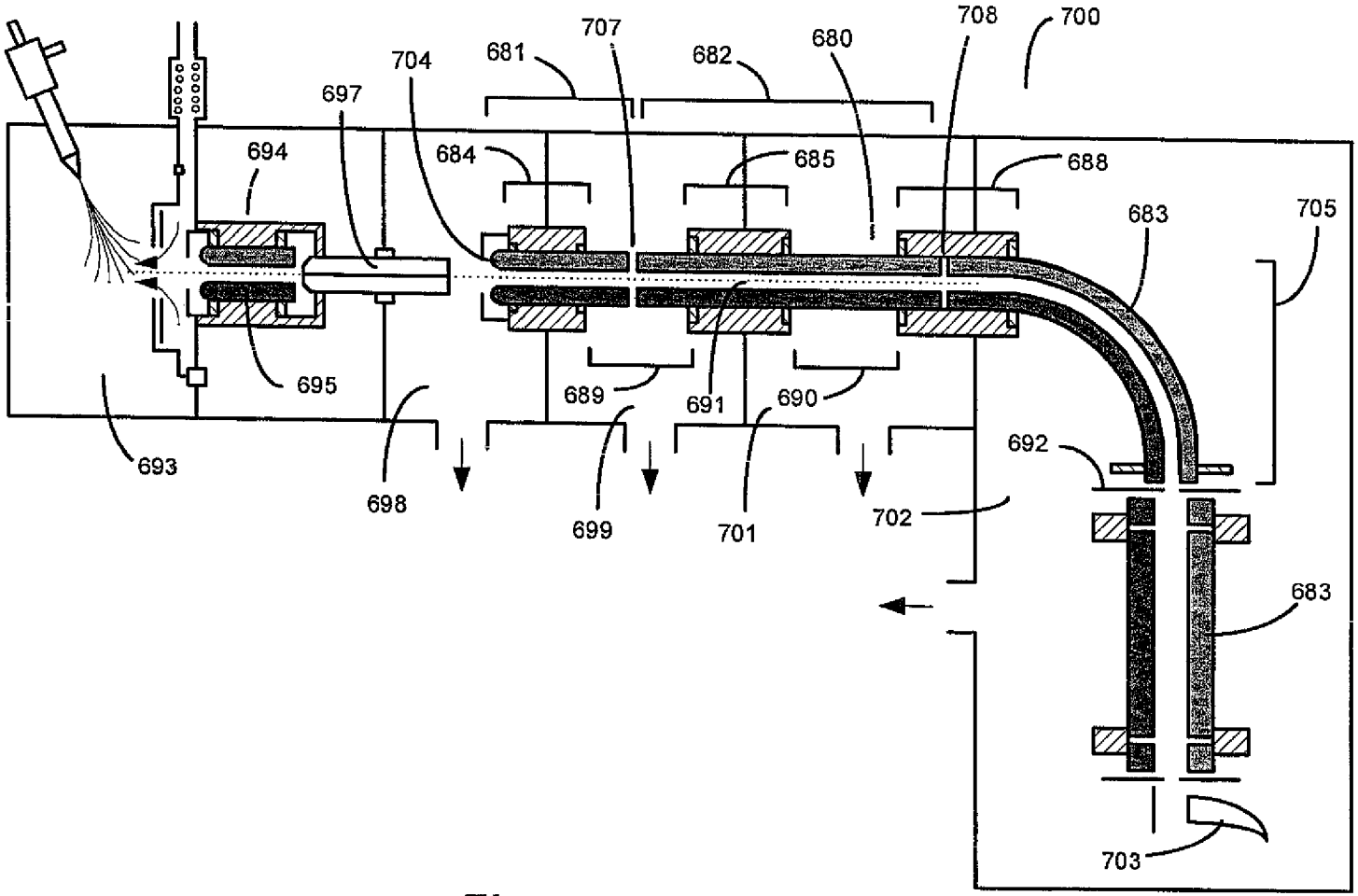
FIG. 31 is a cross section side view of a segmented multipole ion guide comprising a curved section configured in a quadrupole mass to charge analyzer.

An alternative embodiment of the invention is shown in FIG. 31 where three segment ion guide 680 comprises curved ion guide segment 683 and single quadrupole mass to charge analyzer 683. Single quadrupole mass spectrometer assembly 700 comprises Electrospray ion source 693, RF surface assembly 694 with ion guide assembly 695, capillary 697, three segment multipole ion guide assembly 680 with RF surface 704, quadrupole mass to charge analyzer 683, electron multiplier detector 703 and four vacuum pumping stages 698, 699, 701 and 702. Three segment multipole ion guide assembly 680 comprises three straight segments 681, 682, curved segment 683, RF surface 704, first ion tunnel section 684, first open vacuum pumping section 689, second ion tunnel section 685, second open vacuum pumping section 690, third ion tunnel section 688 and third open vacuum pumping section 683. First gap 707 separating first ion guide segment 681 from second ion guide segment 682 is configured in first open vacuum pumping section 689 positioned in second vacuum pumping stage 699. Second gap 708 separating second ion guide segment 682 from curved third ion guide segment 683 is configure in third ion tunnel 688 configured to transfer ions from third vacuum stage 701 into forth vacuum stage 702. Ions produced in Electrospray ion source 693 are transferred through RF surface and ion guide 695 into the bore of capillary 697. Ions exiting the bore of capillary 697 into first vacuum stage 698 are focused into center channel 691 of three segment ion guide 680. In one embodiment of the invention common RF frequency amplitude and phase is applied to all three segments of three segment multipole ion guide 680. Different DC offset voltages applied to first, second and third multipole ion guide segments 681, 682 and 683 respectively are set to move ions through multipole ion guide center channel 691 and into quadrupole mass to charge analyzer 683 through DC electrodes 692. Ions mass to charge analyzed in quadrupole 683 are detected by electron multiplier detector 703.

Three segment multipole ion guide assembly 680 provides high ion transmission efficiency through four vacuum pumping stages while reducing the flow of neutral gas between vacuum pumping stages., Reduced gas flow between vacuum pumping stages without decreasing ion transfer efficiency maintains high sensitivity performance with lower vacuum pumping cost. Contamination cluster and aerosol species exiting capillary 697 pass through the gap in the poles of curved third multipole ion guide segment while radially trapped ions are transferred to quadrupole mass to charge analyzer 683. This separation of contamination species and analyte ions reduces signal noise due to contamination species in acquired mass spectra. Ions can be accelerated from first ion guide segment 681 into second ion guide segment 682 with sufficient energy to cause ion fragmentation in second segment 682 by applying appropriate relative DC offset potentials to ion guide segments 681 and 682. The kinetic energy of ions traversing first and second segments 681 and 682 respectively is reduced due to collisions with neutral background gas. This reduction in ion kinetic energy provides an ion beam with low energy spread and reduced cross section entering quadrupole mass to charge analyzer 683. A low energy spread ion beam focused into quadrupole 683 with low translational energy improves quadrupole mass to charge analysis resolving power and sensitivity.

RF surfaces and ion guides configured according to the invention can be combined with different ion sources and mass to charge analyzer known in the art. Ions traversing ion guides configured according to the invention can be subjected to ion manipulation functions including but not limited to kinetic energy cooling, trapping, mass to charge filtering, ion mobility separation, fragmentation, ion-molecule reactions, ion-ion reactions, charge reduction of multiply charged ions and combinations of these functions RF surfaces can be shaped in non planar shapes including but not limited to curved, inverted cones or hemispheres. The inner diameter to length aspect ratios of ion tunnel or conduit sections can range from 2 to 1 to hundreds to 1. Configurations of ion guides may include but not limited to multipole ion guides or sequential RF disk ion guides. Multipole ion guides may be configured as quadrupoles, hexapoles, octopoles or comprise more than eight poles. Multipole ion guides may be configured with parallel poles, poles angled relative to the ion guide centerline, round poles with uniform diameter along the length or round poles with tapered diameters along the length. Multipole ion guides may comprise one or more segments. Ion guide segments or different ion guides connected to different RF power supplies can be aligned to transfer ions between them with or without a DC lens positioned between the sequential ion guides. Junctions between ion guide segments or different ion guides can be made in ion tunnels or in open vacuum pumping ion guide sections. Multiple ion guide assemblies may be configured with different shaped electrode cross sections Different segments of the same ion guide may comprise different shaped cross sections connecting to a common RF power supply or different RF power supplies that operate with the same frequency and phase.

Although the present invention has been described in accordance with the embodiments shown, one of ordinary skill in the art will recognize that there can be variations to the embodiments and such variations would fall within the spirit and scope of the present invention.

What is claimed is:

1. An apparatus for trapping ions, comprising:

(a) an array of electrodes;

(b) AC voltages having different relative phase applied to adjacent electrodes of said array of electrodes;

(c) at least one DC offset voltage applied to said electrodes of said array of electrodes;

(d) at least one counter electrode;

(e) at least one DC voltage applied to said at least one counter electrode;

(f) at least one back electrode behind said array of electrodes;

(g) at least one DC voltage applied to said at least one back electrode;

(h) means to control said AC and DC voltages to trap ions in one or more trapping regions proximal to said array of electrodes; and (i) means for generating a magnetic field proximal to said array of electrodes; and (j) means for controlling the intensity of said magnetic field.

2. The apparatus of claim 1, further comprising:

(k) a mass analyzer; and (l) means for transferring said ions from said one or more trapping regions to said mass analyzer.

3. The apparatus of claim 2, wherein said mass analyzer comprises a Time-of-Flight Mass Spectrometer, a Time-of-Flight Mass Spectrometer with an ion reflector, a Fourier Transform Mass Spectrometer, a Quadrupole Mass Filter, a Three-dimensional Quadrupole Ion Trap Mass Spectrometer or a Two-dimensional Quadrupole Ion Trap Mass Spectrometer.

4. The apparatus of claim 2, wherein said means for transferring said ions from said one or more trapping regions to said mass analyzer for mass-to-charge analysis comprises an electric field applied in said one or more trapping regions.

5. The apparatus of claim 1, further comprising a Time-of-Flight mass analyzer comprising a pulsing region and a detector, said pulsing region comprising means to control said AC and DC voltages to pulse ions out of said one or more trapping regions for Time-of-Flight mass to charge analysis.

6. The apparatus of any of claims 1, 2 or 5, further comprising at least one side electrode positioned along the side border of said array of electrodes; and at least one DC voltage applied to said at least one side electrode.

7. The apparatus of any of claims 1, 2 or 5, wherein said AC voltages have substantially opposite relative phase.

8. The apparatus of any of claims 1, 2 or 5, wherein the frequency of said AC voltages is radio frequency.

9. The apparatus of any of claims 1, 2 or 5, wherein said electrode array is formed by electrodes comprising metal spheres, metal wires or metal wire tips.

10. The apparatus of any of claims 1, 2 or 5, wherein said alternating electrodes comprise a metal mesh and isolated metal wire tips within cells formed by said mesh.

11. The apparatus of any of claims 1, 2 or 5, further comprising an ion source that generates ions from a sample substance away from said pulsing region, and means for directing said ions into said trap region or pulsing region, as appropriate.

12. The apparatus of claim 11, wherein said ion source is an atmospheric pressure ion source, an Electrospray ion source, an Atmospheric Pressure Chemical Ionization ion source, a Matrix Assisted Laser Desorption Ionization ion source, an ion source which produces ions in vacuum, an Electron Impact Ionization ion source or a Chemical Ionization ion source.

13. The apparatus of claim 11, further comprising means for conducting mass-to-charge selection of ions prior to directing said mass-to-charge selected ions into said pulsing region.

14. The apparatus of claim 11, further comprising means for conducting fragmentation of said ions prior to directing said fragment ions into said pulsing region.

15. The apparatus of claim 14, wherein said fragmentation occurs due to gas phase collisional induced dissociation in a multipole ion guide.

16. The apparatus of claim 14, wherein mass-to-charge selection is conducted prior to said fragmentation.

17. The apparatus of claim 11, further comprising means for conducting mass-to-charge selection and fragmentation of said ions prior to directing said mass-to-charge selected and fragment ions into said pulsing region.

18. The apparatus of claim 11, further comprising means for trapping and releasing of said ions between said ion source and said pulsing region.

19. The apparatus of claim 11, further comprising means for conducting mass-to-charge selection and fragmentation of ions prior to directing said mass-to-charge selected and fragmented ions into said pulsing region.

20. The apparatus of any of claims 1, 2 or 5, wherein ions are created from sample substance molecules by ionization means within said pulsing region.

21. The apparatus of claim 20, wherein said ionization means comprise electrons, photons or ions.

22. The apparatus of any of claims 1, 2 or 5, wherein said array of electrodes is heated to a temperature above ambient temperature or cooled to a temperature below ambient temperature.

23. The apparatus of any of claims 1, 2 or 5, wherein said array of electrodes is replaceable.

24. The apparatus of any of claims 1, 2 or 5, further comprising means to provide neutral gas molecules within said pulsing region for collisional cooling of said ions.

25. The apparatus of claim 5, wherein said Time-of-Flight Mass Spectrometer comprises an ion reflector.

26. An apparatus for trapping and transporting ions, comprising:

(a) an array of electrodes;

(b) AC voltages having different relative phase applied to adjacent electrodes of said array of electrodes;

(c) at least one DC offset voltage applied to said electrodes of said array of electrodes;

(d) at least one counter electrode;

(e) at least one DC voltage applied to said at least one counter electrode;

(f) means to control said AC and DC voltages to trap ions in one or more trapping regions proximal to said array of electrodes;

(g) at least one set of at least four neighboring electrodes of said array of electrodes extending longitudinally behind said array of electrodes, thereby providing an RF multipole ion guide for ion transport of ions through said ion guide; and (h) gas flow for directing ion movement.

27. An apparatus for trapping and transporting ions, comprising:

(i) an array of electrodes;

(j) AC voltages having different relative phase applied to adjacent electrodes of said array of electrodes;

(k) at least one DC offset voltage applied to said electrodes of said array of electrodes;

(l) at least one counter electrode, (m) at least one DC voltage applied to said at least one counter electrode;

(n) means to control said AC and DC voltages to trap ions in one or more trapping regions proximal to said array of electrodes;

(o) at least one set of at least four neighboring electrodes of said array of electrodes extending longitudinally behind said array of electrodes, thereby providing an RF multipole ion guide for ion transport of ions through said ion guide, wherein said multipole ion guide comprises at least two multipole ion guide segments;

(p) separate DC offset voltages applied to each of at least two of said segments; and (q) means to control said DC offset voltages applied to said segments.

28. The apparatus of claim 26, further comprising at least one side electrode positioned along the side border of said array of electrodes; at least one backing electrode behind said array of electrodes; or at least one focus electrode for directing ions toward said counter electrode and said array of electrodes; and at least one DC voltage applied to said at least one side, backing or focus electrode, as appropriate.

29. The apparatus of claim 27, further comprising gas flow for directing ion movement.

30. The apparatus of claim 28, further comprising gas flow for directing ion movement.

31. The apparatus of any of claims 26, 27, 28, 29 or 30, wherein said multipole ion guide extends continuously through at least one vacuum partition between vacuum pumping stages.

32. The apparatus of claim 31, wherein the thickness of said vacuum partition is greater than the inscribed circle diameter of said ion guide, is greater than 10 times the inscribed circle diameter of said ion guide, or is greater than 100 times the inscribed circle diameter of said ion guide.

33. The apparatus of claim 31, wherein said vacuum partition comprises at least two vacuum walls, and vacuum regions between said vacuum walls from which background gas is pumped only via the internal opening of said ion guide into said vacuum pumping stages.

34. A method for trapping ions using an array of electrodes to which AC and DC voltages are applied, a counter electrode in front of said array of electrodes to which DC voltages are applied, at least one backing electrode behind said array of electrodes to which at least one DC voltage is applied, and a magnetic field proximal to said array, said method comprising the steps of:

(a) directing ions to or producing ions in a region between said array of electrodes and said counter electrode;

(b) applying voltages to said array of electrodes and said counter electrode to trap said ions in said region; and (c) generating said magnetic field to trap said ions in said region.

35. The method of claim 34, wherein the ions are directed to a region between the electrode array and the counter electrode further comprising processing said ions in one or more trapping regions.

36. The method of claim 35, wherein processing said ions comprises directing said ions to collide with surfaces in said one or more trapping regions to produce fragment ions by surface induced dissociation, or without producing fragment ions.

37. The method of claim 35, wherein processing said ions comprises the steps of directing said ions to be retained on a MALDI matrix material in said one or more trapping regions; and removing said ions, or molecules formed from said ions, using a MALDI laser pulse.

38. The method of claim 35, wherein processing said ions comprises introducing neutral gas molecules into said one or more trapping regions to collide with said ions.

39. A method for analyzing chemical species using an array of electrodes to which AC and DC voltages are applied, a counter electrode in front of said array of electrodes to which DC voltages are applied, at least one backing electrode behind said array of electrodes to which at least one DC voltage is applied, a magnetic field proximal to said array, and a mass spectrometer, said method comprising:

(a) directing ions to a region between said array of electrodes and said counter electrode;

(b) applying voltages to said array of electrodes and said counter electrode to trap said ions in said region;

(c) generating said magnetic field to trap said ions in said region; and (d) directing said ions from one or more trapping regions into said mass analyzer for mass-to-charge analysis.

40. The method of claim 39, the method further comprising:

processing said ions in said one or more trapping regions.

41. The method of any of claims 34 or 40, wherein processing said ions comprises introducing neutral gas molecules into one or more trapping regions to collide with said ions.

42. A method for analyzing chemical species using an array of electrodes to which AC and DC voltages are applied, a counter electrode in front of said array of electrodes to which DC voltages are applied, at least one backing electrode behind said array of electrodes to which at least one DC voltage is applied, a magnetic field proximal to said array, and a mass spectrometer, said method comprising:

(a) producing ions from said chemical species in a region between said array of electrodes and said counter electrode;

(b) applying voltages to said array of electrodes and said counter electrode to trap said ions in said region;

(c) generating said magnetic field to trap said ions in said region; and (d) directing said ions from one or more trapping regions into said mass analyzer for mass-to-charge analysis.

43. The method of claim 42, further comprising processing said ions in said one or more trapping regions.

44. The method of claim 43, wherein processing said ions comprises introducing neutral gas molecules into said one or more trapping regions to collide with said ions.

45. A method for analyzing chemical species using a Time-of-Flight mass spectrometer comprising a pulsing region and a detector, said pulsing region comprising an array of electrodes to which AC and DC voltages are applied and a counter electrode to which DC voltages are applied, and a magnetic field proximal to said array, said method comprising:

(a) operating an ion source to produce ions;

(b) processing said ions and delivering said processed ions to the region between said array of electrodes and said counter electrode;

(c) applying voltages to said array of electrodes and said counter electrode to trap said processed ions in said region;

(d) generating said magnetic field to trap said ions in said region;

(e) directing said processed ions from one or more trapping regions into said Time-of-Flight mass analyzer for mass-to-charge analysis.

46. The method of claim 45, further comprising processing said processed ions in said one or more trapping regions.

47. The method of any of claims 45 or 46, wherein processing said ions comprises fragmenting said ions by gas phase collision induced dissociation, mass-to-charge selecting said ions, fragmenting and mass-to-charge selecting said ions, mass-to-charge selecting and fragmenting said mass-to-charge selected ions, or trapping and releasing said ions.

48. The method of any of claims 45 or 46, wherein processing said processed ions comprises introducing neutral gas molecules into said one or more trapping regions to collide with said ions.

49. A method for trapping and transporting ions using an array of electrodes to which AC and DC voltages are applied, wherein at least one set of at least four neighboring electrodes of said array of electrodes extend longitudinally behind said array of electrodes, thereby providing an RF multipole ion guide for ion transport, wherein said multipole ion guide comprises at least two multipole ion guide segments to which DC offsets are applied, and a counter electrode in front of said array of electrodes to which DC voltages are applied, said method comprising:

(a) directing ions to or producing ions in a region between said array of electrodes and said counter electrode;

(b) applying voltages to said array of electrodes and said counter electrode to trap said ions in said region;

(c) directing said ions into a first segment of said multipole ion guide;

(d) adjusting said DC offset voltages applied to said segments to control ion transport between said segments.

50. The method of claim 49, wherein said step of adjusting said DC offset voltages applied to said segments to control ion transport efficiency comprises adjusting said DC offset voltages such that said first segment DC offset voltage is lower than a subsequent segment DC offset voltage, to cause trapping of said ions within said first segment.

51. The method of claim 50, wherein background neutral gas molecules are provided within at least a portion of said first ion guide segment, such that collisions between said background gas molecules and said ions causes reduction of kinetic energy of said ions.

52. The method of claim 49, wherein said step of adjusting said DC offset voltages applied to said segments to control ion transport efficiency comprises adjusting said DC offset voltages such that said first DC offset voltage is higher than a subsequent segment DC offset voltage, to cause acceleration of said ions from said first segment into said subsequent segment.

53. The method of claim 52, wherein neutral background gas molecules are provided within and proximal to the region between said ion guide segments, and said acceleration of said ions cause ions to collide with said gas molecules with sufficient collision energy to effect collision-induced fragmentation of said ions.

* * * * *

UNITED STATES PATENT AND TRADEMARK OFFICE

CERTIFICATE OF CORRECTION

PATENT NO. : 7,786,435 B2
APPLICATION NO. : 12/111484
DATED : August 31, 2010
INVENTOR(S) : Craig M. Whitehouse It is certified that error appears in the above-identified patent and that said Letters Patent is hereby corrected as shown below:

Title page, Column 2 (Other Publications),
Line 1, Delete "Collission" and insert --Collision--

Title page, Column 2 (Other Publications),
Line 3, Delete "Quadropole" and insert --Quadruple--

Title page, Column 2 Item [57] (Abstract),
Line 3, Delete "guides potential" and insert --guides. Potential--

Title page, Column 2 Item [57] (Abstract),
Line 7, Delete "wells" and insert --wells.--

Column 40,
Line 59, Delete "electrode" and insert --electrode;--

Signed and Sealed this

Seventh Day of December, 2010

David J. Kappos

David J. Kappos
*Director of the United States Patent and Trademark Office*